US012104461B2

(12) United States Patent
Macphail et al.

(10) Patent No.: US 12,104,461 B2
(45) Date of Patent: Oct. 1, 2024

(54) ASYNCHRONOUS FRAC-TO-FRAC OPERATIONS FOR HYDROCARBON RECOVERY AND VALVE SYSTEMS

(71) Applicant: NCS MULTISTAGE, INC., Calgary (CA)

(72) Inventors: Warren Macphail, Calgary (CA); Jesse Powell, Calgary (CA); Michael Werries, Calgary (CA); Brock Gillis, Calgary (CA)

(73) Assignee: NCS MULTISTAGE, INC., Calgary (CA)

( * ) Notice: Subject to any disclaimer, the term of this patent is extended or adjusted under 35 U.S.C. 154(b) by 0 days.

(21) Appl. No.: 17/787,230

(22) PCT Filed: Dec. 21, 2020

(86) PCT No.: PCT/CA2020/051780
§ 371 (c)(1),
(2) Date: Jun. 17, 2022

(87) PCT Pub. No.: WO2021/119852
PCT Pub. Date: Jun. 24, 2021

(65) Prior Publication Data

US 2023/0022332 A1 Jan. 26, 2023

Related U.S. Application Data

(60) Provisional application No. 62/951,307, filed on Dec. 20, 2019.

(51) Int. Cl.
*E21B 34/14* (2006.01)
*E21B 43/12* (2006.01)
(Continued)

(52) U.S. Cl.
CPC ..... *E21B 34/142* (2020.05); *E21B 43/12* (2013.01); *E21B 43/14* (2013.01); *E21B 43/26* (2013.01); *F04B 23/00* (2013.01); *E21B 2200/06* (2020.05)

(58) Field of Classification Search
CPC ..... E21B 2200/06; E21B 34/08; E21B 34/14; E21B 34/142; E21B 43/162; E21B 43/14; E21B 43/26; F16K 15/18
See application file for complete search history.

(56) References Cited

U.S. PATENT DOCUMENTS 2,850,264 A 9/1958 Grable
3,115,187 A 12/1963 Brown
(Continued)

FOREIGN PATENT DOCUMENTS

CA 2820472 3/2008
CA 2820932 1/2015
(Continued)

OTHER PUBLICATIONS

International Search Report and Written Opinion for International (PCT) Patent Application No. PCT/CA2020/051780, dated Feb. 23, 2021, 11 pages.
(Continued)

*Primary Examiner* — Kenneth L Thompson
(74) *Attorney, Agent, or Firm* — Sheridan Ross P.C.

(57) ABSTRACT

The present description relates to processes and systems for asynchronous frac-to-frac operations for recovering hydrocarbons. The processes can include the use of injection-only and production-only valves that include a housing and at least one sleeve as well as flow restriction components, check valves, or other features. The flow restriction component can be a tortuous path provided in the sleeve. The check valves can be integrated into the sleeve or into the
(Continued)

housing of the valve. Various different types of valve assemblies can be used and integrated with flow restriction components and/or check valves.

28 Claims, 35 Drawing Sheets

(51) Int. Cl.

| | |
|---|---|
| ***E21B 43/14*** | (2006.01) |
| ***E21B 43/26*** | (2006.01) |
| ***F04B 23/00*** | (2006.01) |

(56) References Cited

U.S. PATENT DOCUMENTS

| | | | | |
|---|---|---|---|---|
| 4,476,932 | A | 10/1984 | Emery | |
| 4,705,113 | A | 11/1987 | Perkins | |
| 4,754,812 | A | 7/1988 | Gentry | |
| 5,014,787 | A | 5/1991 | Duerksen | |
| 5,363,919 | A | 11/1994 | Jennings, Jr. | |
| 5,894,888 | A | 4/1999 | Wiemers et al. | |
| 6,015,015 | A | 1/2000 | Luft et al. | |
| 6,318,469 | B1 | 11/2001 | Patel | |
| 6,782,948 | B2 | 8/2004 | Echols et al. | |
| 7,128,150 | B2 | 10/2006 | Thomas et al. | |
| 7,331,398 | B2 | 2/2008 | Dwivedi et al. | |
| RE40,308 | E | 5/2008 | Hamilton et al. | |
| 7,575,062 | B2 | 8/2009 | East, Jr. | |
| 8,171,994 | B2 | 5/2012 | Murray et al. | |
| 8,657,015 | B2 * | 2/2014 | Patel | E21B 34/08 166/325 |
| 8,739,887 | B2 * | 6/2014 | Veit | E21B 34/08 166/374 |
| 9,121,272 | B2 | 9/2015 | Potapenko et al. | |
| 9,127,544 | B2 * | 9/2015 | Dombrowski | E21B 43/26 |
| 9,249,649 | B2 * | 2/2016 | Fripp | E21B 34/08 |
| 9,428,989 | B2 | 8/2016 | Aitken et al. | |
| 9,562,422 | B2 | 2/2017 | Sharma et al. | |
| 9,631,466 | B2 | 4/2017 | Greci et al. | |
| 9,976,400 | B2 | 5/2018 | Ayasse | |
| 10,287,863 | B2 * | 5/2019 | Ayasse | E21B 34/12 |
| 10,648,327 | B2 | 5/2020 | Tinnen et al. | |
| 10,767,456 | B2 * | 9/2020 | Konopczynski | E21B 43/16 |
| 10,890,057 | B2 * | 1/2021 | MacPhail | E21B 17/1035 |
| 11,261,715 | B2 * | 3/2022 | Johnson | E21B 34/14 |
| 11,299,960 | B2 * | 4/2022 | Zachariah | E21B 43/12 |
| 2011/0100643 | A1 | 5/2011 | Themig et al. | |
| 2013/0014953 | A1 | 1/2013 | van Petegem | |
| 2015/0021018 | A1 | 1/2015 | Tunget | |
| 2015/0369023 | A1 | 12/2015 | MacPhail et al. | |
| 2016/0047179 | A1 | 2/2016 | Kjorholt et al. | |
| 2016/0076335 | A1 | 3/2016 | Getzlaf et al. | |
| 2019/0242224 | A1 * | 8/2019 | Keller | E21B 43/26 |

FOREIGN PATENT DOCUMENTS

| | | |
|---|---|---|
| CA | 2855146 | 11/2015 |
| RU | 2456441 | 7/2012 |
| WO | WO 2014/082054 | 5/2014 |
| WO | WO 2018/076119 | 5/2018 |
| WO | WO 2018/161158 | 9/2018 |

OTHER PUBLICATIONS

Konopczynski et al. "Improving the Performance of EOR in Unconventional Oil Reservoirs Using Advanced Completion Technology," Society of Petroleum Engineers Improved Oil Recovery Conference, Tulsa, Oklahoma, No. SPE-190260-MS, Apr. 14-18, 2018, 19 pages.

Mydland et al., "Gas EOR Processes in Tight Unconventionals," Society of Petroleum Engineers Improved Oil Recovery Conference, No. SPE-200396-MS, Aug. 30, 2020, 22 pages.

Extended European Search Report for Europe Patent Application No. 20902086.6, dated Nov. 16, 2023, 15 pages.

* cited by examiner

FIG. 57A
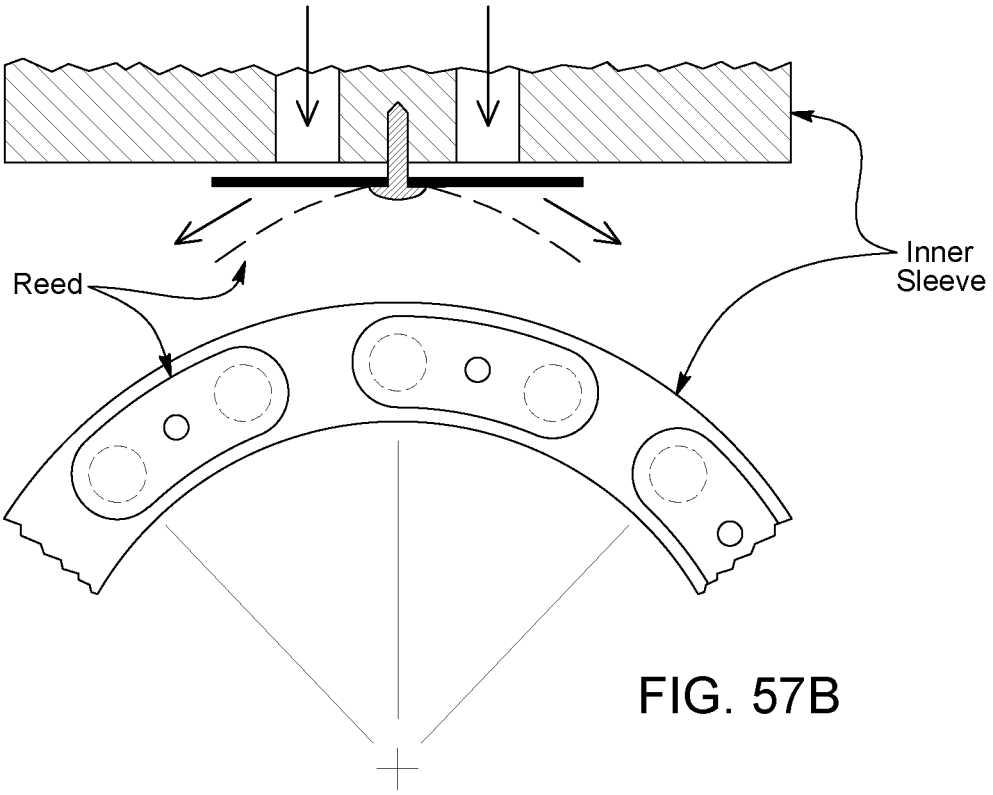
FIG. 57B
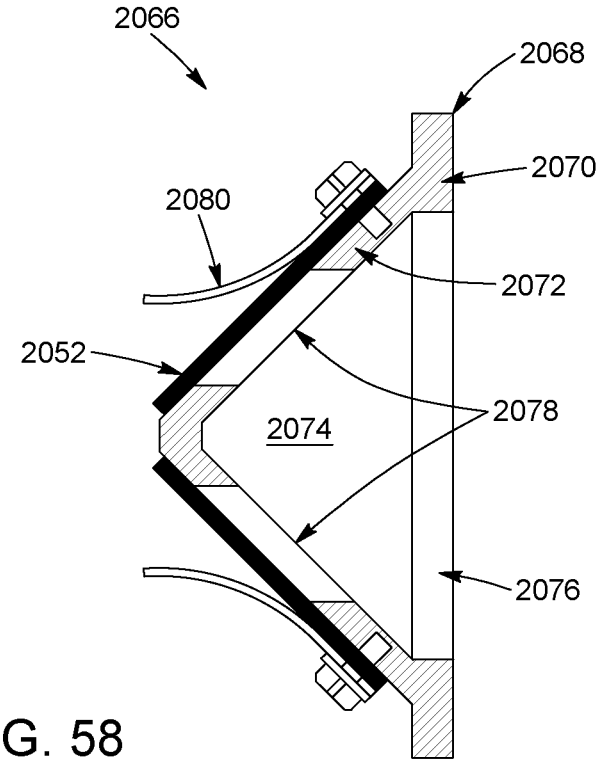
FIG. 58

ASYNCHRONOUS FRAC-TO-FRAC OPERATIONS FOR HYDROCARBON RECOVERY AND VALVE SYSTEMS

CROSS REFERENCE TO RELATED APPLICATIONS

This application is a national stage application under 35 U.S.C. § 371 and claims the benefit of PCT Application No. PCT/CA2020/051780 having an international filing date of 21 Dec. 2020, which designated the United States, which PCT application claimed the benefit of U.S. Provisional Patent Application No. 62/951,307 filed 20 Dec. 2019, the disclosures of each of which are incorporated herein by reference in their entireties.

TECHNICAL FIELD

The technical field generally relates to recovering hydrocarbons from fractured reservoirs that have been hydraulically fractured and related operating methods, and more particularly frac-to-frac displacement flood operations for recovering hydrocarbons.

BACKGROUND

Recovering hydrocarbons from an underground formation can be enhanced by fracturing the formation in order to form fractures through which hydrocarbons can flow from the reservoir into a well. Fracturing can be performed prior to primary recovery where hydrocarbons are produced to the surface without imparting energy into the reservoir. Fracturing can be performed in stages along the well to provide a series of fractured zones in the reservoir. Following primary recovery, it can be of interest to inject fluids to increase reservoir pressure and/or displace hydrocarbons as part of a secondary recovery phase. Tertiary recovery can also be performed to increase the mobility of the hydrocarbons, for example by injecting mobilizing fluid and/or heating the reservoir. Tertiary recovery of oil is often referred to as enhanced oil recovery (EOR). Depending on various factors, primary recovery can be immediately followed by tertiary recovery without conducting any secondary recovery. In addition, some recovery operations include elements of pressurization and displacement as well as mobilizing of the hydrocarbons. Injecting fluids into a fractured reservoir and recovering hydrocarbons involves a number of challenges and there is a need for enhanced technologies.

SUMMARY

A asynchronous frac-to-frac processes and systems can include a number of features for enhanced operation, such as a hybrid method where at least one cyclic valve is operated in injection and production modes to access hydrocarbons in an isolated fractured zone while at least a pair or group of valves is operated with valves in injection-only and production-only modes; implementing valves that have sliding sleeves that include one or more check-valve devices to allow only production or only injection; providing flow restrictions on the sleeves; using valves that can be remotely controlled between fully open and fully closed positions and optionally controlling the valves based on data regarding properties of the fractured zones, fluid characteristics and/or flow behavior; monitoring the asynchronous frac-to-frac operation and adjusting the groupings of valves operating in injection-only and production-only modes over time; and managing the asynchronous frac-to-frac of multiple proximal wells to avoid fluid breakthrough and optimize the overall multi-well process.

In some implementations, there is provided a process for producing hydrocarbons from a fractured reservoir via a well that has been operated for primary production of hydrocarbons, comprising: conducting an asynchronous frac-to-frac operation comprising asynchronously injecting an injection fluid into the reservoir and producing production fluid from the reservoir respectively via injection-only valves and production-only valves provided in alternating relation along the well to enable frac-to-frac hydrocarbon recovery from fractured zones in the reservoir; wherein the production-only valves and/or the injection-only valves each comprise: a housing with a port for fluid communication therethrough; and a sliding sleeve mounted within the housing and configured to slide therein, the sliding sleeve comprising a check valve device for alignment with the port of the housing upon shifting the sliding sleeve to an aligned configuration to allow fluid flow through the check valve device in one direction.

In some implementations, the production-only valves each comprise a production check-valve device for alignment with the port of the housing to enable inflow of production fluid during a production cycle of the asynchronous frac-to-frac operation while preventing outflow of injection fluid during an injection cycle of the asynchronous frac-to-frac operation. In some implementations, the injection-only valves each comprise an injection check-valve device for alignment with the port of the housing enable outflow of injection fluid during an injection cycle of the asynchronous frac-to-frac operation while preventing inflow of production fluid during a production cycle of the asynchronous frac-to-frac operation. In some implementations, the production-only valves each comprise a production check-valve device and the injection-only valves each comprise an injection check-valve device.

In some implementations, the sliding sleeve comprises a sleeve channel providing fluid communication between a central passage of the corresponding valve and the port of the housing, and wherein the check valve device comprises a displaceable member mounted within a check valve chamber of the sleeve channel, the displaceable member being moveable between an open position and a closed position.

In some implementations, the check valve chamber of the sleeve channel is defined by a recessed region of an outer surface of the sleeve and an inner surface of the housing. In some implementations, the sleeve channel comprises axial tubular portions on either side of the check valve chamber. In some implementations, the sleeve channel comprises a second chamber in direct fluid communication with the port of the housing and one of the axial tubular portions. In some implementations, the displaceable member of the check valve device comprises an axial poppet having through-channels that provide fluid communication in the open position. In some implementations, the displaceable member of the check valve device comprises a dart around which fluid flows in the open position. In some implementations, the displaceable member of the check valve device comprises a ball. In some implementations, the sleeve channel comprises a plurality the check valve chambers arranged around a circumference of the sleeve and in parallel relation with each other, wherein each of the check valve chambers has a corresponding displaceable member therein and is in fluid communication with the central passage and with the port of the housing. In some implementations, the check valve chamber extends circumferentially around the sleeve and the displaceable member of the check valve device comprises a ring plug that extends around the check valve chamber. In some implementations, the displaceable member is configured to move axially within the check valve chamber.

In some implementations, the sliding sleeve comprises a sleeve channel providing fluid communication between a central passage of the corresponding valve and the port of the housing, and wherein the check valve device comprises a reed petal mounted with respect to the sleeve channel to be moveable between an open position and a closed position. In some implementations, the reed petal is mounted to be parallel with a longitudinal axis of the sleeve in the closed position, and to deflect radially outward toward the open position. In some implementations, the reed petal is mounted to be perpendicular with a longitudinal axis of the sleeve in the closed position. In some implementations, the reed petal is mounted to cover an end opening of the sleeve channel.

In some implementations, the sleeve comprises a first sleeve part having a sleeve port in fluid communication with the port of the housing, and a second sleeve part mounted to the first sleeve part such that the first and second sleeve parts define therebetween at least part of the sleeve channel.

In some implementations, the check valve device further comprises a biasing mechanism coupled to the displaceable member to bias the same toward the closed position. The biasing member can include a spring.

In some implementations, the check valve device comprises a displaceable member that is configured to move outwardly from a closed position to an open position.

In some implementations, the sliding sleeve comprises a sleeve channel providing fluid communication between a central passage of the corresponding valve and the port of the housing, the sleeve channel comprising a circumferential chamber extending at least partly around a circumference of the sleeve, and wherein the check valve device comprises a circumferential dart mounted within the circumferential chamber of the sleeve channel and being moveable between an open position and a closed position. In some implementations, the check valve device comprises a plurality of the circumferential chambers and corresponding circumferential darts provided therein, arranged in spaced-apart relation and stacked along the sleeve.

In some implementations, the check valve device comprises a circumferential reed valve comprising curved reed petals that extend over corresponding openings and follow a curvature of the sleeve.

In some implementations, the sliding sleeve of each valve is configured to have a first configuration, a down-shifted open configuration, and an upshifted open configuration. In some implementations, the first configuration of the sliding sleeve is a closed configuration. In some implementations, the sliding sleeve of each valve comprises a production-only check valve device configured for alignment with the port of the housing when the sleeve is shifted in one direction, and an injection-only check valve device configured for alignment with the port of the housing when the sleeve is shifted in another direction. In some implementations, the sliding sleeve of each valve further comprises flow restriction components associated with the production-only check valve device and the injection-only check valve device, respectively, to restrict a flow rate when the corresponding check valve device is open. In some implementations, the flow restriction components associated with the production-only check valve device and the injection-only check valve device are configured to provide different flow restriction.

In some implementations, the sliding sleeve of each valve further comprises a flow restriction component in fluid communication with the check valve device to restrict a flow rate when the check valve device is open. In some implementations, the flow restriction component comprises a tortuous path.

In some implementations, there is provided a process for producing hydrocarbons from a fractured reservoir via a well, comprising:

- deploying a tubing down a wellbore and comprising multiple valves distributed along its length, each valve comprising:
  - a housing comprising a housing port though a sidewall thereof;
  - a frac sleeve provided in the housing and configured to be slidable between a closed position where the frac sleeve covers and block the housing port, and an open position where the housing port is in fluid communication with an internal conduit of the housing and the reservoir; and
  - a second-phase sleeve provided in the housing;
- fracturing the reservoir, comprising for each valve:
  - shifting the frac sleeve to the open position;
  - injecting fracturing fluid down the well to flow through the housing port and into the corresponding zone of the reservoir to provide a fractured zone;
  - shifting the frac sleeve to the closed position retain fracturing fluid within the reservoir;
  - conducting primary hydrocarbon recovery from the reservoir, comprising:
  - shifting the frac sleeve to the open position;
  - causing fluid to flow from the reservoir through the housing port and up via the tubing to surface;
- after a period of time, ceasing the primary hydrocarbon recovery from the reservoir;
- conducting an asynchronous frac-to-frac operation in the well, comprising:
  - shifting the second-phase sleeves of the respective valves to convert the valves into a first set of production-only valves and a second set of injection-only valves;
  - asynchronously injecting an injection fluid into the reservoir and producing production fluid from the reservoir respectively via the injection-only valves and the production-only valves to enable frac-to-frac hydrocarbon recovery via the well.

In some implementations, there is provided a process for producing hydrocarbons from a fractured reservoir via a well, comprising:

- conducting primary hydrocarbon recovery from the reservoir in which a wellbore is provided, wherein a tubing comprising multiple valves distributed along its length is disposed in the wellbore, and wherein:
  - each valve comprises:
    - a housing comprising a housing port though a sidewall thereof;
      - a frac sleeve provided in the housing and configured to be slidable between a closed position where the frac sleeve covers and block the housing port, and an open position where the housing port is in fluid communication with an internal conduit of the housing and the reservoir; and
      - a second-phase sleeve provided in the housing; and
  - each valve is operable for fracturing the reservoir wherein, for each valve, the frac sleeve is shiftable to the open position, the housing port is capable or receiving fracturing fluid injected down the well to flow into the corresponding zone of the reservoir to provide a fractured zone; and the frac sleeve is shiftable to the closed position retain fracturing fluid within the reservoir;

wherein the primary hydrocarbon recovery comprises operating the valves such that the frac sleeve is in the open position such that fluid flows from the reservoir through the housing port and up via the tubing to surface;

after a period of time, ceasing the primary hydrocarbon recovery from the reservoir; and conducting an asynchronous frac-to-frac operation in the well, wherein the second-phase sleeves of the respective valves are positioned to operate the valves as a first set of production-only valves and a second set of injection-only valves, the asynchronous frac-to-frac operation comprising: asynchronously injecting an injection fluid into the reservoir and producing production fluid from the reservoir respectively via the injection-only valves and the production-only valves.

In some implementations, each of the valves comprises a check valve device provided in the second-phase sleeve. In some implementations, each of the valves comprises a production-only check valve device and an injection-only check valve device provided in the second-phase sleeves. In some implementations, the check valve device comprises an axial poppet check valve, an axial dart check valve, an axial ring check valve, a circumferential dart check valve, a reed valve, or a combination thereof. In some implementations, the check valve device further comprises a biasing mechanism configured to provide a biasing force toward a closed position of the check valve device.

In some implementations, there is provided a process for producing hydrocarbons from a fractured reservoir via a well that has been operated for primary production of hydrocarbons, comprising: conducting an asynchronous frac-to-frac operation comprising asynchronously injecting an injection fluid into the reservoir and producing production fluid from the reservoir respectively via injection-only valves and production-only valves provided in alternating relation along the well to enable frac-to-frac hydrocarbon recovery from fractured zones in the reservoir; wherein the production-only valves and/or the injection-only valves each comprise: a housing with a port for fluid communication therethrough; a flow restriction component in fluid communication with the port and configured to restrict a flow rate of fluid flowing therethrough; and a check valve device in fluid communication with the port and the flow restriction for providing one-way flow.

In some implementations, the flow restriction component comprises a tortuous path. In some implementations, the flow restriction component is provided by a sleeve that is mounted within the housing. The flow restriction component can have various other features as described herein.

In some implementations, the check valve device is provided in a sleeve channel defined by the sleeve. In some implementations, the check valve device comprises an axial poppet check valve, an axial dart check valve, a ring plug check valve, a reed check valve, or a circumferential dart check valve. In some implementations, the sleeve comprises a plurality of sleeve channels, each having a corresponding check valve provided therein. In some implementations, the sleeve is fixed with respect to the housing. In some implementations, the sleeve is slidable with respect to the housing between at least a first configuration and a second configuration. In some implementations, the check valve device is provided in the port of the housing. In some implementations, the check valve device is a radial poppet check valve.

In some implementations, the production-only valves and the injection-only valves are in fluid communication with a single well string comprising conduit sections that are interconnected together along the well, the well string providing the injection fluid during injection cycles and receiving production fluid during production cycles of the asynchronous frac-to-frac operation. In some implementations, the production-only valves are in fluid communication with a production conduit system, and the injection-only valves are in fluid communication with an injection conduit system that is fluidly isolated from the production conduit system in the well. In some implementations, the production conduit system and the injection conduit system are arranged in side-by-side relation to each other. In some implementations, the production conduit system and the injection conduit system are arranged concentrically with respect to each other.

In some implementations, both the production-only valves and the injection-only valves each comprise corresponding flow restriction components and check valve devices. Alternatively, only the injection-only valves or only the production-only valves could comprise the flow restriction components and the check valve devices.

In some implementations, the sleeve of each valve comprises a production-only check valve device configured for alignment with the port of the housing when the sleeve is shifted in one direction, and an injection-only check valve device configured for alignment with the port of the housing when the sleeve is shifted in another direction.

In some implementations, there is provided a process for producing hydrocarbons from a fractured reservoir via a well that has been operated for primary production of hydrocarbons, comprising: conducting an asynchronous frac-to-frac operation comprising asynchronously injecting an injection fluid into the reservoir and producing production fluid from the reservoir respectively via injection-only valves and production-only valves provided in alternating relation along the well to enable frac-to-frac hydrocarbon recovery from fractured zones in the reservoir; wherein the production-only valves and/or the injection-only valves each comprise: a housing having a central passage and a housing wall with a port therethrough for fluid communication between the central passage and an exterior of the housing; and a sleeve mounted within the central passage of the housing, the sleeve comprises a sleeve channel and a check valve device cooperating with the sleeve channel for providing one-way flow therethrough, wherein the sleeve is positionable such that the sleeve channel is in fluid communication with the port of the housing and the central passage to provide fluid flow therebetween when fluid pressure enables the check valve device to move from a closed position to an open position.

In some implementations, the check valve device is an axial poppet check valve, a ring plug check valve, a reed valve such as an end or side reed valve, a circumferential dart check valve, or another types of check valve. In some implementations, the sleeve channel comprises multiple sleeve channel portions in parallel with respect to each other, each sleeve channel cooperating with a corresponding check valve device. The multiple sleeve channel portions can extend axially or circumferentially depending on the check valve construction that is used.

In some implementations, the sleeve is fixedly mounted within the housing. In some implementations, the sleeve is shiftably mounted within the housing and is shiftable between at least a non-aligned position and an aligned position in which the sleeve channel is in fluid communication with the port of the housing. The sleeves can be shifted remotely or using a downhole tool.

In some implementations, both the production-only valves and the injection-only valves comprise respective sleeves and check valve devices cooperating with the respective sleeve channels.

In some implementations, there is provided a process for producing hydrocarbons from a fractured reservoir via a well that has been operated for primary production of hydrocarbons, comprising: conducting an asynchronous frac-to-frac operation comprising asynchronously injecting an injection fluid into the reservoir and producing production fluid from the reservoir respectively via injection-only valves and production-only valves provided in alternating relation along the well to enable frac-to-frac hydrocarbon recovery from fractured zones in the reservoir; wherein the production-only valves and/or the injection-only valves each comprise: a housing having a central passage and a housing wall within a port therethrough for fluid communication between the central passage and an exterior of the housing; and a sleeve mounted within the central passage of the housing, the sleeve comprising a flow restriction component including a tortuous path defined therein and being positionable to provide fluid communication between the port and the central passage.

In some implementations, the tortuous path comprises a groove in an outer surface of the sleeve. In some implementations, the tortuous path comprises a boustrophedonic pattern. In some implementations, the injection-only valves and the production-only valves each include a corresponding sleeve providing the tortuous path therein. In some implementations, the sleeve is fixedly mounted within the housing. In some implementations, the sleeve is shiftably mounted within the housing and is shiftable between at least a non-aligned position and an aligned position in which the tortuous path is in fluid communication with the port of the housing.

In some implementations, there is provided a hybrid process for producing hydrocarbons from a fractured reservoir via a well that has been operated for primary production of hydrocarbons, comprising: conducting an asynchronous frac-to-frac operation comprising asynchronously injecting an injection fluid into the reservoir and producing production fluid from the reservoir respectively via injection-only valves and production-only valves provided along the well to enable frac-to-frac hydrocarbon recovery from a first set of fractured zones in the reservoir; and concurrently with the asynchronous frac-to-frac operation, conducting a cyclical huff-and-puff operation comprising cyclically injecting injection fluid and producing production fluid from a cyclically-operated valve provided in the well in fluid communication with an isolated fractured zone that is hydraulically isolated from all other fractured zones of the reservoir.

In some implementations, the process further includes, prior to commencing the asynchronous frac-to-frac operation and the cyclical huff-and-puff operation, measuring at least one property of the fractured zones and determining: the first set of fractured zones having adjacent zone pairs that are in hydraulic communication; and the isolated fractured zone. In some implementations, the process further includes, during the asynchronous frac-to-frac operation and the cyclical huff-and-puff operation, measuring at least one property of the fractured zones and determining: the first set of fractured zones having adjacent zone pairs that are in hydraulic communication; and the isolated fractured zone.

In some implementations, if the isolated zone is determined to have become in hydraulic communication with another fractured zone, the process further comprises converting the cyclically-operated valve into an injection-only valve or a production-only valve or a closed valve.

In some implementations, if a fractured zones of the first set of fractured zones is determined to have become hydraulically isolated from the other fractured zones, further comprising converting the injection-only or production-only valve in communication with that fractured zone into a cyclically-operated valve or a closed valve.

In some implementations, the at least one property of the fractured zones comprises injectivity, pressure drop-off, or flow rates. In some implementations, multiple cyclically-operated valves are operated in respective isolated fractured zones along the well. In some implementations, each of the cyclically-operated valve, injection-only valve and/or production-only valve is in fluid communication with an adjacent fractured zone that corresponds to a single fractured stage along the well. In some implementations, each of the cyclically-operated valve, injection-only valve and/or production-only valve is in fluid communication with an adjacent fractured zone that corresponds to multiple fractured stages along the well. In some implementations, at least one of the cyclically-operated valve, the injection-only valve and/or the production-only valve is in fluid communication with an adjacent fractured zone that corresponds to multiple fractured stages along the well. In some implementations, at least one of the fractured zones is in fluid communication with multiple valves. In some implementations, prior to commencing the cyclical huff-and-puff operation, all of valves along the well are operated for the asynchronous frac-to-frac operation.

In some implementations, the process further includes, prior to commencing the asynchronous frac-to-frac operation and the cyclical huff-and-puff operation, the steps of: ceasing the primary production; deploying a tubing string down the well to run along a length thereof, the tubing string being configured for fluid flow therethrough and defining an annulus between an outer surface thereof and an outer casing of the well; deploying the valves down the well, wherein each valve is in fluid communication with the tubing string; and providing packers in the annulus to isolate each of the valves with respect to each other.

In some implementations, the cyclically-operated valve comprises a cyclical port for injection and production. In some implementations, the cyclical port is configured in a static open position during injection and production. In some implementations, the injection-only valves each comprise a housing with a port, and an injection check-valve device in fluid communication with the port, wherein the injection check-valve device is configured to allow injection fluid into the reservoir and prevents flow from the reservoir into the injection-only valve. In some implementations, the injection-only valves each comprise a sliding sleeve mounted within the housing and configured to slide therein, the sliding sleeve comprising the injection check-valve device for alignment with the port to provide a configuration for injection only. In some implementations, the production-only valves each comprise a housing and a port, and a production check-valve device in fluid communication with the port, wherein the production check-valve device is configured to allow production fluid into the valve from the reservoir and prevents flow of the injection fluid into the reservoir. In some implementations, the production-only valves each comprise a sliding sleeve mounted within the housing and configured to slide therein, the sliding sleeve comprising the production check-valve device for alignment with the port to provide a configuration for production only. In some implementations, the production-only valves and the injection-only valves have an identical construction wherein for each valve the sliding sleeve comprises the production check-valve device and the injection check-valve device located at different positions thereon, such that he sliding sleeve can be displaced to align either the production check-valve device or the injection check-valve device in order to configure the given valve as a corresponding production-only valve or injection-only valve, respectively. In some implementations, the sliding sleeves are displaceable by remote control. In some implementations, the sliding sleeves are displaceable by deploying a shifting tool downhole to engage and shift the sliding sleeve. In some implementations, the injection-only valves and the production-only valves each comprise a housing with a port; and a piston mounted within the housing and displaceable between a first position where a portion thereof occludes the port, and a second position where the first port is open for fluid communication therethrough. In some implementations, the valves each further comprise an actuator within the housing and configured to cause the piston to move between the first and second positions. In some implementations, the actuator comprises: a pump mounted within the housing and configured to move hydraulic fluid to cause the piston to move between the first and second position; a motor coupled to the pump to power the pump; and a power and control system coupled to the motor to provide power thereto and to control the motor between a first mode to cause the piston to move to the first position and a second mode to cause the piston to move to the second position, the power and control system being coupled to a command system at surface. In some implementations, each valve is configured to move only between a fully closed position corresponding to the first position and a fully open position corresponding to the second position.

In some implementations, the process further includes controlling each of the valves to be in the first position or the second position to enable the asynchronous frac-to-frac operation, such that: a first set of the valves is controlled to be in the first position during injection of the injection fluid and the second position during production of the production fluid, to provide the production-only valves; and a second set of valves is controlled to be in the first position during production of the production fluid and the second position during injection of the injection fluid, to provide the injection-only valves.

In some implementations, the production-only valves and the injection-only valves have an identical construction.

In some implementations, there is provided a process for producing hydrocarbons from a fractured reservoir via a well, comprising: conducting an asynchronous frac-to-frac operation comprising asynchronously injecting an injection fluid into the reservoir and producing production fluid from the reservoir respectively via injection-only valves and production-only valves provided along the well to enable frac-to-frac hydrocarbon recovery from a first set of fractured zones in the reservoir; and concurrently with the asynchronous frac-to-frac operation, conducting a cyclical huff-and-puff operation comprising cyclically injecting injection fluid and producing production fluid from a cyclically-operated valve provided in the well in fluid communication with an isolated fractured zone that is hydraulically isolated from all other fractured zones of the reservoir.

In some implementations, there is provided a hybrid process for producing hydrocarbons from a fractured reservoir via one or more wells, comprising: asynchronously injecting an injection fluid into the reservoir and producing production fluid from the reservoir respectively via injection-only valves and production-only valves provided in the one or more wells to enable hydrocarbon recovery from a first set of fractured zones in the reservoir; and concurrently cyclically injecting injection fluid and producing production fluid from a cyclically-operated valve provided in the one or more wells in fluid communication with an isolated fractured zone that is hydraulically isolated from all other fractured zones of the reservoir.

In some implementations, there is provided a process for producing hydrocarbons from a fractured reservoir via a well that has been operated for primary production of hydrocarbons, comprising:

providing valves along the well, wherein each valve comprises:
- a housing;
- a fluid conducting passage defined within the housing;
- a flow communicator configured for effecting flow communication between the fluid conducting passage and the subterranean formation, wherein the flow communicator includes:
  - an orifice defined within a valve seat;
  - one or more ports defined within the outermost surface of the housing; and
  - a space extending between the orifice and the one or more ports;
- a flow control member displaceable relative to the valve seat between seated and unseated positions for controlling flow communication via the orifice; and
- a cutting tool coupled to the flow control member for translation with the flow control member;
- wherein the flow control member and the cutting tool are co-operatively configured such that, while: (i) the flow control member is being displaced relative to the valve seat between the seated and the unseated positions, and (ii) solid debris is disposed within the space, the cutting tool effects size reduction of the solid debris, such that size-reduced solid debris is obtained; and
- wherein the valves are each controllable between:
  - a first position where the flow control member is seated with respect to the valve seat for preventing flow through the orifice; and
  - a second position where the flow control member is unseated with respect to the valve seat for allowing flow through the orifice;

conducting an asynchronous frac-to-frac operation comprising asynchronously injecting an injection fluid into the reservoir and producing production fluid from the reservoir respectively via injection-only valves and production-only valves provided along the well to enable frac-to-frac hydrocarbon recovery from the fractured zones in the reservoir, wherein:
- the injection-only valves are defined as respective valves that are in the first position during production of the production fluid and in the second position during injection of the injection fluid; and
- the production-only valves are defined as respective valves that are in the first position during injection of the injection fluid and in the second position during production of the production fluid.

In some implementations, there is provided a process for producing hydrocarbons from a fractured reservoir via a well that has been operated for primary production of hydrocarbons, comprising:

providing valves along the well, wherein each valve comprises:

a housing;

a fluid conducting passage defined within the housing;

a flow communicator configured for effecting flow communication between the fluid conducting passage and the subterranean formation, wherein the flow communicator includes:

an orifice defined within a valve seat;

one or more ports defined within the outermost surface of the housing; and a space extending between the orifice and the one or more ports;

a reciprocating assembly including a flow control member that is displaceable relative to the valve seat between seated and unseated positions for controlling flow communication via the orifice;

wherein the flow control member and a distal end of the reciprocating assembly are co-operatively configured such that while the flow control member is seated relative to the valve seat, the distal end, of the reciprocating assembly, extends through the orifice and into the space, while being spaced apart from the housing, and is spaced apart from the housing by a maximum distance of less than 3/1000 of an inch; and wherein the valves are each controllable between:

a first position where the flow control member is seated with respect to the valve seat for preventing flow through the orifice; and a second position where the flow control member is unseated with respect to the valve seat for allowing flow through the orifice;

conducting an asynchronous frac-to-frac operation comprising asynchronously injecting an injection fluid into the reservoir and producing production fluid from the reservoir respectively via injection-only valves and production-only valves provided along the well to enable frac-to-frac hydrocarbon recovery from the fractured zones in the reservoir, wherein:

the injection-only valves are defined as respective valves that are in the first position during production of the production fluid and in the second position during injection of the injection fluid; and the production-only valves are defined as respective valves that are in the first position during injection of the injection fluid and in the second position during production of the production fluid.

In some implementations, there is provided a process for producing hydrocarbons from a fractured reservoir via a well that has been operated for primary production of hydrocarbons, comprising:

providing valves along the well, wherein each valve comprises:

a housing;

a fluid conducting passage defined within the housing;

a flow communicator configured for effecting flow communication between the fluid conducting passage and the subterranean formation, wherein the flow communicator includes:

an orifice defined within a valve seat;

one or more ports defined within the outermost surface of the housing; and a space extending between the orifice and the one or more ports;

a flow control member displaceable relative to the valve seat between seated and unseated positions for controlling flow communication via the orifice; and a tracer material source disposed within the space;

wherein the orifice defines a central axis; the port defines a central axis; and the orifice and the port are co-operatively configured such that, while the flow control apparatus is oriented such that the central axis of the orifice is disposed within a horizontal plane, the central axis of the port is disposed at an acute angle of greater than 45 degrees relative to the horizontal plane; and wherein the valves are each controllable between:

a first position where the flow control member is seated with respect to the valve seat for preventing flow through the orifice; and a second position where the flow control member is unseated with respect to the valve seat for allowing flow through the orifice;

conducting an asynchronous frac-to-frac operation comprising asynchronously injecting an injection fluid into the reservoir and producing production fluid from the reservoir respectively via injection-only valves and production-only valves provided along the well to enable frac-to-frac hydrocarbon recovery from the fractured zones in the reservoir, wherein:

the injection-only valves are defined as respective valves that are in the first position during production of the production fluid and in the second position during injection of the injection fluid; and the production-only valves are defined as respective valves that are in the first position during injection of the injection fluid and in the second position during production of the production fluid.

In some implementations, there is provided a process for producing hydrocarbons from a fractured reservoir via a well that has been operated for primary production of hydrocarbons, comprising:

providing valves along the well, wherein each valve comprises:

a housing;

a fluid conducting passage defined within the housing;

a flow communicator configured for effecting flow communication between the fluid conducting passage and the subterranean formation;

a flow control member displaceable, relative to the flow communicator, between closed and open positions, for controlling flow communication between the fluid conducting passage and the flow communicator;

a hydraulic actuator for effecting the displacement of the flow control member; wherein the hydraulic actuator includes:

working fluid;

a pump;

a first working fluid containing space;

a second working fluid containing space; and a piston, wherein each one of the first and second working fluid containing spaces, independently, is disposed in fluid pressure communication with the piston; and wherein the working fluid, the pump, the piston, the first space, and the second space are co-operatively configured such that while the flow control member is disposed in one of the opened and closed positions, and the pump becomes disposed in the first mode of operation, the pump is receiving supply of working fluid from the first working fluid containing space and discharging pressurized working fluid into the second working fluid containing space, with effect that working fluid, within the second working fluid containing space, and in fluid pressure communication with the piston, becomes disposed at a higher pressure than working fluid within the first working fluid containing space and in fluid pressure communication with the piston, such that an unbalanced force is acting on the piston and effects movement of the piston, such that the flow control member is displaced to the other one of the opened position and the closed position; and while the flow control member is disposed in the other one of the opened position and the closed position, and the pump becomes disposed in the second mode of operation, the pump is receiving supply of working fluid from the second working fluid containing space and discharging pressurized working fluid into the first working fluid containing space, with effect that working fluid, within the first working fluid containing space and in fluid pressure communication with the piston, becomes disposed at a higher pressure than working fluid within the second space and in fluid pressure communication with the piston, such that an unbalanced force is acting on the piston and effects movement of the piston, such that the flow control member becomes disposed in the one of the opened position and the closed position;

a passage extends through the piston and joins two portions of one of the first working fluid containing space and the second working fluid containing space; and the piston and the two portions of the one of the first working fluid containing space and the second working fluid containing space are co-operatively configured such that joinder of the two space portions is maintained while the piston is displaced between positions corresponding to opened and closed positions of the flow control member; and conducting an asynchronous frac-to-frac operation comprising asynchronously injecting an injection fluid into the reservoir and producing production fluid from the reservoir respectively via injection-only valves and production-only valves provided along the well to enable frac-to-frac hydrocarbon recovery from the fractured zones in the reservoir, wherein:

the injection-only valves are defined as respective valves having the flow control member in the closed position during production of the production fluid and in the open position during injection of the injection fluid; and the production-only valves are defined as respective valves having the flow control member that is in the closed position during injection of the injection fluid and in the open position during production of the production fluid.

In some implementations, there is provided a process for producing hydrocarbons from a fractured reservoir via a well that has been operated for primary production of hydrocarbons, comprising:

providing valves along the well, wherein each valve comprises:

a housing;

a fluid conducting passage defined within the housing;

a flow communicator configured for effecting flow communication between the fluid conducting passage and the subterranean formation;

a flow control member displaceable, relative to the flow communicator, for controlling flow communication between the fluid conducting passage and the flow communicator;

a hydraulic actuator for effecting the displacement of the flow control member; wherein the hydraulic actuator includes:

a working fluid pressurizing assembly including:

a working fluid source containing working fluid;

a working fluid-containing space; and a pump fluidly coupled to the working fluid source for pressurizing the working fluid and discharging the working fluid to the working fluid-containing space; and a piston;

wherein the working fluid-containing space is disposed in fluid pressure communication with the piston; and wherein the working fluid source, the pump, the working fluid-containing space, the piston, and the flow control member are co-operatively configured such that, while the pump is pressurizing and discharging the working fluid into the working fluid-containing space, movement of the piston is actuated, with effect that the flow control member is displaced relative to the flow communicator;

a working fluid supply compensator includes working fluid disposed in fluid pressure communication with the fluid-conducting passage; and a valve device for controlling flow communication between the working fluid-pressurizing assembly and the working fluid supply compensator, and configured for opening when the pressure of the working fluid within the working fluid-containing space becomes disposed below the pressure of the working fluid within the working fluid compensator;

conducting an asynchronous frac-to-frac operation comprising asynchronously injecting an injection fluid into the reservoir and producing production fluid from the reservoir respectively via injection-only valves and production-only valves provided along the well to enable frac-to-frac hydrocarbon recovery from the fractured zones in the reservoir, wherein:

the injection-only valves are defined as respective valves having the flow control member in a closed position during production of the production fluid and in an open position during injection of the injection fluid; and the production-only valves are defined as respective valves having the flow control member that is in a closed position during injection of the injection fluid and in an open position during production of the production fluid.

In some implementations, there is provided a process for producing hydrocarbons from a fractured reservoir via a well that has been operated for primary production of hydrocarbons, comprising: providing a tubing string within the well and valves along the tubing string, each valve being actuatable between a fully open position and a fully closed position and being in fluid communication with a respective fractured zone of the reservoir; characterizing an injectivity of one or more of the fractured zones of the formation in accordance with sensed characteristics of an injection fluid that is injected through corresponding valves in the fully open position; based on the characterized injectivity of the one or more fractured zones, determining a first set of the valves for operation as injection-only valves, a second set of the valves for operation as production-only valves; and conducting an asynchronous frac-to-frac operation comprising asynchronously injecting an injection fluid into the reservoir and producing production fluid from the reservoir respectively via the first set of injection-only valves and the second set of production-only valves provided along the well to enable frac-to-frac hydrocarbon recovery from the fractured zones in the reservoir.

In some implementations, the first set of valves and the second set of valves are determined to exclude any pair of valves for which the characterized injectivity indicated a hydraulic short-circuit. In some implementations, the first set of valves and the second set of valves are determined such that any pair of valves for which the characterized injectivity indicated a hydraulic short-circuit are both operated as injection-only valves or production-only valves. In some implementations, the first set of valves and the second set of valves are determined to exclude any valve for which the characterized injectivity indicated a hydraulic breakthrough. In some implementations, after conducting the asynchronous frac-to-frac operation for a first time interval, the first and second sets of valves are reversed such that the first set is operated as production-only valves and the second set is operated as production-only valves.

In some implementations, there is provided a process for producing hydrocarbons from a fractured reservoir via a well that has been operated for primary production of hydrocarbons, comprising: providing a tubing string within the well and valves along the tubing string, each valve being actuatable between a fully open position and a fully closed position and being in fluid communication with a respective fractured zone of the reservoir; defining a first set of the valves for operation as injection-only valves and a second set of the valves for operation as production-only valves; conducting an asynchronous frac-to-frac operation comprising asynchronously injecting an injection fluid into the reservoir and producing production fluid from the reservoir respectively via the first set of injection-only valves and the second set of production-only valves provided along the well to enable frac-to-frac hydrocarbon recovery from the fractured zones in the reservoir; and characterizing at least one property of one or more of the fractured zones of the formation in accordance with sensed characteristics. The process includes, based on the characterized property of the one or more fractured zones, determining at least one operating parameter of the asynchronous frac-to-frac operation. The operating parameter can include an operating schedule between injection and production modes; an operating flow rate or pressure of the injection fluid; an operating flow rate or pressure of the production fluid; and/or an operating mode of one or more of the valves as an injection-only valve, a production-only valve, a shut-in valve, or a cyclically operated injection-and-production valve.

In some implementations, the first set of valves is initially defined as odd-number valves along the well, and the second set of valves is initially defined as even-number valves along the well. In some implementations, the first set of valves is initially defined as even-number valves along the well, and the second set of valves is initially defined as odd-number valves along the well. In some implementations, the characterized property comprises fluid injectivity via one or more of the valves. In some implementations, the characterized property comprises pressure drop-off at one or more of the valves. In some implementations, the characterized property comprises a fluid temperature, pressure or flow property.

In some implementations, there is provided a process for producing hydrocarbons from a fractured reservoir via a well that has been operated for primary production of hydrocarbons, comprising: conducting an asynchronous frac-to-frac operation comprising asynchronously injecting an injection fluid into the reservoir and producing production fluid from the reservoir respectively via injection-only valves and production-only valves provided along the well to enable frac-to-frac hydrocarbon recovery from a first set of fractured zones in the reservoir; wherein the production-only valves are in fluid communication with a production conduit system that receives production fluid during production cycles, and the injection-only valves are in fluid communication with an injection conduit system providing the injection fluid during injection cycles, the injection conduit system being fluidly isolated from the production conduit system in the well; for at least one transition phase between injection and production cycles, simultaneously injecting and producing via the well. In some implementations, the at least one transition phase comprises a corresponding transition phase for each transition between injection and production cycles. In some implementations, the transition phase comprises a first transition phase wherein production is decreased and injection is initiated, and a second transition phase wherein injection is decreased and production is initiated. In some implementations, the first transition phase is controlled such that the injection is initiated by flowing the injection fluid down the injection conduit system while production is ongoing, but the injection fluid does not flow through the injection-only valves until production is ceased. The overlap between the production and injection cycles can have various features, some of which are further described herein.

In some implementations, there is provided a process for producing hydrocarbons from a fractured reservoir via a well that has been operated for primary production of hydrocarbons, comprising: conducting an asynchronous frac-to-frac operation comprising asynchronously injecting an injection fluid into the reservoir and producing production fluid from the reservoir respectively via injection-only valves and production-only valves provided along the well to enable frac-to-frac hydrocarbon recovery from a first set of fractured zones in the reservoir; wherein the production-only valves and the injection-only valves are coupled to a closed loop hydraulic circuit; during each production cycle, operating the closed loop hydraulic circuit to open the production-only valves and close the injection-only valves; and during each injection cycle, operating the closed loop hydraulic circuit by reversing flow of hydraulic fluid therein to close the production-only valves and open the injection-only valves.

In some implementations, there is provided a process for producing hydrocarbons from a fractured reservoir via a well that has been operated for primary production of hydrocarbons, comprising:

conducting an asynchronous frac-to-frac operation comprising asynchronously injecting an injection fluid into the reservoir and producing production fluid from the reservoir respectively via injection-only valves and production-only valves provided along the well to enable frac-to-frac hydrocarbon recovery from a first set of fractured zones in the reservoir;

wherein the production-only valves and/or the injection-only valves each comprise:

a housing having a central passage and a housing wall within a port therethrough for fluid communication between the central passage and an exterior of the housing;

a radial poppet check valve mounted within the port of the housing, the radial poppet check valve comprising:

a poppet member having a body and a fluid channel through the body;

a biasing unit cooperating with the poppet member to urge the poppet to a closed position and allow the poppet member to be displaced radially within the port toward an open position;

wherein the fluid channel of the poppet member is positioned and configured such that:

in response to fluid pressure from a first side of the poppet member, the fluid enters the fluid channel and forces the poppet member toward sealing surfaces to form a fluid seal to prevent flow of the fluid from the first side through the port; and in response to fluid pressure from a second side of the poppet member, the fluid overcomes the biasing unit and forces the poppet member away from the sealing surface to allow fluid to flow from the second side, through the fluid channel, and out to the first side.

In some implementations, the radial poppet check valve further comprises a plug member mounted in the port and having a cavity in which the poppet member is located. In some implementations, the poppet member comprises a ball. In some implementations, the poppet member comprises a dart comprises a shank and a head. In some implementations, the fluid channel has a main portion extending through the shank and secondary portions extending from the main portion through the head and having openings therein. In some implementations, the openings of the secondary portions of the fluid channel are positioned to be spaced outward way from the sealing surface when the poppet member engages the same in the closed position.

It is noted that, in some implementations, there is provided a process for producing hydrocarbons from a fractured reservoir via a well that has been operated for primary production of hydrocarbons, comprising conducting an asynchronous frac-to-frac operation wherein the production valves and/or the injection valves have a check valve device in the housing and/or sleeve, and wherein the check valve device has one or more features as described herein. For example, the check valve device can include a radial poppet valve, an axial poppet valve, a side- or end-bending reed valve, a ring valve, a circumferential dart valve, a valve with a spring loaded sleeve, a check valve that has a member that moves radially outward to an open position, or a valve having another check valve device incorporated therein.

BRIEF DESCRIPTION OF THE DRAWINGS

FIG. 57A is a top view of part of a sleeve with an end reed check valve.

FIG. 57B is a transverse view of part of a sleeve with end reed check valves.

FIG. 58 is a cut view schematic of a reed check valve device.

DETAILED DESCRIPTION

Figure 1A:
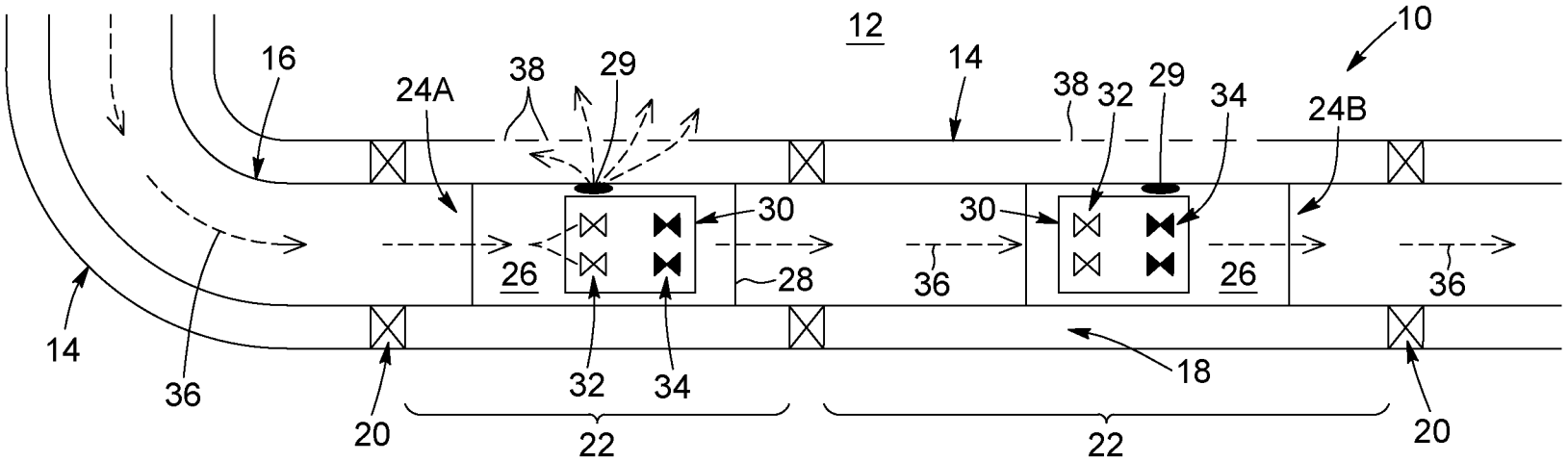
FIG. 1A is a side cut view schematic of a well system during an injection cycle.

The present description relates to asynchronous frac-to-frac operations for recovering hydrocarbons from reservoirs that have been fractured. The asynchronous frac-to-frac processes can include various operational features and can be implemented using systems that include valves and other equipment designed to facilitate enhanced operations. In general, when referring to "fractured" reservoirs in the present description it refers to man-made fractures or "hydraulic fractures" as opposed to merely "naturally fractured" reservoirs.

In a fractured reservoir in which man-made hydraulic fractures have been created, a well can be equipped with a plurality of valves along its length, including injection-only valves and production-only valves. These valves can be the same in terms of their construction and are operated in injection-only and production-only modes, respectively; or different types of valves can be provided to enable the injection and production. The well may have been previously fractured using plug-and-perf, pinpoint, or other fracturing techniques and may have then been operated for primary production of hydrocarbons for a given period of time. There are multiple fractured zones in the reservoir along the well.

In some implementations, after primary recovery, equipment can be deployed to enable the asynchronous frac-to-frac operation. Once the equipment is deployed, the asynchronous frac-to-frac operation can begin. During an injection mode when fluid is injected into the well, the fluid is injected into some of the fractured zones via the injection-only valves while fluid injection is inhibited at the product-only valves. No production via the well occurs during the injection mode. Fluid injection is then ceased, and the well is switched to production mode. During production mode, mobilized or displaced hydrocarbons flow into the well via the production-only valves while production is inhibited via the injection-only valves. No injection into the well occurs during the production mode. It is also noted that primary recovery may in some implementations be accomplished with the same equipment used to enable the asynchronous frac-to-frac operation, as will be described in further detail below.

The asynchronous frac-to-frac operation can include a number of features for enhanced operation, such as a hybrid method where at least one cyclic valve is operated in injection and production modes to access hydrocarbons in an isolated fractured zone; implementing valves that have sliding sleeves that include check-valve devices to allow only production or only injection; using valves that can be remotely controlled between fully open and fully closed positions and controlling the valves based on data regarding properties of the fractured zones, fluid characteristics and/or flow behavior; and managing the asynchronous frac-to-frac of multiple proximal wells to avoid fluid breakthrough and optimize the overall multi-well process.

More details regarding various implementations of the asynchronous frac-to-frac processes will be described further below.

Asynchronous Frac-to-Frac Processes and Systems

Figure 1B:
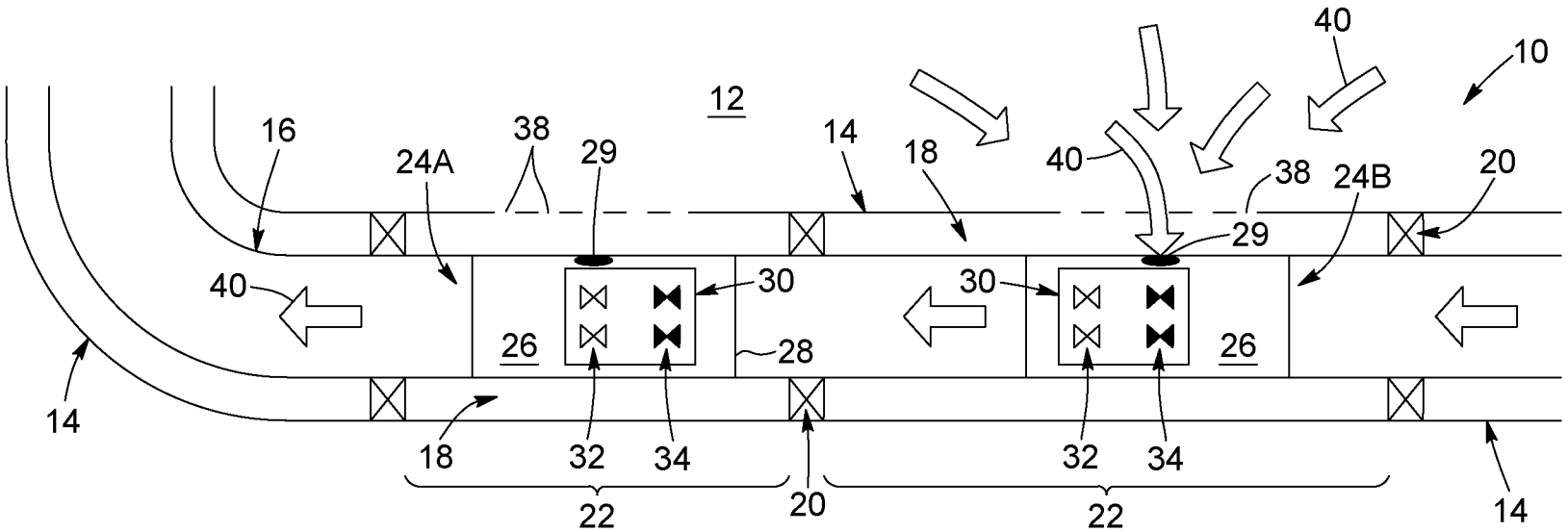
FIG. 1B is a side cut view schematic of a well system during a production cycle.

Referring to FIGS. 1A and 1B, an example asynchronous frac-to-frac process and system will be described. A well 10 is located in a fractured reservoir 12 and can have a casing 14 as well as an inner conduit 16 extending within the casing 14. An annulus 18 can therefore be defined in between the casing 14 and the inner conduit 16. Isolation devices 20, such as packers, can be deployed within the annulus 18 in order to define isolated segments 22 along the well 10. Within each or some of the isolated segments 22, a valve 24 with a central passage 26 can be provided in fluid communication with the inner conduit 16. Note that the valves in general are referred to with the reference character 24, while functionally the injection valves and production valves are referred to with reference characters 24A and 24B, respectively. The valve 24 can include a housing 28 that has at least one port 29 provided through its sidewall, and a sliding sleeve 30 mounted within the housing 28. The sliding sleeve 30 can include one or more ports 32, 34 that are configured for injection (outflow) or production (inflow). The sliding sleeve 30 of each valve 24 along the well is shifted to either an injection position or a production position aligned with the housing port 29 so that a first set of valves operate as injection-only valves while a second set of valves operate as production-only valves.

In practice, the well 10 is initially drilled and completed (e.g., optionally with a cemented casing), subjected to multistage fracturing (e.g., plug-and-pert or other methods), and then put on primary production. Once primary production has run its course in terms of economic performance, the well can be shut in and then provided with additional completion equipment for the asynchronous frac-to-frac process. Thus, the inner conduit 16, valves 24, and packers 20 can be installed to convert the well from primary recovery to either secondary or tertiary recovery depending on the injected fluid that is used.

As shown in FIG. 1A, in an example asynchronous frac-to-frac process, during injection mode a fluid 36 is injected from the surface down the inner conduit 16. At injection valves 24A, the fluid passes through the inner conduit 16, into the central passage 26 of the injection valve 24A, through the injection ports 32 provided in the sliding sleeve 30, and then through the housing port 29 which is aligned with the injection port 32 for the injection valve 24A. The fluid 36 then passes into the annulus 18, through perforations 38 provided in the casing 14, and into the fractures of the surrounding reservoir at the reservoir zone that communicates with that isolated segment 22. The fluid 36 that passes to the next isolated segment 22 cannot enter the reservoir because the sliding sleeve 30 of the production valve 24B has been shifted to align the production ports 34 with the housing port 29. The fluid 36 therefore passes down in the well 10 to the next injection valve (not shown here). Thus, during injection mode, the fluid is injected only at the injection valves 24A.

Figure 11:
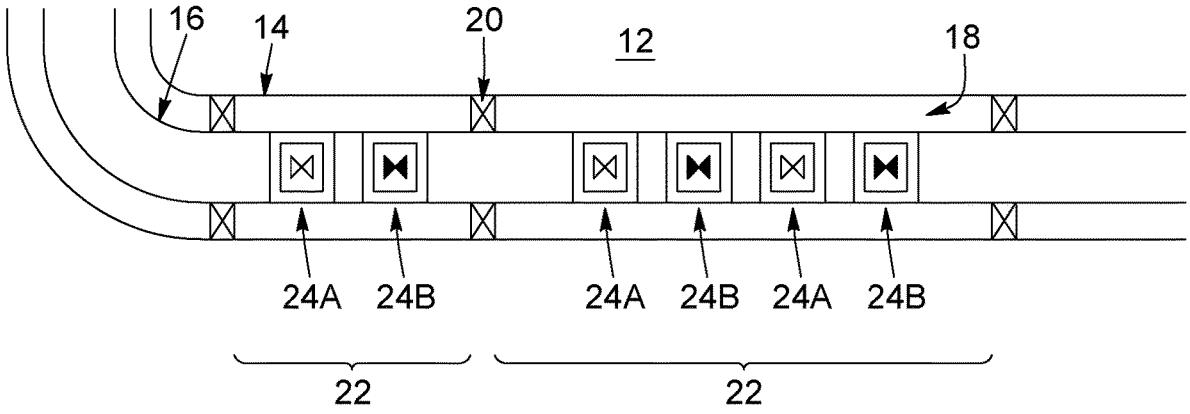
FIG. 11 is a side cut view schematic of part of a well system in which multiple valves are provided in each isolated segment.

Each isolated segment 22 can be the same length along the well or the can be different lengths. A given isolated segment 22 can cover a fracture stage or multiple fracture stages, and can include one valve or multiple valves along its length. To design the isolate segments 22 and the arrangement and spacing of the valves 24 in each isolated segment, the fractured reservoir can be characterized (e.g., permeability, fracture complexity). FIG. 11 shows an example where the isolated segments are of different lengths and contain different numbers and arrangements of valves 24.

Referring now to FIG. 1B, after the injection mode is complete, the well 10 can be switched to production mode. Fluid injection is therefore ceased, and production is initiated. During production, mobilized hydrocarbon production fluid 40 in the reservoir 12 flows through perforations 38 in the casing 14 and into the annulus 18 where a production valve 24B is located. The hydrocarbons then flow through the housing port 29 and the production ports 34 that are aligned with the housing port 29, as illustrated. The hydrocarbon production fluid then flows into the central channel 26 of the production valve 24B and then up the well via the inner conduit 16 for recovery at surface.

In this manner, the well 10 is operated between injection and production modes where mobilizing or displacement fluid is injected through the first set of valves and then production fluid is recovered via the second set of valves. Various implementations, equipment and operating schemes leveraging this asynchronous frac-to-frac operation will be described in greater detail below.

System and Equipment Implementations

In some implementations, the injection and production ports 32, 34 that are provided in the sleeves 30 include check-valve devices configured for one-way flow of fluids. The check-valve devices facilitate operation of the injection and production valves 24A, 24B for asynchronous frac-to-frac operations.

Figure 2:
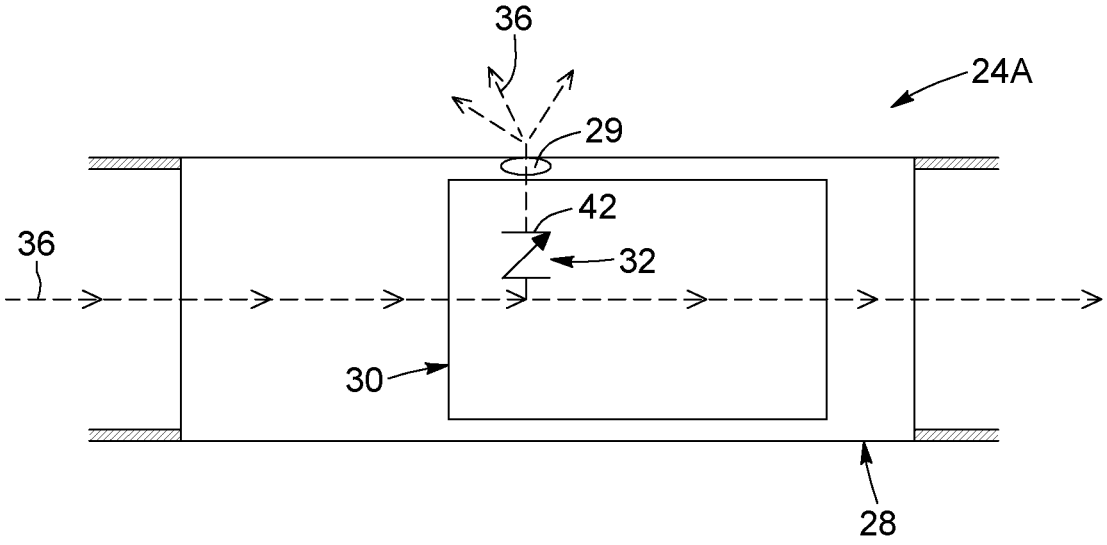
FIG. 2 is a side cut view schematic of part of a well including a valve having a sleeve with check valve device enabling injection only.
Figure 3:
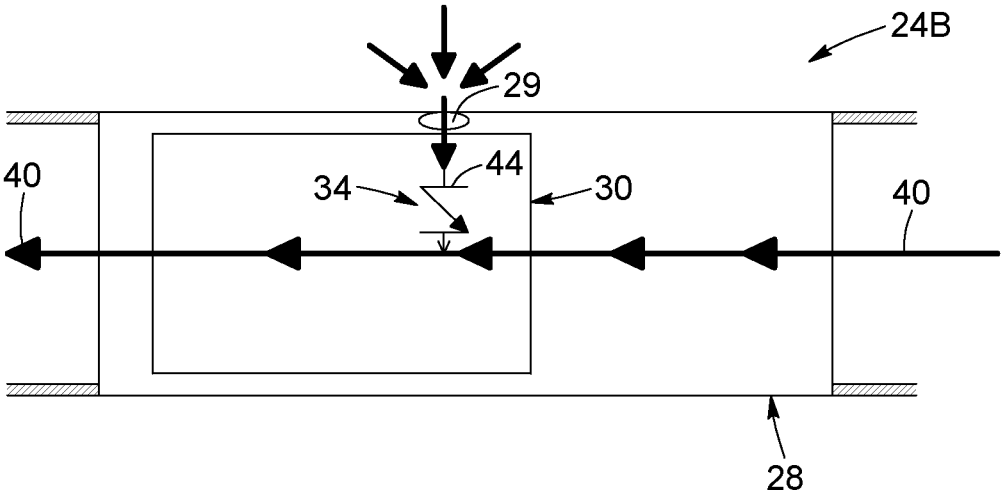
FIG. 3 is a side cut view schematic of part of a well including a valve having a sleeve with check valve device enabling production only.

As shown in FIG. 2, the injection ports 32 include outflow check-valve devices 42; and as shown in FIG. 3, the production ports 34 include inflow check-valve devices 44. One or multiple check-valve devices can be provided around the circumference of each sleeve.

Various types of check-valve devices can be used and integrated into the sliding sleeves 30. For example, the check-valve devices can include a ball check valve, diaphragm check valve, flapper valve, stop-check valve, lift-check valve, spring check valve, reed check valve, and so on. Depending on the construction and design of the valve and its sleeve as well as its function of inhibiting injection or production, different types of check-valve devices can be used. The check-valve devices can also be incorporated in various different orientations and in relation with ports having different shapes, sizes, and orientations.

The type and construction of the outflow and inflow check-valve devices can be the same or different. For example, the outflow check-valve devices can be specifically designed for the given fluid to inject and/or the injection operating conditions, whereas the inflow check-valve devices can be specifically designed for the fluids to be received from the reservoir. In frac-to-frac operations, the injection fluid is typically vapour phase and thus the outflow check-valve devices can be designed to accommodate vapor outflow while inhibiting liquid inflow. The injection fluid can be supercritical $CO_2$, field gas (mainly methane and having relatively low miscibility in the oil in the reservoir), or enriched field gas (methane with added light components that make it more miscible in the oil). The injected fluid is preferably a compressible fluid in vapour phase. The outflow check-valve devices can thus be designed to allow flow of such fluids from the well into the fractured reservoir without detrimentally impacting desired properties of the fluid. For example, when supercritical $CO_2$ is used, the outflow check-valve devices can be sized and configured to avoid a pressure drop that would bring the $CO_2$ below the critical point. In addition, supercritical $CO_2$ has a density that is similar to water while having low viscosity, and thus the outflow check-valve devices designed for water flow or similar liquid flow could be used for such an injection fluid. It is noted that the outflow check-valve devices can also be designed to provide a predetermined pressure drop depending on the injection pressure and various injection parameters for the process. Furthermore, the produced fluid is primarily liquid phase (e.g., oil with some water) and thus the inflow check-valve devices can be provided to accommodate liquid inflow while inhibiting vapor outflow. The produced fluid can also include some free gas being present in increasing amounts if the flowing bottom hole pressure depresses below the bubble point, and the inflow check-valve devices could be designed accordingly to minimize vapor inflow.

In addition, the check-valve devices can be configured based on the operating pressures within the well and within the reservoir during injection and production modes. For example, the outflow check-valve devices can be configured to allow flow only when central passage 26 pressure exceeds annulus 18 pressure (e.g., exceeds by at least certain predetermined pressure or "cracking pressure" e.g., 0.5, 1, 2, 3, 4 or 5 psi). The inflow check-valve devices can be configured to allow flow only when annulus 18 pressure exceeds central passage 26 pressure (e.g., exceeds by at least certain predetermined pressure or "cracking pressure" e.g., 0.5, 1, 2, 3, 4 or 5 psi). The check-valve devices can be designed and configured to require a certain pressure gradient between the central passage 26 and the annulus 18 to cause fluid flow. For example, some check-valve devices can be designed to require only a slight pressure gradient to enable fluid flow, while other check-valve devices can be designed to require higher pressure gradients to enable fluid flow. The inflow and outflow check-valve devices can be designed to require different pressure gradients to enable fluid flow (e.g., the minimum pressure gradient for inflow being higher than the minimum pressure gradient for outflow, or vice versa).

The check-valve devices can have various features and designs. For instance, the check valve device can have various designs and orientations and can be integrated into the other components of the injection and production valves. Some of the design features and embodiments of check valve devices will be described in more detail below in relation to FIGS. 46-63.

The central passage 26 pressure during injection would normally be greater than reservoir 12 pressure but would not exceed fracturing pressure of the reservoir. The central passage pressure 26 during production would be less than reservoir 12 pressure. For example, for a well with 8000 feet vertical depth having a reservoir pressure gradient of 0.5 psi per foot and a fracture gradient of 0.65 psi per foot, optimal injection pressure may fall in the range from 4,000 to 5,200 psi with a preferred value of 4,680 psi or 10% less than the upper limit of injection pressure, and optimal production pressure (also called the flowing bottom hole pressure) may fall in the range from 100 to 4000 psi, with a preferred value of about 500 psi.

Furthermore, FIGS. 1A and 1B illustrate an implementation where each valve 24 has both injection and production ports 32, 34 provided on the corresponding sleeve 30. In this case, the sleeve 30 of the injection valve 24A is shifted to align the injection ports 32 with the housing port 29 (shifted to the right in the figure), and the sleeve 30 of the production valve 24B is shifted to align the production ports 34 with the housing port 29 (shifted to the left in the figure). In this implementation, each valve 24 can be the same type and construction, and it is simply the shifting of the sleeve that determines whether the valve operates as an injection valve 24A or a production valve 24B. This implementation can facilitate simplicity of installation as well as manufacturing and inventory management since all valves are the same. This implementation can also facilitate process control strategies in the event it is desirable to switch one or more of the valves 24 from one operating position to the other after installation or operation. For example, it may not be known during deployment of the valves downhole which locations would be better operated as injection or production valves, and only after downhole testing (e.g., fluid injectivity tests) does one know that certain valves are better as production or injection valves for the initial phase of the asynchronous frac-to-frac process. Thus, having both possibilities for all valves can be advantageous. In addition, it could be desirable to switch an injection valve to a production valve or vice versa after operation for a certain period of time, and this could be done using remote shifting or manual shifting using a downhole shifting tool. This implementation where the valves are the same or similar and each enable both production and injection modes thus facilitates additional flexibility.

In addition, some or each of these valves 24 could be configured such that the sleeve 30 has other positions, such as a closed position or a fully-open position with no check-valve functionality. The sleeve 30 may be placed into other positions using a stroking tool, actuatable using an electric motor, or metered hydraulic pump, for example. It is also noted that two-position valves may be run in tandem in a zone or isolated segment, one valve being selectable between an inflow and a closed position, and the other valve selectable between an outflow and a closed position. This arrangement would allow any particular zone to be fully closed. Similarly, multiple valves having the same function may be run within a zone to provide redundancy, for example to mitigate for a damaged valve.

In addition, each, some or all of the valves could also be configured to have binary functionality. Such binary valves could have a closed position and an open position, where the open position for injection-only valves enables injection and inhibits production while the open position for production-only valves enables production and inhibits injection (e.g., via appropriate check-valve devices). In addition, multiple binary valves could be placed in a given isolated segment, each with a closed position and a functional position. For instance, in an isolated segment there could be at least one binary valve is an injection-only valve and at least one binary valve is a production-only valve, thus allowing the choice between injection or production for that segment for the asynchronous frac-to-frac operation. The isolated segment could also include at least one additional valve that is operable between a closed position and an open position, to enable other processes such as cyclic injection and production via the same valve. By providing multiple binary valves each with a different possible functionality within a same isolated segment, an operator can select the desired functionality once the properties of the fractured reservoir zones have been tested. An example system that includes multiple binary valves 24A, 24B for each segment 22 is shown in FIG. 11.

It is also noted that various other valve constructions are possible. For example, as shown in FIGS. 2 and 3, each valve 24 can have a sleeve 30 that includes a single type of check-valve device for either outflow (FIG. 2) or inflow (FIG. 3). Each valve 24 is therefore predetermined and dedicated for either outflow or inflow during the asynchronous process. In this implementation, the sleeves 30 could be shifted to other positions, such as fully-open or closed, if desired and depending on construction of the valve, but they would not have the functionality of shifting between check-valve devices having different flow directions. This approach could simplify construction and installation of the valves.

Figure 5:
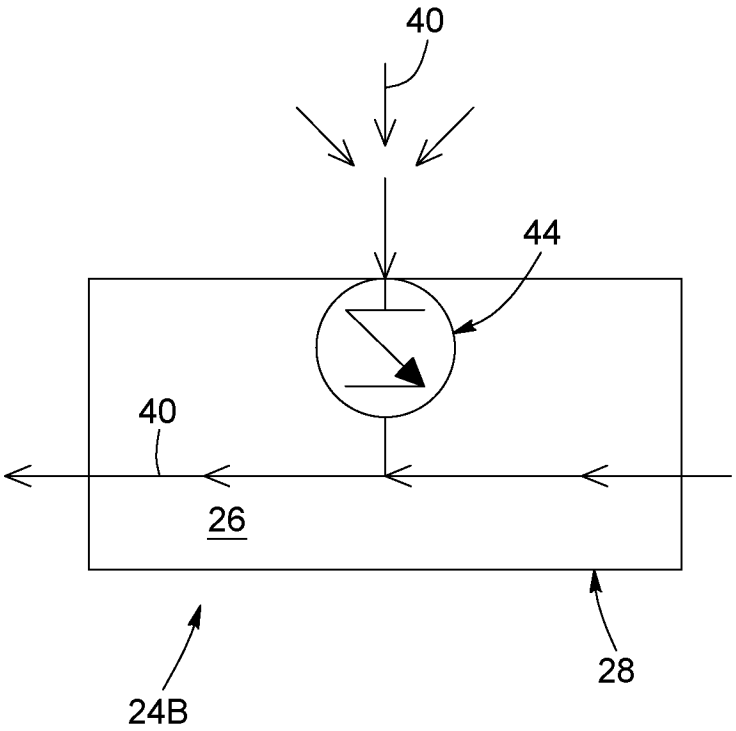
FIG. 5 is a side cut view schematic of a valve housing with check valve device enabling production only.
Figure 4:
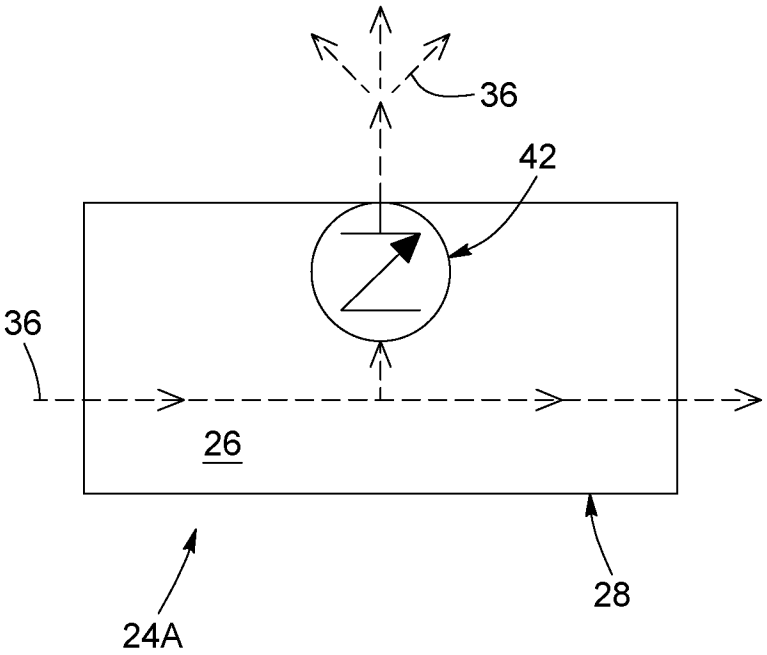
FIG. 4 is a side cut view schematic of a valve housing with check valve device enabling injection only.

Another alternative example is shown in FIGS. 4 and 5 where the valves 24A, 24B do not include sleeves but rather the check-valve devices are integrated into the housing 28 itself. Here, each valve 24 includes a single type of check-valve device 42, 44 for either outflow (FIG. 4) or inflow (FIG. 5). In this implementation, the valves 24 can be relatively simple to manufacture although there is reduced flexibility in terms of actively controlling the functionality of the valves 24. By forgoing the sleeve component, space can be gained to enable construction efficiencies and/or modifications, if desired, with respect to the check-valve devices.

It is also noted that multiple different types of valves could be provided for a single tubing string deployed in the well, such that one or more valves have sleeves (as in FIG. 1A-1B or 2-3) and one or more valves do not have sleeves (as in FIGS. 4-5), if desired. The valves can also be arranged and spaced along the well and within different isolated segments in various ways. For example, some isolated segment could include multiple valves (e.g., two, three, four or more) that can be operated in injection or production mode, while other isolated segments could include only one valve operated in injection or production mode. The isolated segments can be sized and the valves can be selected and installed based on reservoir and fracture characteristics, which could be measured using various techniques.

Examples of a valve with a sleeve are described in Canadian application No. 3,079,570 (Johnson et al.), which is incorporated herein by reference; and FIGS. 26 to 34 illustrate valves that can be used in and adapted for the present technology, for example by incorporating check-valve devices in one or more ports. Such valves can have certain features, such as a flow restrictor, a calibrated tortuous flow path that creates back pressure without relying on small-diameter orifices that may not be preferred; the restrictors being optionally customizable, to encourage zone specific flowrates as needed to distribute injection; integral screen to filter solids, before they enter the flow restrictor; full-drift casing or liner; and/or compatibility with $CO_2$ injection. The elements shown in FIGS. 26 to 34 include the following: valve assembly 400, housing 402, housing flow communicator (or port) 404, passage 406 through the housing, flow controller 408, first, second and third flow modulators 410, 412, 414, flow control member (or sleeve) 416 that has a first side 418 and a second opposite side 420 through which the flow modulators extend, downhole shoulder 422 of the housing, complementary profile 426 of the flow control member 416 that can mate with a shifting tool, and defeatable retainer 428.

Figure 35:
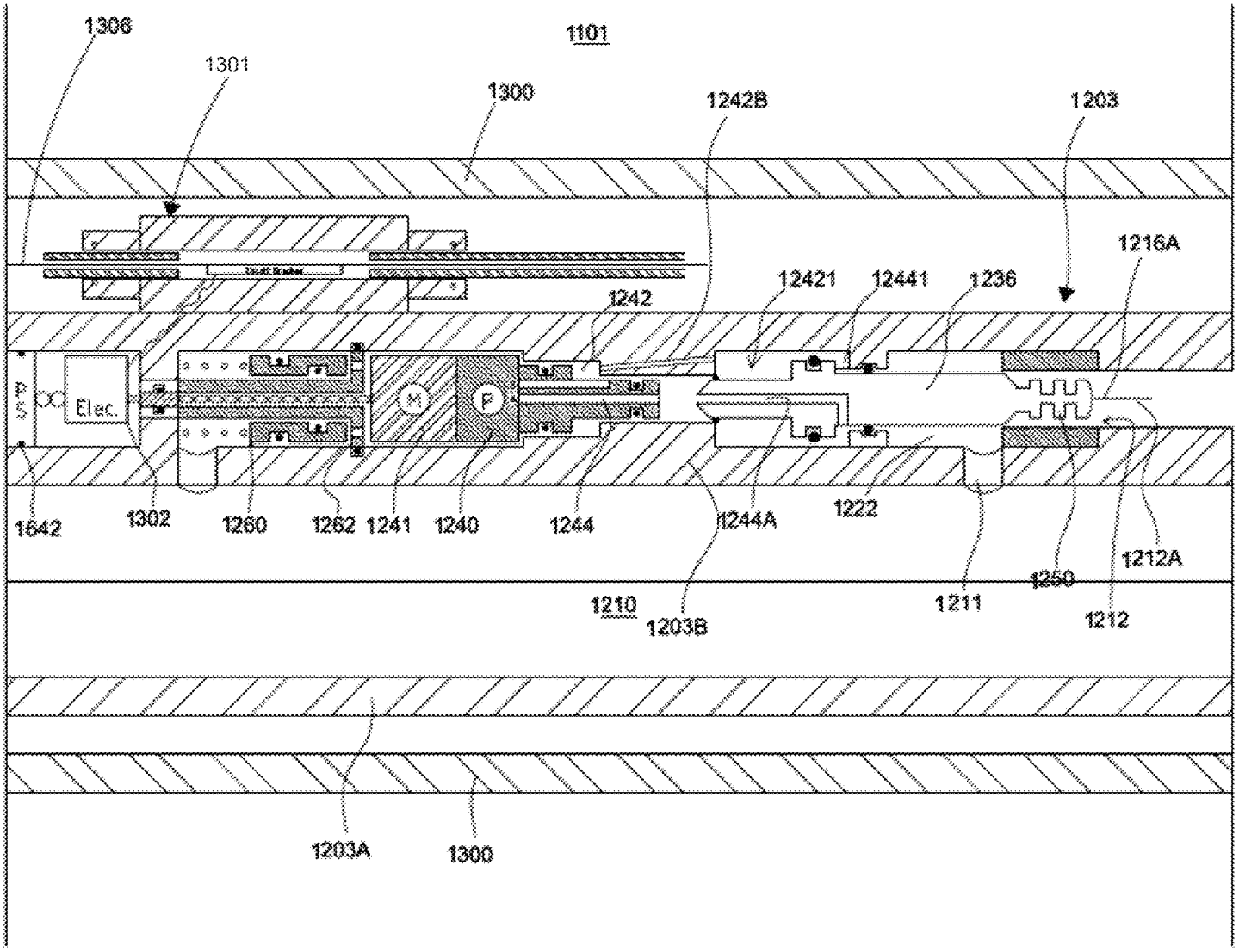
FIGS. 35-36 are cut view schematics of another type of valve that can be used in the context of frac-to-frac processes described herein, wherein the valve includes a piston that can move between a closed position (FIG. 35) and an open position (FIG. 36) and can be controlled remotely.
Figure 36:
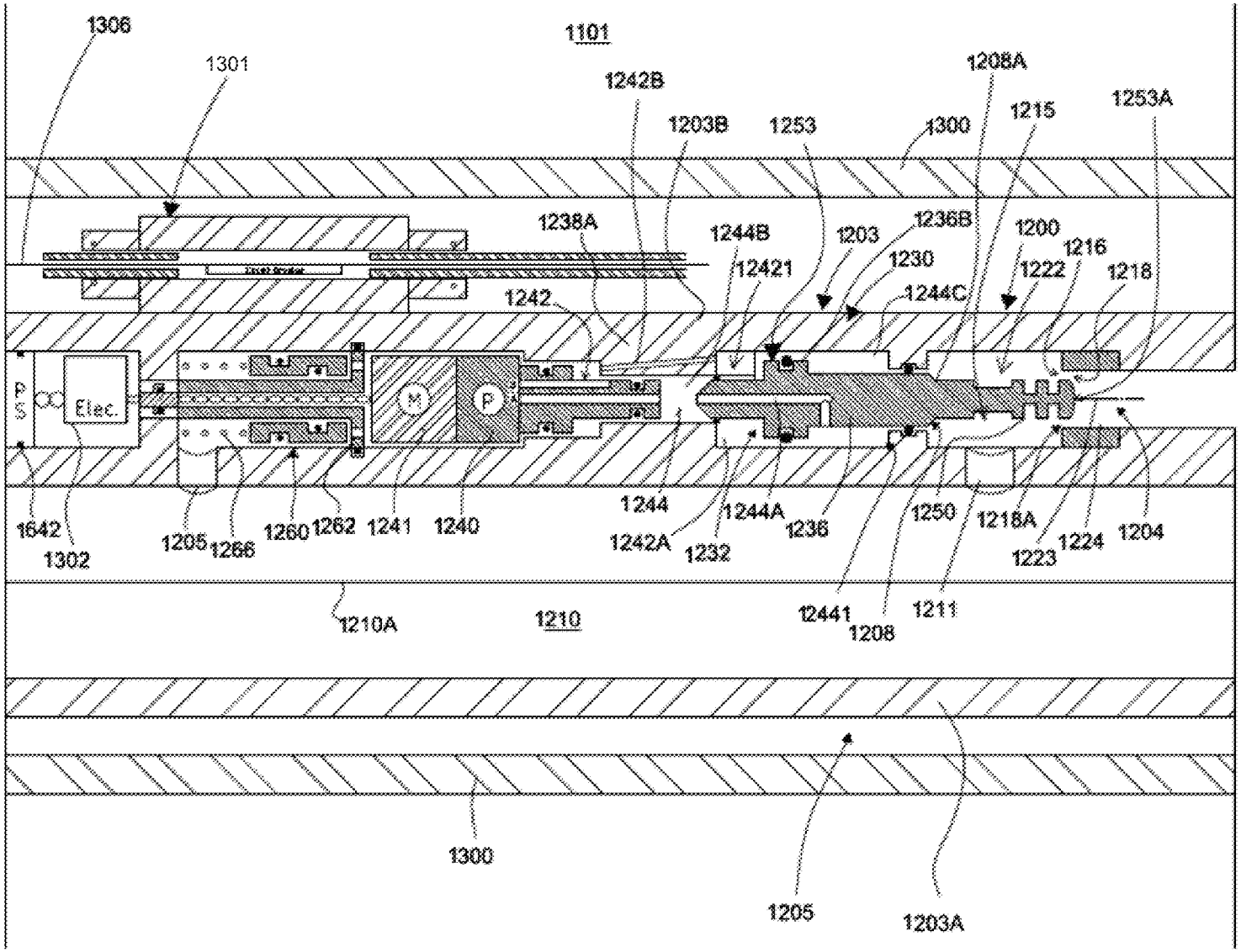
Figure 37:
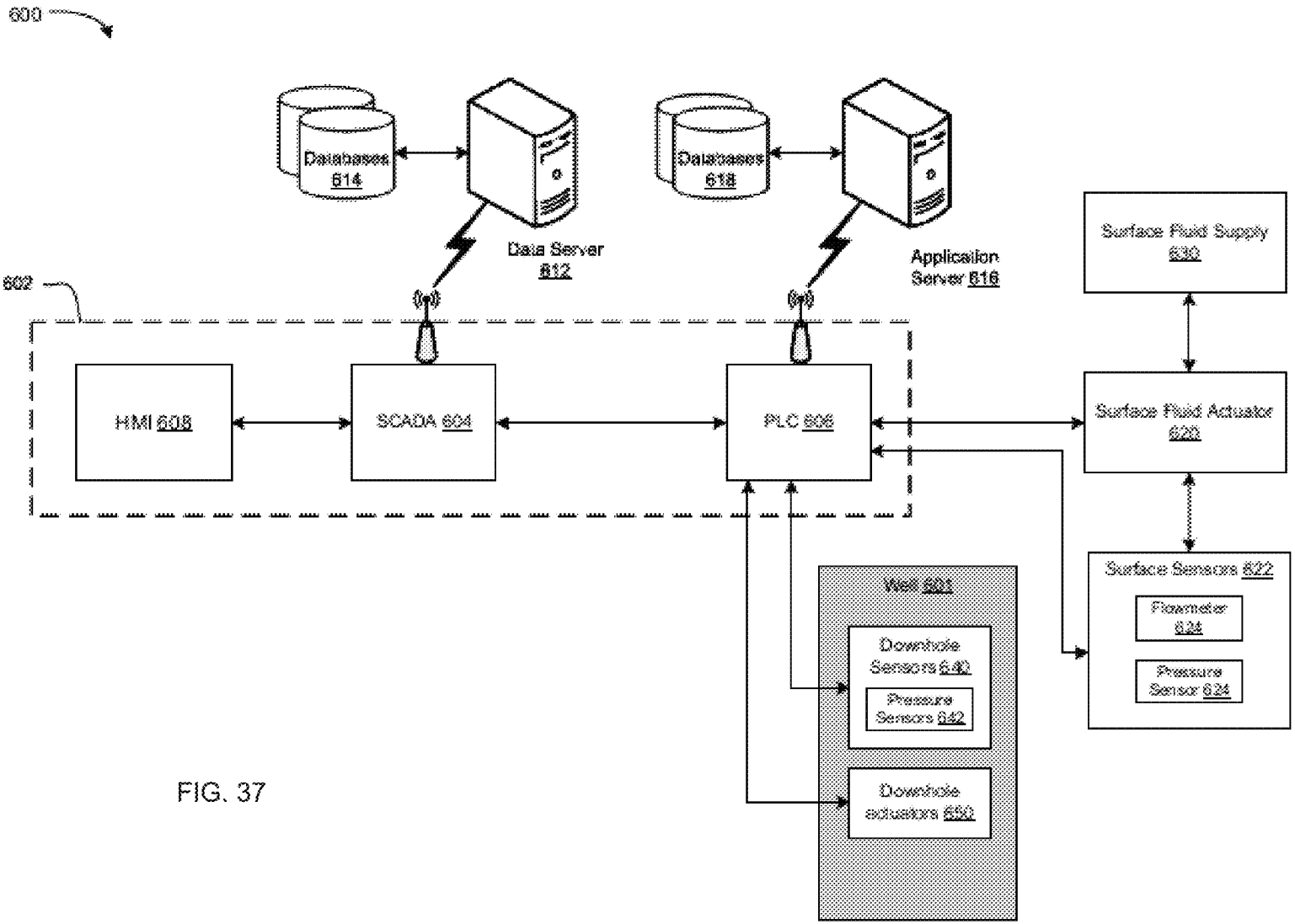
FIGS. 37-42 are process and block diagrams illustrating systems and methods for optimizing operation of one or more tubing strings and remote operation of tubing strings that include downhole valves.
Figure 38:
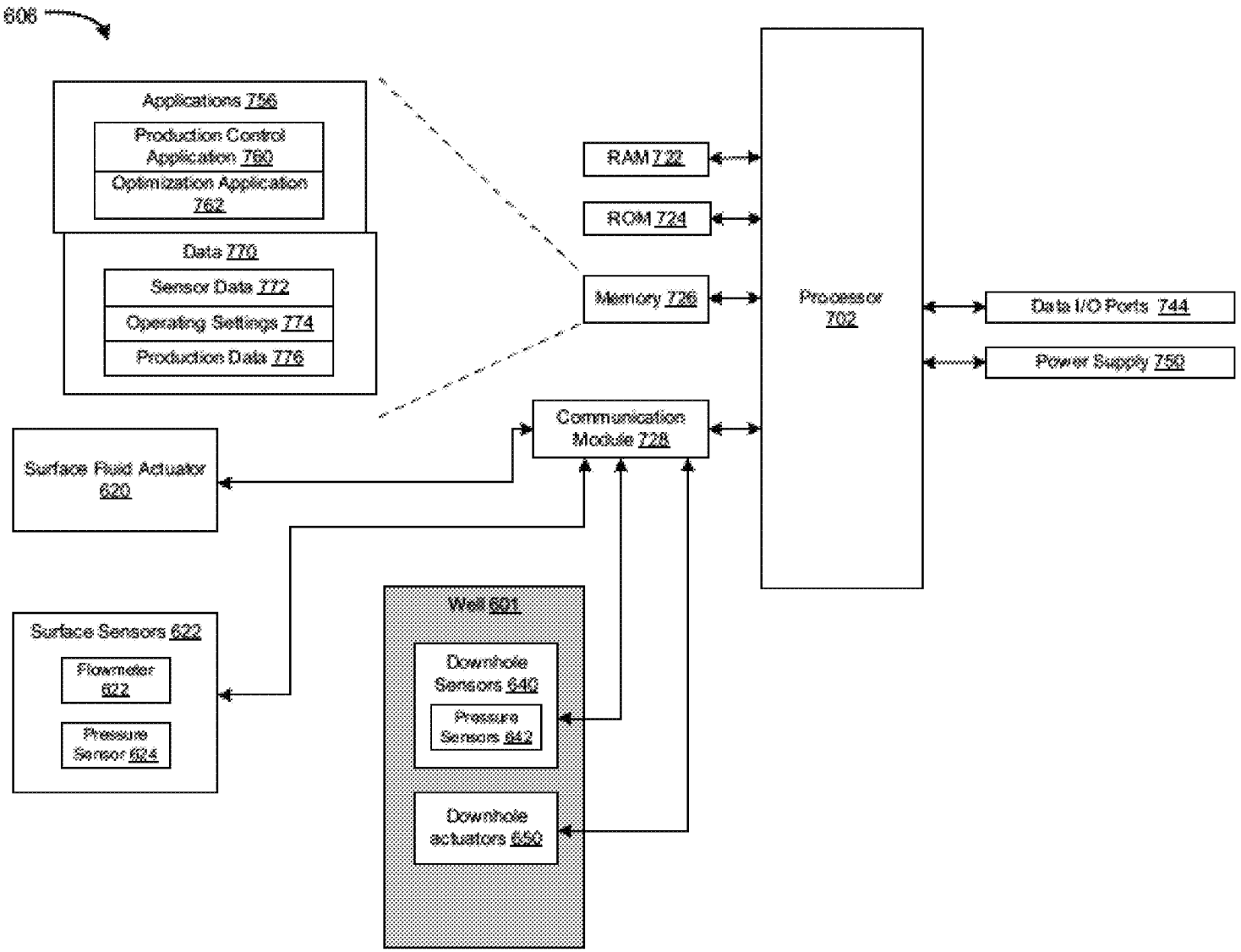

Examples of a valve that operates without a sleeve are described in WO 2019/183713 (Johnson & Kalantari), US 2019/0235007 (Williamson & Tajallipour) or WO 2019/148279 (Kalantari et al.); and FIGS. 35 and 36 illustrate valves that can be used in and adapted for the present technology. The elements shown in FIGS. 35 and 36 include the following: subterranean formation 1101, fluid passage 1210, casing 1300, power supply 1301, housing 1203, port 1205, piston 1236, power and communications cable 1306, pin connector 1302, resilient member such as spring 1266, compensator 1260, moveable piston 1262, bi-directional motor 1241, hydraulic pump 1240, first working fluid-containing space 1242, second working fluid-containing space 1244, an actuator 1232, a chamber 12421, flow control member 1208, cutting tool 1250, port 1211 defined in the inner surface of the housing 1203A, valve seat 1218, space 1223, flow controller 1224, orifice 1216 disposed within space 1222 (e.g., a passage), portions 244A, 244B, 244C of the space 244, reciprocating assembly 253 that includes at least the piston 1236 and the flow control member 1208, and, in some embodiments, further includes the cutting tool 1250, enlarged piston portion 1236B and union 1238A. The motor is powered by the cable and drives the pump to move the piston back and forth from a seated closed position and an unseated open position, thus preventing or enabling flow between the passage and the port. In some implementations, working fluid within the chamber 12441 can urge displacement of the enlarged piston portion 1236B away from or toward the orifice 1216, and thereby urging the flow control member 1108 towards an unseated position or a stead position, respectively.

Figure 6A:
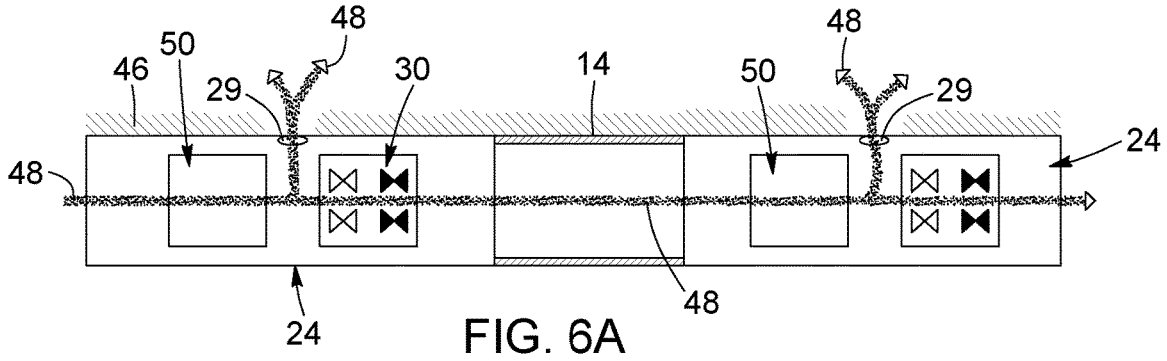
FIGS. 6A to 6D are side cut view schematics of part of a well system and showing stages of fracturing, sleeve shifting, injection and production.
Figure 6B:
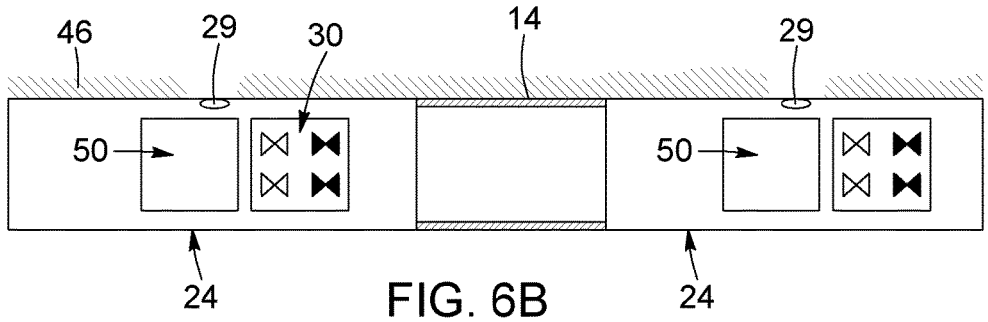
Figure 6C:
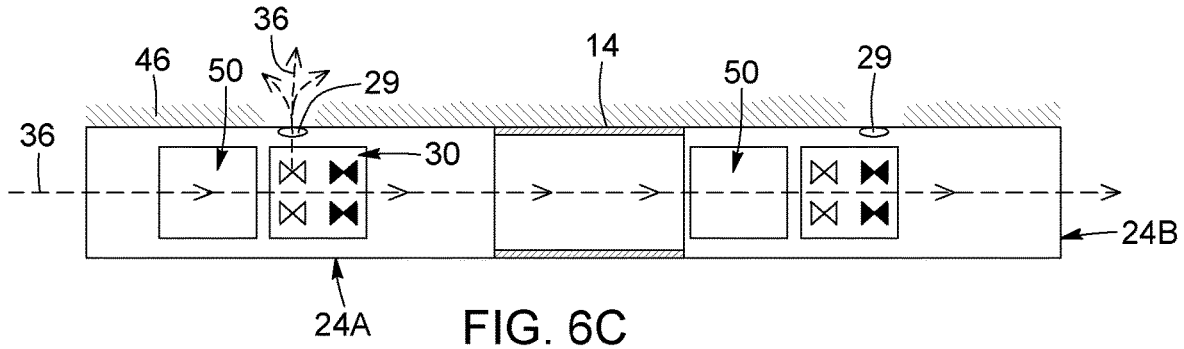
Figure 6D:
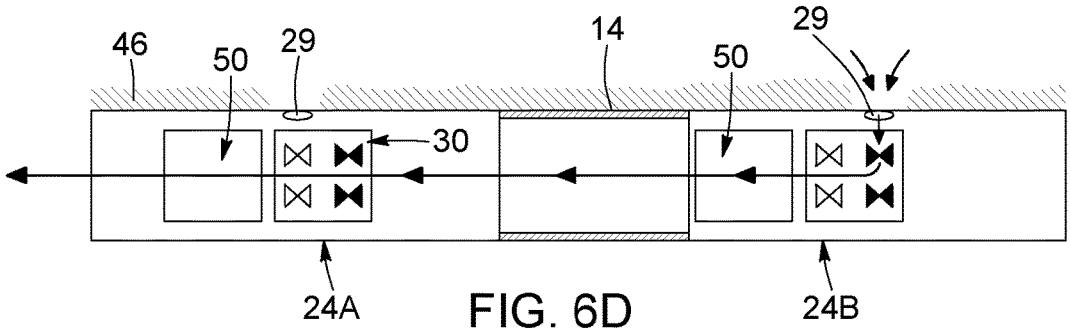

Turning now to FIGS. 6A to 6D, another example of the valves 24 is illustrated in connection with a casing 14 that has been cemented into a wellbore. The cement 46 secures the casing 14 and the valves 24 within the wellbore. In this implementation, the valves 24 are configured and operated to enable injection of fracturing fluid 48 for fracturing of the reservoir (FIG. 6A), and closing off of the reservoir after fracturing to enable the fractures to heal (FIG. 6B). The valves can each have a frac sleeve 50 that can be slid between an open position to provide fluid communication with the housing port 29 (FIG. 6A), and a closed position to isolate the well from the reservoir (FIG. 6B). After the fractures are allowed to "heal" in the closed position, the frac sleeve 50 can be slid to the open position to enable production (e.g., primary production) from the reservoir. In production mode the sleeve 50 would be in the position as shown in FIG. 6A, except with fluid flowing in the opposite direction (into the well from the reservoir and then up to surface). After primary production, the valves 24 can be operated to shift the other sleeves 30 into position to enable injection or production for asynchronous frac-to-frac operations. The frac sleeve 50 is thus shifted to one side and the operational sleeve becomes sleeve 30. FIG. 6C shows injection mode and FIG. 6D shows production mode in this system. In this implementation, it is noted that the cement 46 and casing 14 provide the isolation between the injection and production valves, and thus there may be no need for the conduit and packers shown in FIGS. 1A and 1B.

It is also noted that valve systems having certain features as described in WO 2018/161158 (Ravensbergen et al.), which is incorporated herein by reference, could be used in this type of implementation generally shown in FIG. 6. FIGS. 18 to 25 illustrate examples of such valves that have two sleeves. The elements shown in FIGS. 18 to 25 include the following: flow control apparatus (or valve) 200 with uphole and downhole ends 200A, 200B, housing 202, sealing members 203A, 203B that are retained relative to the housing 202, housing passage 204, uphole flow communicator 206 (such as, for example, a port), downhole flow communicator 208, subterranean formation flow communicator 210 that can be a port through the housing wall, flow controller 212 configured for controlling flow between the housing passage 204 and an external environment and includes first flow control member 214 and a second flow control member 216 which can be respective sleeves inside the housing, collet retainer 202X for being releasably engaged to the first flow control member 214 while it abuts against a stop 222, tortuous flow path-defining fluid conductor 2162 that defines a tortuous flow path, fluid compartment 2164, fluid compartment-defined fluid conductor 2166, first side flow communicator 2168 (e.g., in the form of one or more ports) that extends through first side 2170 of the second flow control member 216, and filter medium 2176. In addition, the valve of this type can be configured to move from a first closed position where one of the sleeves (e.g., downhole sleeve 214) covers the housing ports 210 (FIGS. 18, 20), to a second position where the sleeve is shifted downward to expose the housing ports 210 (FIG. 19, 21), to a third position wherein the second sleeve (e.g., uphole sleeve 216) is shifted to align the flow restriction component (e.g. a tortuous flow path-defining fluid conductor 2162 that defines a tortuous flow path) with the housing port. In the third position, fluid flowing in or out of the valve via the housing ports 210 passes through the flow restriction and is therefore restricted. The flow restriction can take the form of one or more small orifices and/or a tortuous path such as that illustrated in FIGS. 23 and 24. The tortuous path can be defined by a groove in the external surface of the second sleeve 216 and can have various forms (e.g., boustrophedonic, zigzag, etc.) and can extend circumferentially around the sleeve once as illustrated or multiple times. Note that in these figures the downhole end is at the top and the uphole end is at the bottom in terms of the above description.

It is also noted that the system could be notably simplified by providing each valve to be shiftable to only one mode, either injection or production (e.g., see sleeves 30 of the valves in FIGS. 2 and 3). This simplified system could facilitate manufacturing and operational simplicity. However, due to uncertainties in reservoir response to the frac-to-frac displacement, including potential for direct communication through connected fractures or absence of a primary cement between intervals, it would be preferable that the system be configured to allow for adjustment of configurations as described in the previous paragraph. When the valves are configured to move to several different modes, various mechanisms for placing the valves into different modes could be used (e.g., via rotation, check valve placement above and below the frac sleeve, shifting tool actuation of a selective mechanism on the valve, etc.). Further simplification could involve a sleeve that is fixedly mounted within the housing of the valve (e.g., see FIG. 43).

Figure 7:
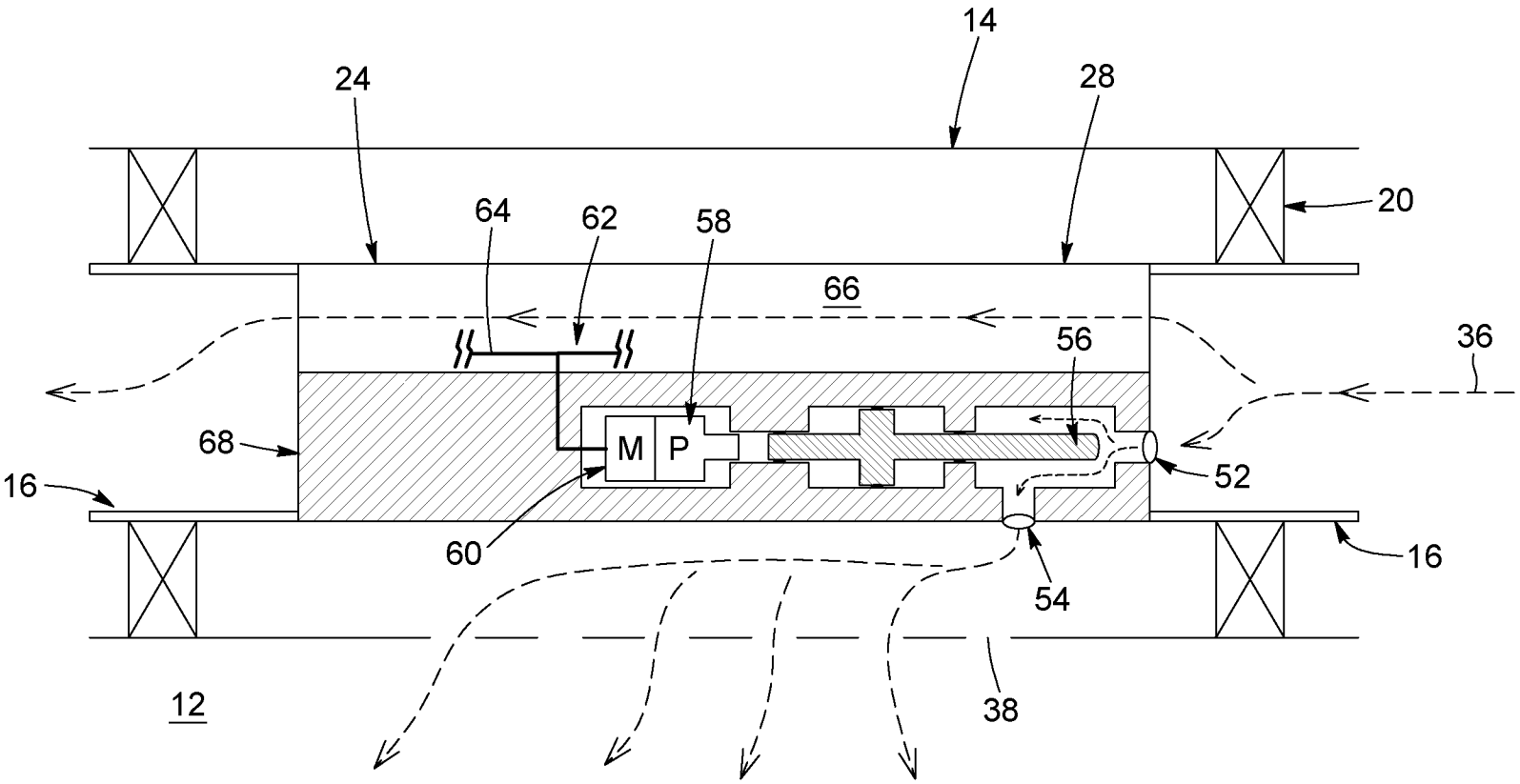
FIG. 7 is a side cut view schematic of part of a well system including a valve that includes a piston that controls fluid flow.
Figure 10:
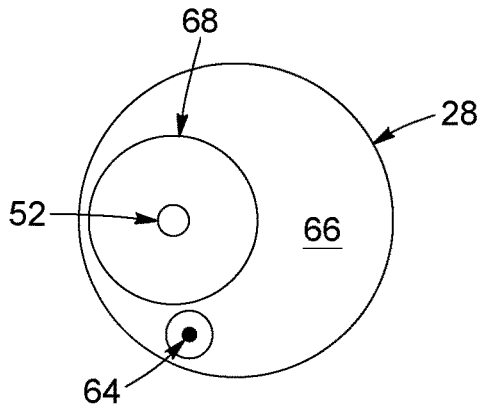
FIG. 10 is a transverse cut view schematic of part of a valve, such as the piston type valve of FIG. 7.

Turning now to FIG. 7, one or more of the valves can be configured such that fluid communication between the conduit 16 and the reservoir 12 is enabled by opening or closing a fluid passage having a first port 52 and a second port 54, and where a piston 56 can be displaced to occlude one of the ports (e.g., port 52). A pump 58 and a motor 60 can be present to move the piston 56. The motor 60 can be coupled to a power supply and a control system 62, and can be connected to a cable 64 that runs up to surface to interface with the power and control system for remotely controlling the valve. This arrangement can be provided within a housing 28 that also defines a through-conduit 66 (which may be sized to allow run-in of downhole equipment). FIG. 10 illustrates an example of this type of valve, in cross-section, illustrating the general position of sub-system 68 within the housing 28 wherein the sub-system 68 includes the piston, pump, motor and associated structures and housing. This type of valve could, for example, have one or more features described in WO 2019/183713 (Johnson & Kalantari), US 2019/0235007 (Williamson & Tajallipour) or WO 2019/148279 (Kalantari et al.).

Figure 8A:
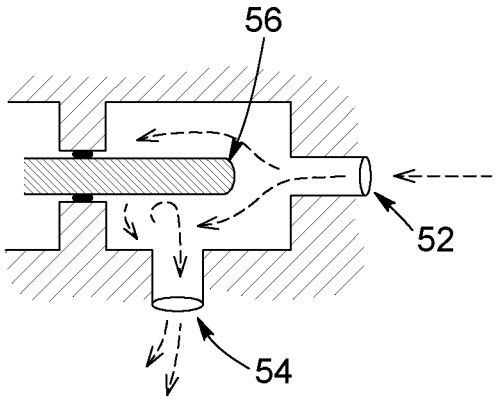
FIGS. 8A and 8B are side cut view schematics of part of a valve that includes a piston in an open position for injection and a closed position blocking production, respectively.
Figure 9A:
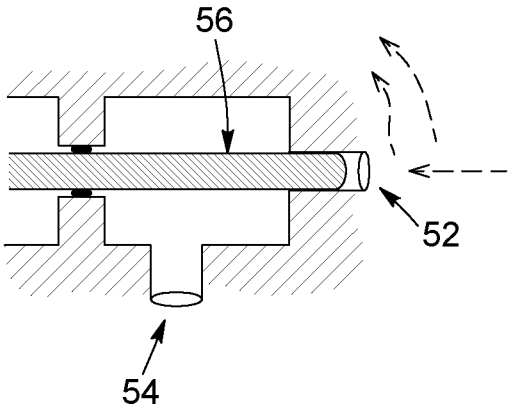
FIGS. 9A and 9B are side cut view schematics of part of a valve that includes a piston in a closed position blocking injection and an open position enabling production, respectively.
Figure 8B:
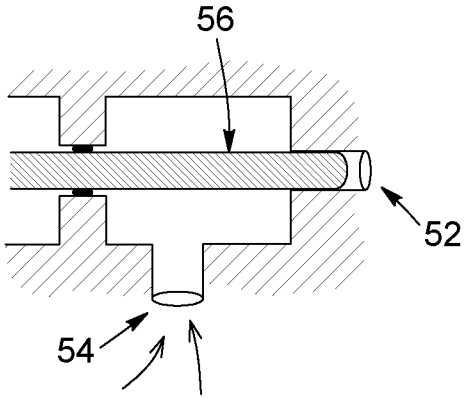
Figure 9B:
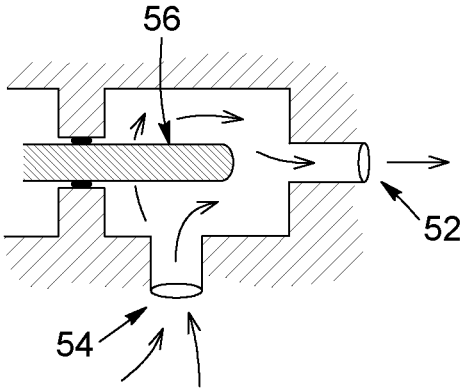

FIGS. 8A, 8B, 9A and 9B illustrate how the piston can be positioned for injection and production valves. FIGS. 8A and 9A show how the injection and production valves respectively can be configured during injection mode, while FIGS. 8B and 9B show how the injection and production valves respectively can be configured during production mode. For this type of valve, the position of the piston can be moved for each mode in order to enable or stop fluid communication. This type of valve can be remotely operated from the surface in order to switch between open and closed positions.

Referring back to FIGS. 6A to 6D, the shifting of the sleeves 30 can be done remotely when the valves 24 are coupled to a control system (not shown here), or manually using a downhole shifting tool (not shown here).

When manual shifting is performed, it can be done after primary production is complete and the well is shut in to allow a work string that includes completion equipment to be fed into the well. Using the work string, the sleeves can be shifted into the desired configuration for testing the fractured zones using fluid injection and eventually to shift into the operational configuration. The downhole work string can then be removed, and the asynchronous frac-to-frac operation can be commenced with fluid injection or production. The valves can then remain in a single operational position during these operations. If the position or configuration of the valves is to be changed, then operations can be ceased, and another work string can be deployed to shift the sleeves to a modified configuration.

When the valves are installed prior to primary recovery, the manual workover operation can simply shift the valve sleeves into the desired positions prior to commencing the asynchronous frac-to-frac operation. When the valves have not been installed, the workover operations will also include installing the inner conduit, packers, and valves using a downhole work string or other equipment for this purpose. For instance, packers can be set using a setting tool or hydraulic pressure, and sleeves can be shifted using a shifting tool. The downhole work string can be deployed using coiled tubing or wireline, depending on the application and the equipment being installed.

When remote shifting is performed, deploying a work string downhole is not required for shifting the sleeves or otherwise moving components of the valve. For remote control, the valves are connected to a downhole or surface control unit electrically or by other means whereby signals can be sent to the valves for control purposes. In one example, the valve can be a flow control apparatus as described in WO 2019/183713 (Johnson & Kalantari), US 2019/0235007 (Williamson & Tajallipour) or WO 2019/148279 (Kalantari et al.), which are incorporated herein by reference. FIGS. 37 to 45 illustrate systems and flowcharts for remote well control and optimizing operation of wells and could be used and adapted embodiments of the asynchronous frac-to-frac processes described herein. Using such optimization methods, one can optimize the asynchronous frac-to-frac processes by selecting valve modes for the valves distributed along the well (i.e., production-only, injection-only, closed, etc.); injection and production cycle times; and other variables of the process.

Figure 39:
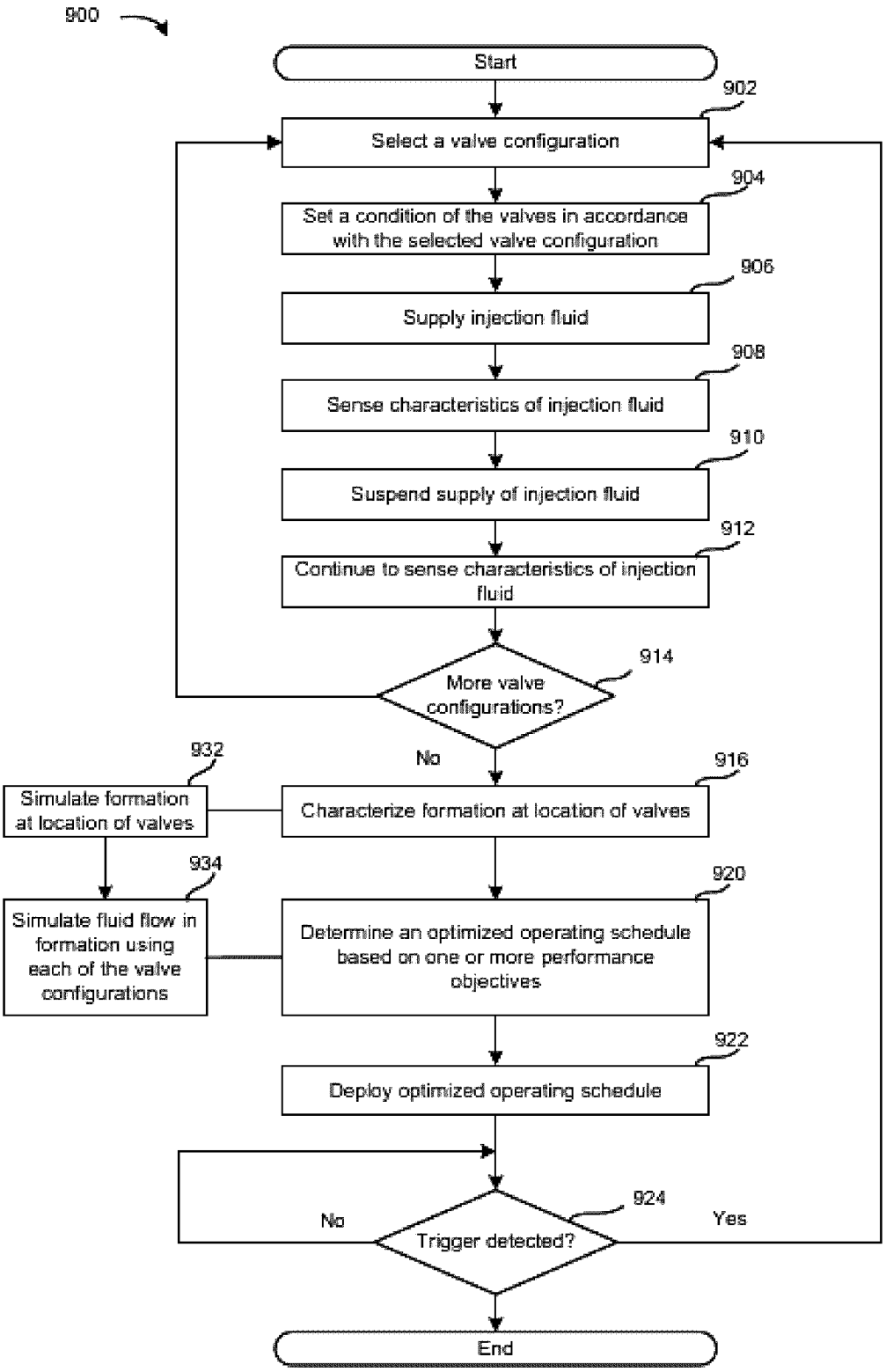
Figure 40:
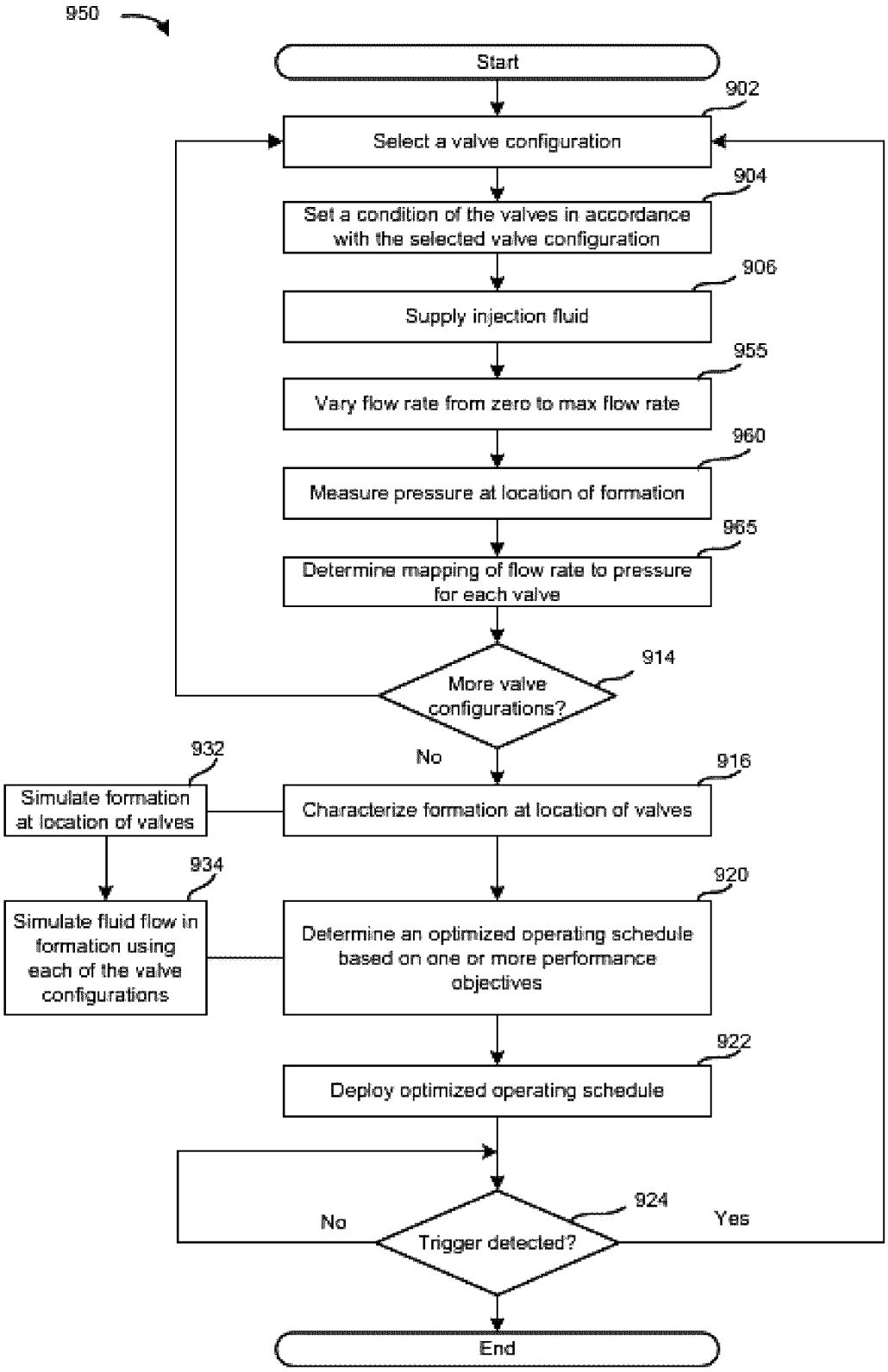
Figure 41:
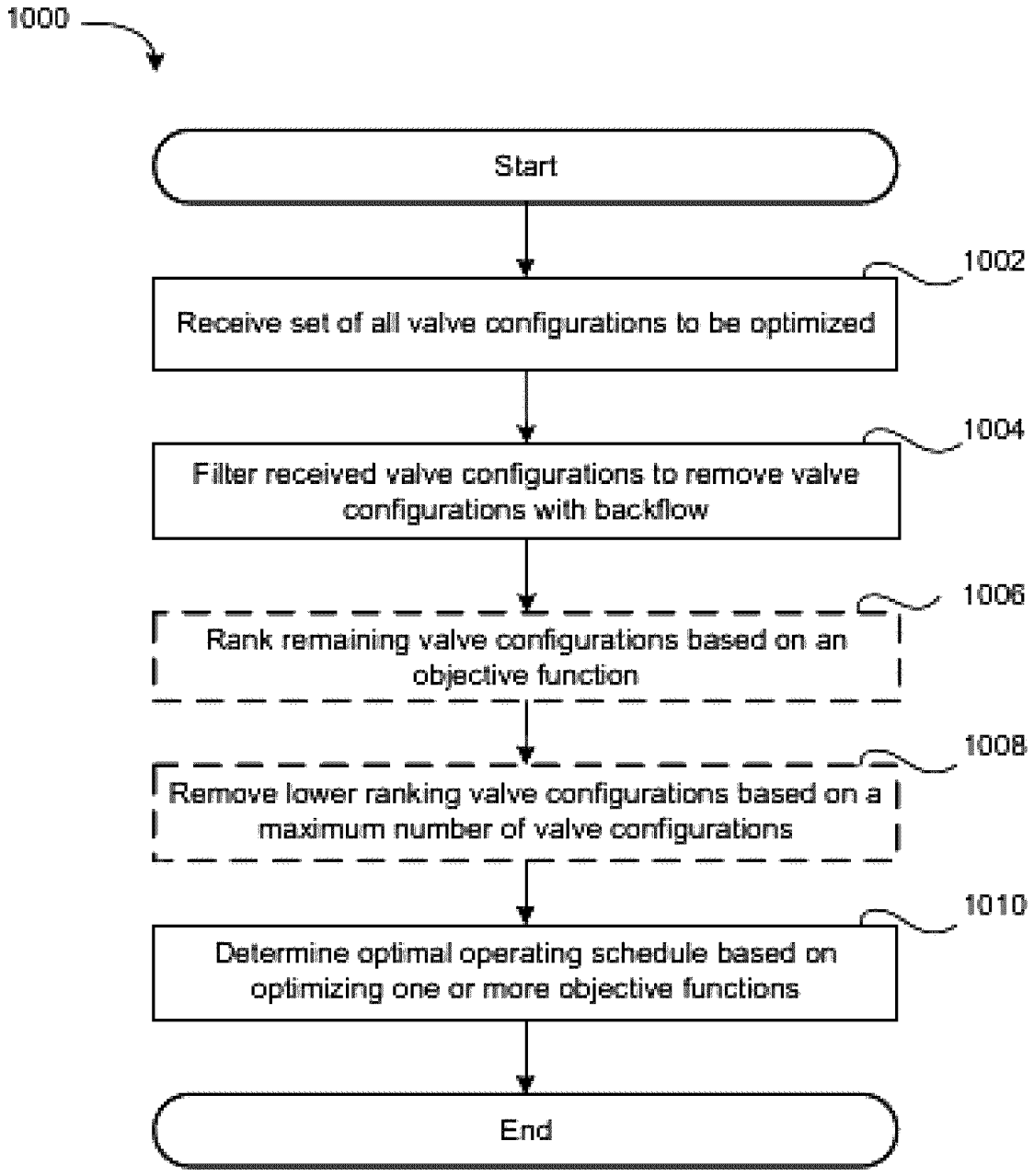
Figure 42:
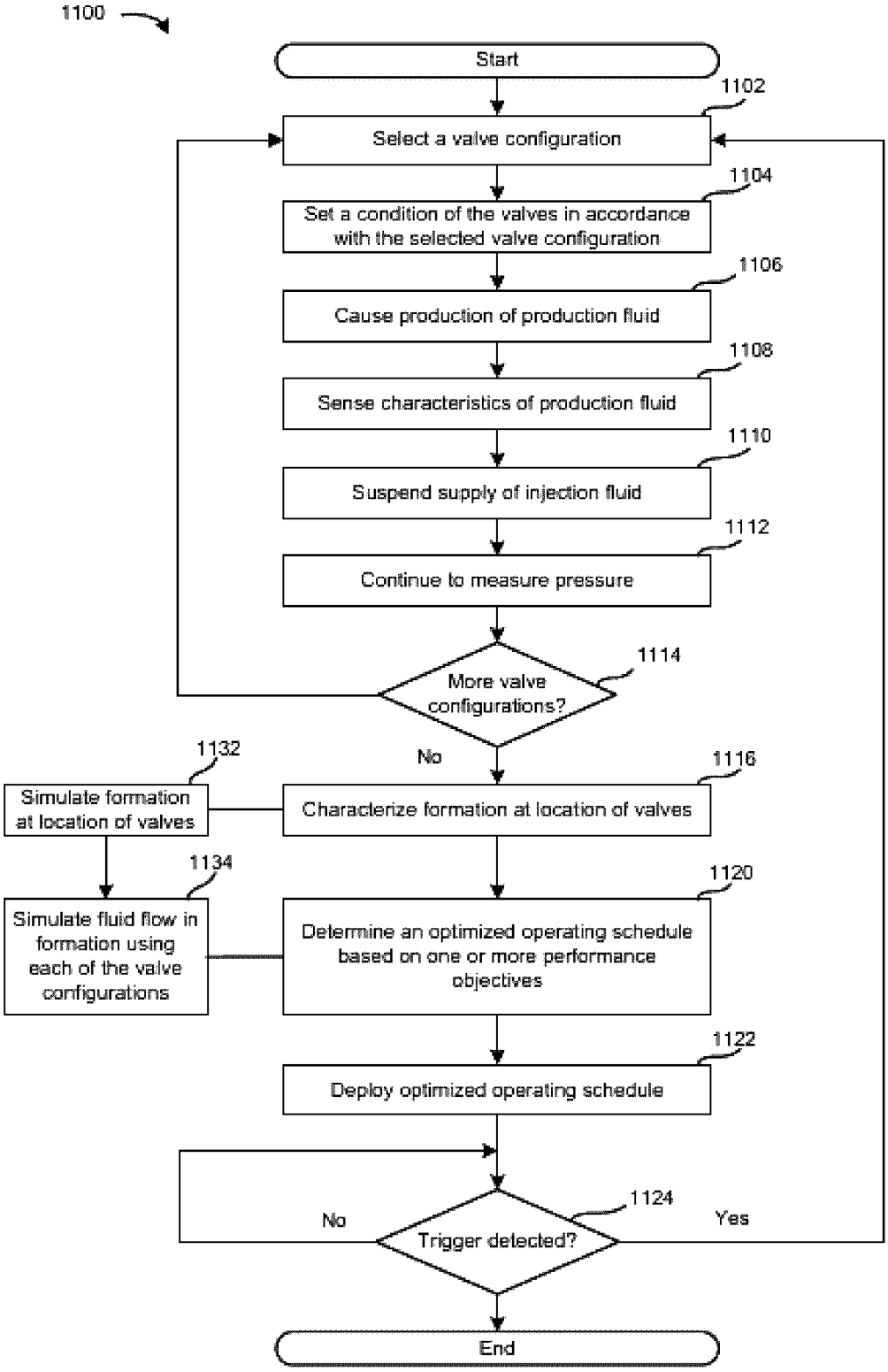

Referring to FIGS. 37 to 42, the example methods and systems can include the following elements: system 600 for operating hydrocarbon wells, control systems 602 each controlling multiple wells 601 or a single well 601, supervisory control and data acquisition (SCAD A) control system 604 coupled to a controller, such as a programmable logic controller (PLC) 606, a human machine interface (HMI) 608 coupled to the SCADA control system 604, data server 612, databases 614, application server 616, one or more databases 618, surface fluid actuator 620, fluid supply 630 located at the surface, surface sensors 622, surface flowmeter and/or pressure sensor 624 that measure a flow rate of an injection fluid or a pressure of the injection fluid, downhole sensors 640, downhole pressure sensors 642, downhole actuators 650; a processor 702 that is coupled to RAM 722, ROM 724, persistent (non-volatile) memory 726 such as flash memory, and a communication module 728 for communication with the surface fluid actuator 620, surface sensors 622, downhole sensors 640 and downhole actuators 650; the processor 702 also being coupled to one or more data ports 744 such as serial data ports for data I/O (e.g., USB data ports), and a power supply 750; a number of applications 756 executable by the processor 702 and stored in the persistent memory 726 including a production control application 760, which may operate the respective well 601 in accordance with optimized operating settings or parameters based on sensor data acquired from the respective well 601 and determined by an optimization application 762 of the application server 616 and pushed down to the PLC 606 (wherein the optimization application may be a machine learning or artificial intelligence based application); the memory 726 also storing a variety of data 770 including sensor data 772 acquired by the surface sensors 622 and downhole sensors 640, operating settings 774 such as optimized operating settings or parameters including valve position data relating to the open or closed states of the valves of the tubing string (e.g., a state of the tubing string or well 601), and production data 776; a method 900 of optimizing operation of one or more tubing strings by an optimization apparatus, which may be the PLC 606 or the application server 616, and includes operations 902, 904, 906, 908, 910, 912, 914, 916, 920, 922, 924, 932 and 934 as shown in FIG. 39; a method 905 of optimizing operation of one or more tubing strings by an optimization apparatus (differing from the method 900 at least in the characterization phase) and including additional operations 955, 960 and 965 as shown in FIG. 40; wherein the method 900 may be used when the injectivity or the hydraulic resistivity of the reservoir in which the tubing string is located is relatively constant and the reservoir may be modeled using analytic techniques and wherein the method 905 may be used when the injectivity or the hydraulic resistivity of the reservoir in which the tubing string is located is not relatively constant; a method 1000 of determining an optimal operating schedule by an optimization apparatus and including the operations 1002, 1004, 1006, 1008, 1010 as shown in FIG. 41; a method 1100 of optimizing operation of one or more tubing strings by an optimization apparatus where the method 1100 is similar to method 900 except that the tubing string is a production string and the method includes operations 1102, 1104, 1106, 1106, 1108, 1110, 1112, 1114, 1116, 1120, 1122, 1124, 1132 and 1134 as shown in FIG. 42.

Implementations for New Well System for Casing or Liner Deployment

In this implementation, hydraulic fractures are first placed at desired locations along a well in a reservoir. The fracturing can be done using multistage fracturing techniques, e.g., using type coiled tubing shifted sleeve valves each containing two sleeves. The coiled tubing shifted sleeve valves can be of the type and design provided by NCS Multistage Inc, for example.

The valves can each include a housing with a frac port provided through the housing wall. In addition, the valves can include a first sleeve for covering and uncovering a frac port, to be used for closing the sleeve for isolation and opening the sleeve for hydraulic fracturing, primary production and unregulated injection. The valves can also include a second sleeve having one or more check-valve devices for permitting injection through the valve only while well pressure exceeds formation pressure, or a third sleeve having one or more check-valve devices for permitting production through the valve only while well pressure is less than formation pressure. In other words, each valve can include a first-phase sleeve for fracturing and production during primary production, and a second-phase sleeve that can be designed either for injection-only or production-only and thus has a check-valve device enabling either injection or production.

After hydraulic fracturing, the well is placed on production by opening only the first sleeve for up to all zones. This is the primary production phase.

After primary production, the well can then be configured for asynchronous injection and production by shifting the second-phase sleeves to regulate flow through the frac ports located in the housings.

The well is completed using an array of dual sleeve valves, each having a first-phase sleeve and a second-phase sleeve. In one implementation, the valves are arranged such that alternating valves in the array have either a second sleeve (injection-only) or a third sleeve (production-only). Thus, sleeve valves having a first and second sleeve are for injection, while sleeve valves having a first and third sleeve are for production. Second sleeves may contain a check-valve device for permitting injection outflow only while well pressure is greater than formation pressure and for preventing inflow while well pressure is less than formation pressure. Second sleeves may further contain a flow control device for regulating injection by limited-entry flow restriction in order to distribute injection fluid outflow along the length of the well. Third sleeves may contain a check-valve device for permitting production inflow only while well pressure is less than formation pressure and for preventing outflow while well pressure is greater than formation pressure. Third sleeves may further contain a flow control device for reducing the throughput of non-oil fluid phases including both or either of water and/or gas. Production sleeve valves may further contain a screen for restricting or excluding the production of formation sand or fracturing proppant.

The flow control device for the injection sleeves can include a tortuous path that induces a pressure reduction on the flow stream as a product of the flowrate, for example. Each individual interval can achieve an equilibrium condition, balanced by the reservoir injection pressure, reservoir injection flow capacity and tortuous path flow resistance on the downstream side, and by the casing injection pressure on the upstream side. With each of these factors being fixed during any particular time interval, the flowrate through any particular injection sleeve flow control device can be determined (or controlled) as a dependent governed variable of the pressure difference across the tortuous path flow resistance. The practical effect of this relationship is two-fold. Firstly, since the tortuous path flow resistance increases with pressure difference, rate of injection into intervals that are connected to parts of the reservoir having a lower flow resistance will be selectively limited, relative to other parts of the reservoir having higher flow resistance which may be disposed to the well. Secondly, the upstream casing injection pressure may be maintained at a higher value, thus increasing the injection rate into intervals disposed to parts of the reservoir having higher flow resistance. The tortuous path can be provided to have a boustrophedonic configuration, for example.

Some examples of two-sleeve valves and tortuous paths and related structures and equipment are described in WO 2018/161158 (Ravensbergen et al.) and can be adapted for use in the present technology. FIGS. 18 to 25 illustrate valves that have two sleeves, one of which including a tortuous path, and other features that can be used in and adapted for the present technology, for example by incorporating check-valve devices.

A conceptual example of this type of implementation is illustrated in FIGS. 6A to 6D, where the valves are installed prior to fracturing and primary recovery, and each valve 24 includes two sleeves 50,30. The valves can be run with the casing and cemented into the well. Of course, a similar process could be conducted where at least two valves are provided for each segment of the well, one being for fracturing and production and the other being for the asynchronous frac-to-frac operation.

This implementation can present benefits since after primary production the time, resources and infrastructure to implement the configuration in asynchronous frac-to-frac mode are less compared to retrofitting operations that can use an inner conduit and packers, as described herein. When manually-shifted sleeves are used as the production-only and injection-only sleeves 30, then after primary production a work string can be deployed to shift the sleeves into their desired positions. When remotely operated sleeves are used as the production-only and injection-only sleeves 30, then after primary production the sleeves can be shifted into their desired positions using a control system at surface, thus avoiding any additional downhole work using a work string and associated rig.

It is also noted that this implementation could be performed using valves that enable fluid communication using components other than shiftable sleeves. For example, valves using a piston-type system (e.g., see FIG. 7) with the control cable being provided on the outside of the casing. Other valves, such as sFrac™ Valves could be used.

It is also noted that the valves and asynchronous frac-to-frac process could be implemented in a well drilled into an existing waterflooded or EOR field. In this case, the valves would be installed prior to any production from that newly-drilled well. In such a case, the first production from that well may not be definable as "primary" production.

Implementations with Retrofitting Existing Well

In other implementations, the well can be retrofit with appropriate equipment after primary production. A retrofit system can be provided for tubing deployment and positioning to provide the production-only and injection-only positions. A retrofit system could alternatively be configured to be autonomously controlled to provide the valves in production-only and injection-only positions.

In one implementation, hydraulic fractures are first placed at desired locations in a reservoir. The fracturing can be done using multistage fracturing techniques, e.g., using type coiled tubing shifted sleeve valves. The coiled tubing shifted sleeve valves can be of the type and design provided by NCS Multistage Inc, for example, and each valve can include a single sleeve.

After hydraulic fracturing, the well may be placed on production by any method and for any period of time. Any hydrocarbon production method could be used and may or may not involve the injection of fluid though the well or an adjacent well.

After a period of primary production, the production is stopped and an array of valves (e.g., valves that may include sleeves) is installed such that the well may be configured for asynchronous injection and production for example by shifting the sleeves into a first position or a second position to regulate flow through each valve. These new valves are sized to have a diameter that is smaller than the casing and sleeve valves that were used for the fracturing and primary recovery. Appropriate conduits and packer are also provided. An example configuration of this is shown in FIGS. 1A and 1B. Production tubing-deployed valves, each containing a single sleeve having two positions, can be used to regulate the flow of injection fluid from the well into the formation or the flow of production fluid from the formation into the well. Each valve may be configured for injection or production by positioning its sleeve into one of the two positions.

In the first sleeve position injection flow can be regulated using a check-valve device for permitting injection flow through the valve only while well pressure is greater than formation pressure and for preventing inflow while well pressure is less than formation pressure. In the first sleeve position, flow may be further regulated by channeling it through a flow control device for regulating injection by limited-entry flow restriction in order to distribute injection fluid outflow along the length of the well.

In the second sleeve position, production flow is regulated using a check-valve device for permitting production flow through the valve only while well pressure is less than formation pressure and for preventing outflow while well pressure is greater than formation pressure. In the second sleeve position, production flow may be further regulated by channeling it through a flow control device to reduce the throughput of non-oil fluid phases including both or either of water and/or gas. The second sleeve position may further divert flow through a screen for restricting or excluding the production of formation sand or fracturing proppant.

Sleeve positions may be selected to configure alternating valves in the array in a production configuration and an injection configuration. Sleeve positions may be selected to configure valves in the array in any other preferred arrangement of either production configuration or injection configuration, for example to isolate a direct hydraulic short circuit between adjacent zones in which case it may be desirable to conduct injection or production at two or more adjacent zones.

In this tubing-deployed valve implementation, the valves are deployed along with an inner conduit and packers, as generally described above for FIGS. 1A and 1B. Upon installation of the valves, each of the valves can be tested by pumping fluid through the valve into the reservoir, and using the non tested check valves to prevent fluid backflow from non tested zones. In this way, the injectivity of the reservoir at each injection interval can be assessed upon installation. Further, the tests can be used to determine whether each fractured zone is isolated and does not immediately and directly communicate with other zones, has a hydraulic short circuit with an adjacent well segment, or has other injectivity or productivity features such that each valve can be set as an production-only valve or an injection-only valve. Once all valves have been set, the tool string and tubing can be removed and the asynchronous injection and production process can begin.

In some implementations, the valves are operated in a remote and autonomous manner. As with the above implementation, hydraulic fractures are first placed at desired locations in a reservoir using coiled tubing shifted sleeve valves or any other method. After hydraulic fracturing, the well may be placed on production by any method and for any length of time. After a period of primary production, an array of remotely controlled interval control valves ("ICVs", for example Qumulus™ ICVs) may be installed to position each ICV in isolated communication with a zone comprising an individual hydraulic fracture or a group of adjacent hydraulic fractures to manage asynchronous injection and production by selecting the state of each individual ICV as needed to regulate flow at each zone. Examples of such ICV type valves are shown in FIG. 7 and in the following publications: WO 2019/183713 (Johnson & Kalantari), US 2019/0235007 (Williamson & Tajallipour) and WO 2019/148279 (Kalantari et al.).

ICV states, whether opened or closed, may be selectable from surface. ICV states, may be selected to place alternating valves in the array in a production configuration and an injection configuration. ICV states may be selected to place alternating valves in the array in either a production configuration or an injection configuration. ICV states may be selected to place ICVs in any arrangement of either production configuration or injection configuration, for example to accommodate a direct short circuit between adjacent hydraulic fractures in which case it may be desirable to conduct injection or production in two or more adjacent zones which are not sealed outside of the completion. ICV states may be selected for each ICV in isolation of what states are selected for any of the other ICVs in the array, based on what is needed to manage the enhanced oil recovery (EOR) scheme. The ICVs may contain permanent sensors, for example to measure the pressure and temperature in the annulus at the location of the ICV.

In practice, the ICVs may be controlled using an artificial intelligence (AI) system trained on data obtained from operations in order to optimize the overall system. Various factors could be taken into consideration (e.g., measured properties, actions taken and corresponding effects, etc.) as relevant input data for Al system training, and for AI-assisted implementation of asynchronous frac-to-frac processes optionally combined with cyclic processes. The ICV array may be managed autonomously with the assistance of an AI system or another type of control system.

The array of ICVs may be installed within a single well or within multiple wells in proximity. Where ICVs are installed in multiple wells in proximity they may be used to manage injection and production collectively from the wells.

When considering the hydraulic fracture locations, hydraulic fractures subject to inter-frac flooding for waterflood or EOR may share a common well or may share a system of wells.

Implementations With Hybrid Process

In some implementations, a hybrid process can be used to recover hydrocarbons via the well by performing asynchronous injection and production via some valves that communicate with through-fractures (natural fracture or hydraulic fracture) fluidly interconnected fractured zones and cyclic injection and production (also known as "huff and puff") via other valves that communicate with fluidly isolated fractured zones. This process therefore incorporates both through-fracture displacement and cyclic fluid injection and production. It is noted that the through-fracture displacement case can benefit from the same recovery mechanisms as the cyclic fluid injection and production case, at the fluidly interconnected fracture reservoir rock surface.

More particularly, some injection zones may directly hydraulically communicate to some production zones by interconnected fast flow or high permeability pathways, for example, a natural fracture, interconnected natural fracture network or interconnected hydraulic fractures. Still other injection zones of the reservoir may be connected to a reservoir region that is isolated or contained, that is, not directly connected to other production zones by an interconnected fast flow pathway, so that fluid (e.g., gas) injected into these zones over the period of an injection cycle will remain entirely or substantially contained in the reservoir zone into which it was injected. In this case, cyclic injection may be performed into selected intervals that are connected to contained reservoir regions to conduct a cyclic injection EOR scheme (also known as "huff and puff"); while fluid is asynchronously injected into non-selected intervals to displace fluid through the fast flow pathways for recovery via the production-only valves during the subsequent production mode. It is noted that "fast" communication can be viewed in contrast to "slow" communication through the reservoir rock matrix, which is desirable for volumetrically efficient EOR.

In this hybrid setup, a portion of EOR incremental oil production would occur from the cyclic injection zones and a portion would occur from the production zones that receive injection fluid and displaced oil from interconnected fast flow pathways.

Figure 12:
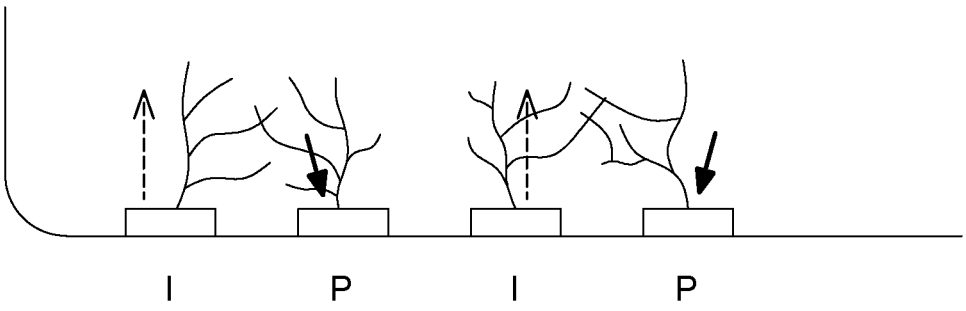
FIGS. 12 to 15 are side view schematics of wells having valves that are for injection, production or cycling operation.
Figure 13:
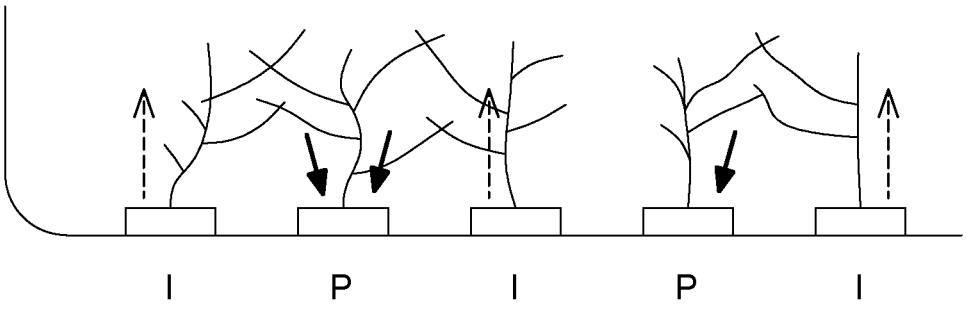
Figure 14:
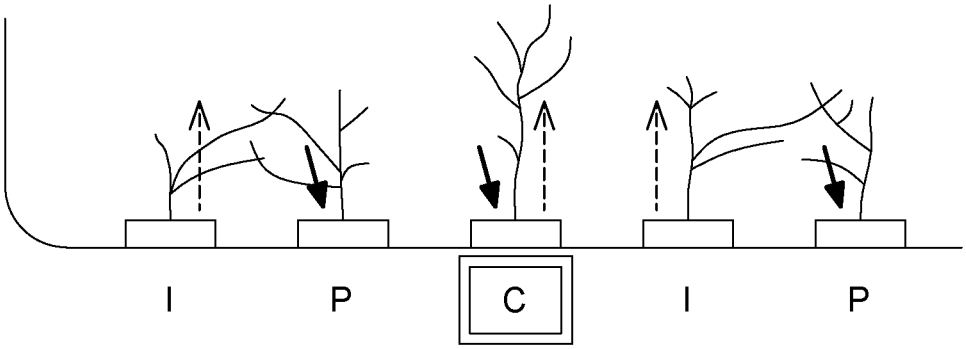
Figure 15:
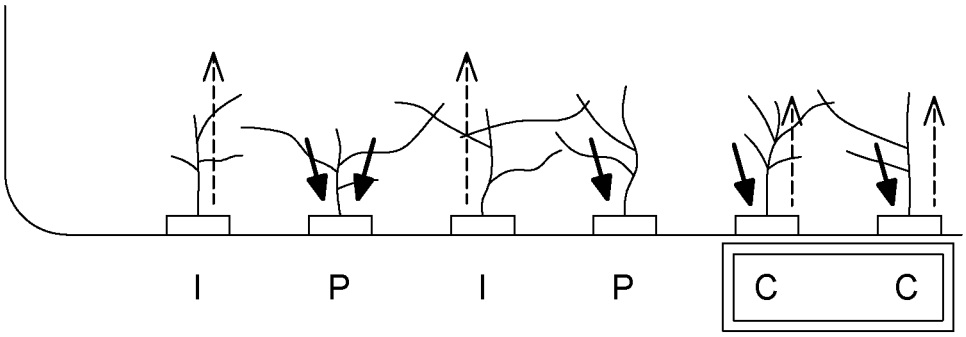

Conceptual examples of such a hybrid configuration is shown in FIGS. 14 and 15, where injection valve (I) and production valve (P) pairs or groups of valves are operated asynchronously for fractured zones that are hydraulically connected, while cyclic valves (C) that communicate with contained fractured zones are operated with cyclical injection and production at the same time. By contrast, FIGS. 12 and 13 show wells that only have I-P valve pairs or groups and thus are operated only using an asynchronous frac-to-frac process.

Figure 16:
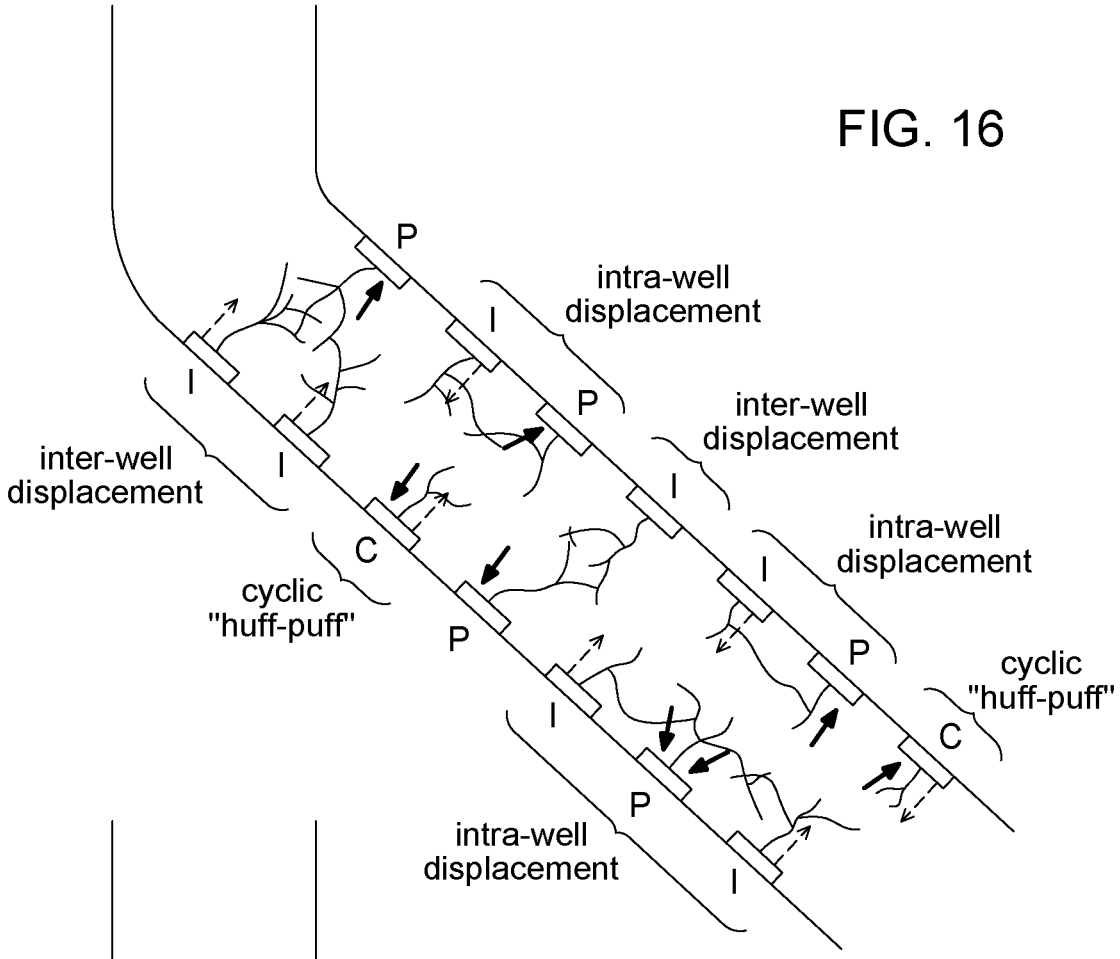
FIG. 16 is a perspective top view schematic of adjacent wells having valves that are for injection, production or cyclic operation with intra-well or inter-well displacement.

It is also noted that injection and production zones do not have to share the same well. By way of example, FIG. 16 illustrates two generally parallel horizontal wells that each have a number of valves distributed along their length and which are operated based on the appropriate scheme depending on hydraulic communication or lack thereof with adjacent or opposing fractured zones. There can therefore be a combination of inter-well displacement, intra-well displacement and cyclic "huff and puff" recovery mechanisms at play. In addition, when multiple wells are present, the timing of injection and production can be coordinated such that injection occurs at the same time in both wells, as does production.

Figure 17:
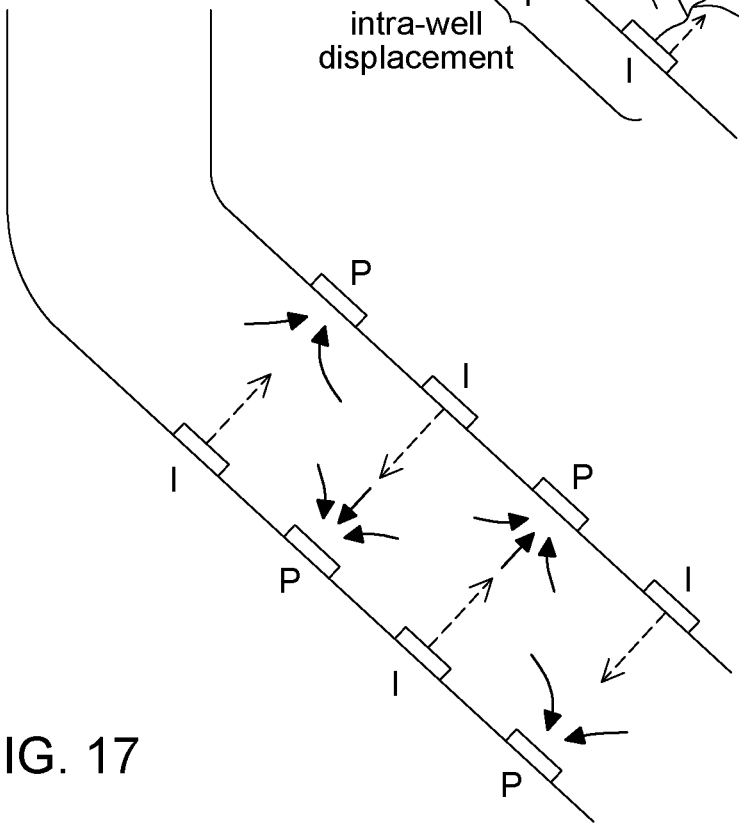
FIG. 17 is a perspective top view schematic of adjacent wells having valves that are for injection or production with inter-well displacement.
Figure 18:
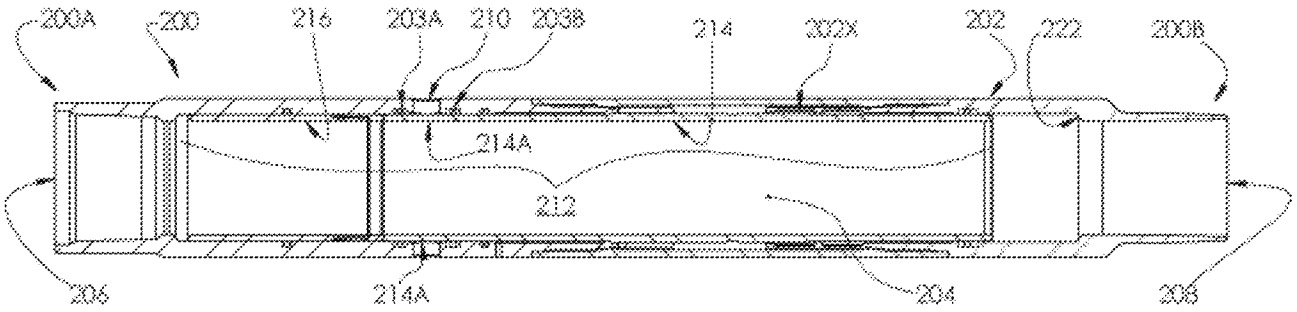
FIGS. 18 to 22 are side cut views of a type of valve that can be used in the context of frac-to-frac processes described herein, wherein the valve includes two inner sleeves and has a closed position (FIG. 18, FIG. 20), a second position where the lower sleeve is shifted downward to fracturing or production (FIG. 19, FIG. 21), and a third position where the upper sleeve having a flow restriction is shifted downward to enable flow restricted injection (FIG. 22). Embodiments of such valves have been referred to as INNOVUS™ Convertible Frac Sleeves with TORIUS™ Regulator.
Figure 19:
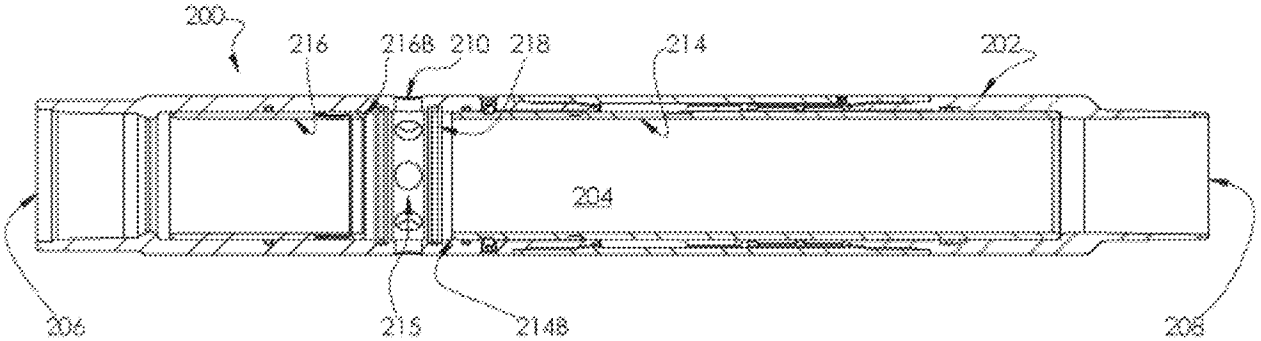
Figure 20:
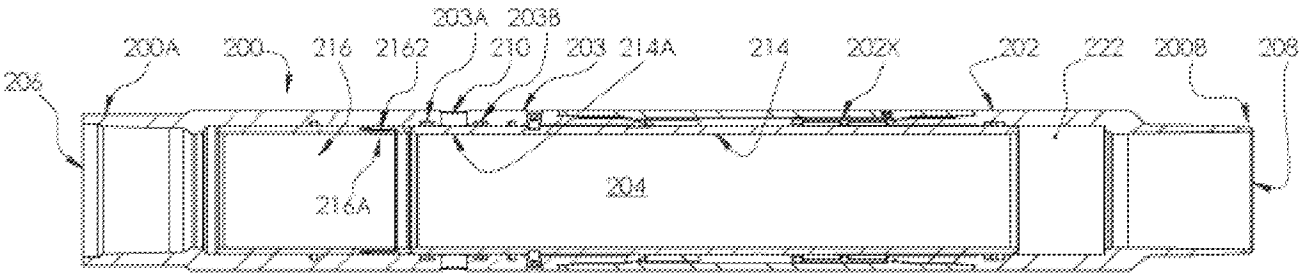
Figure 21:
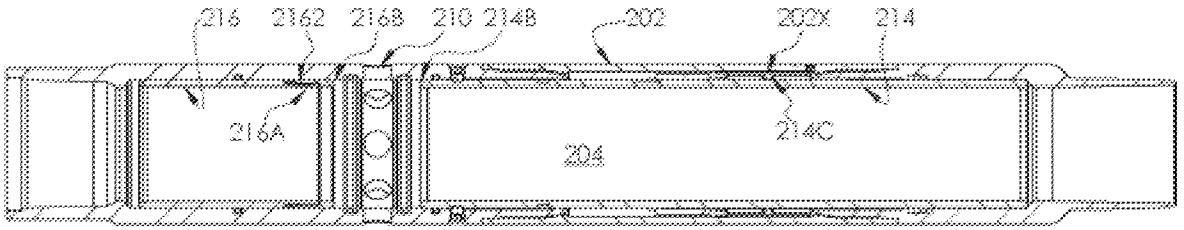
Figure 22:
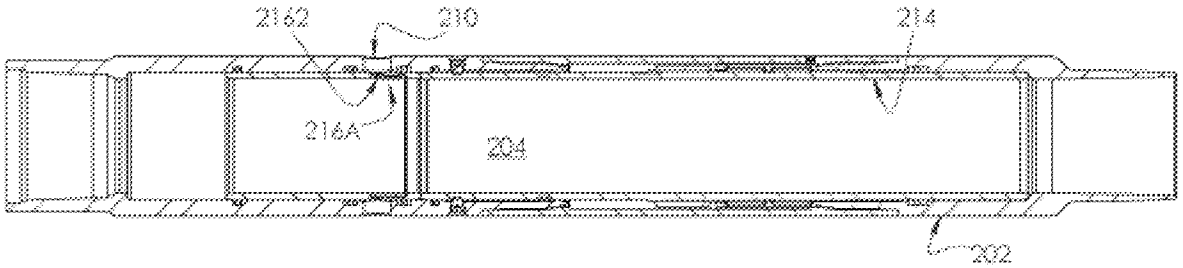
Figure 23:
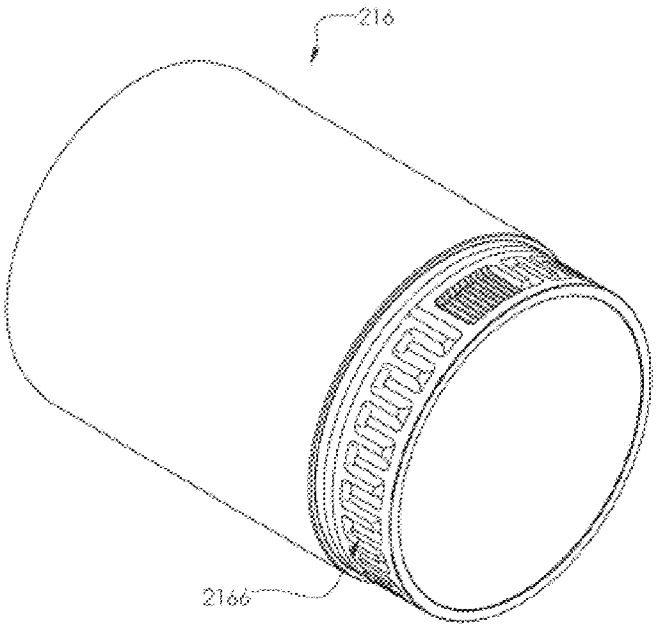
FIGS. 23 and 24 are perspective views of an example sleeve with a flow restriction component, the sleeve being usable as the upper sleeve of the valve of FIGS. 18 to 22 and other types of sleeves. Embodiments of such sleeves have been referred to as TORIUS™ Regulator products.
Figure 24:
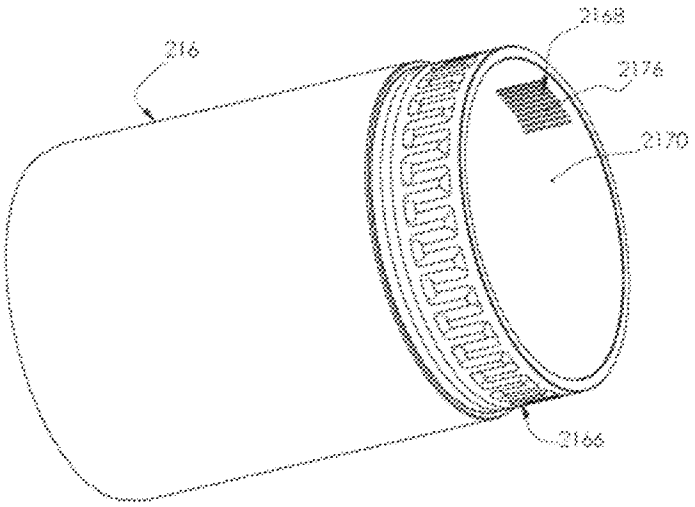
Figure 25:
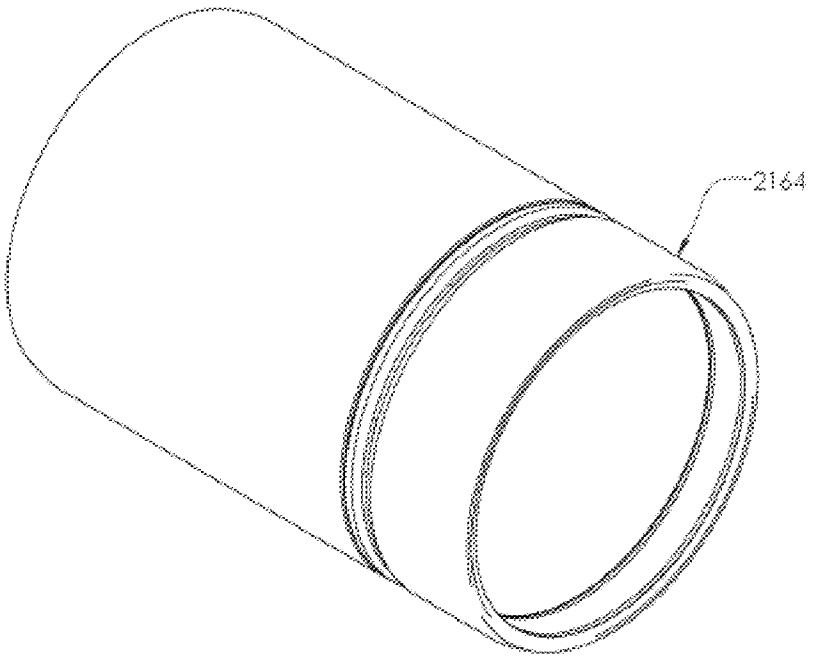
FIGS. 25 is a perspective view of an example sleeve usable as the upper sleeve of the valve of FIGS. 18 to 22, where a cap is provided over one end to enclose a flow restriction component.
Figure 26:
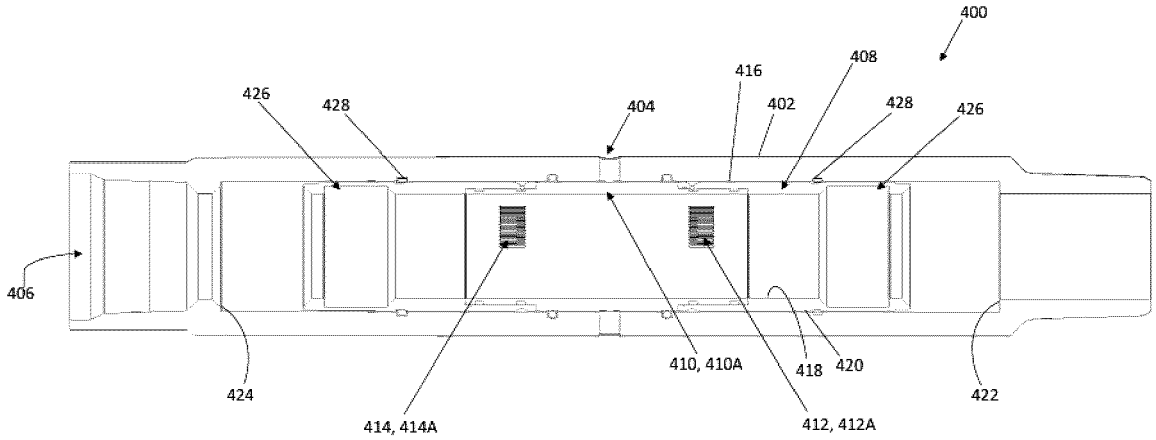
FIGS. 26 to 34 are side cut views of other types of valves that can be used in the context of frac-to-frac processes described herein, wherein the valves include a sleeve with three operational positions including a central position, an up-shifted position and a down-shifted position. The valve sleeves can also include flow restriction components that communicate with the housing port in respective positions. Embodiments of such valves have been referred to as TERRUS™ Injection Sleeves with TORIUS™ Regulator.
Figure 27:
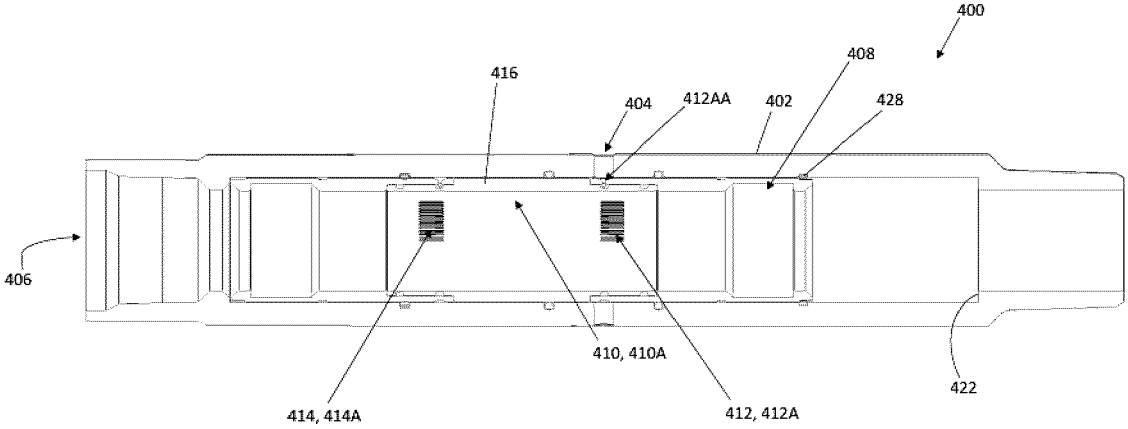
Figure 28:
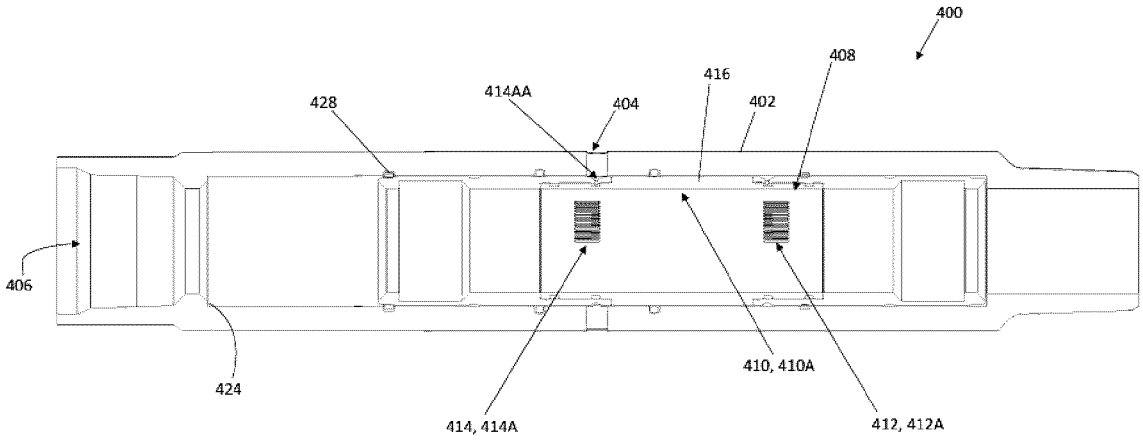
Figure 29:
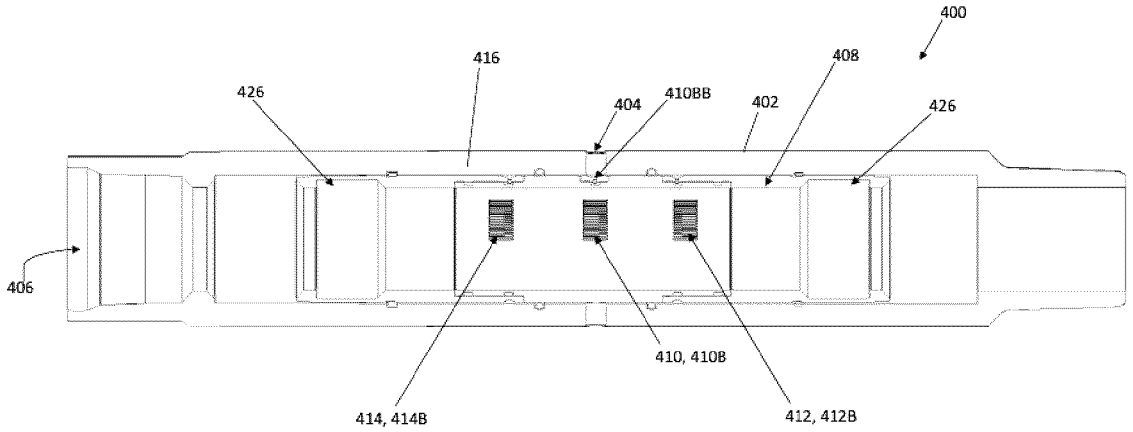
Figure 30:
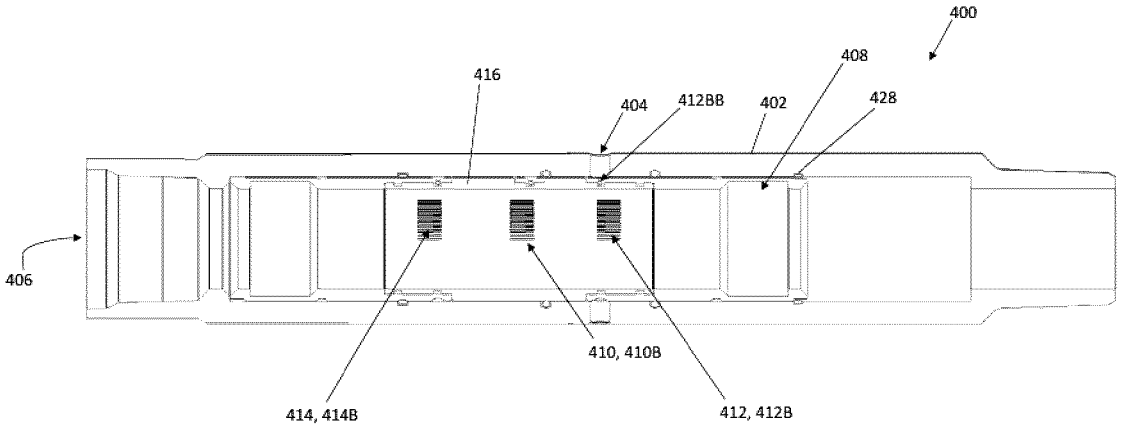
Figure 31:
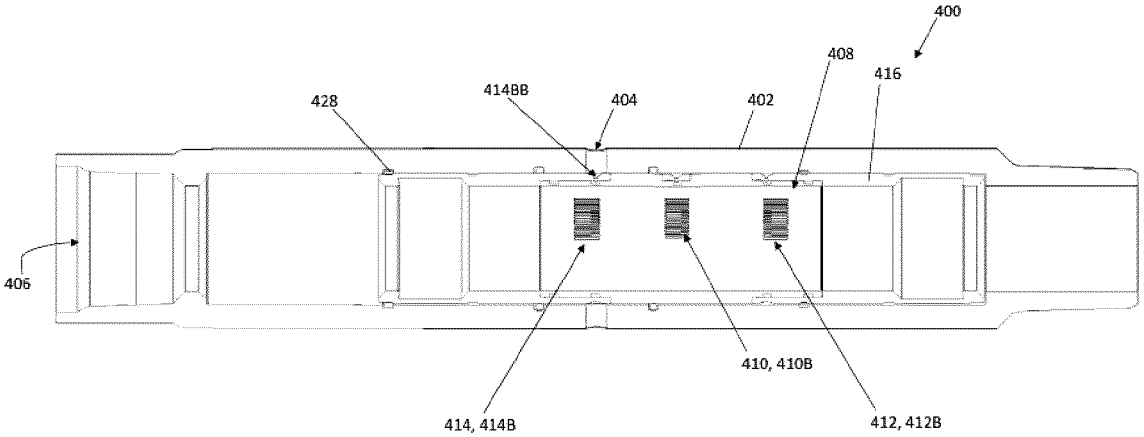
Figure 32:
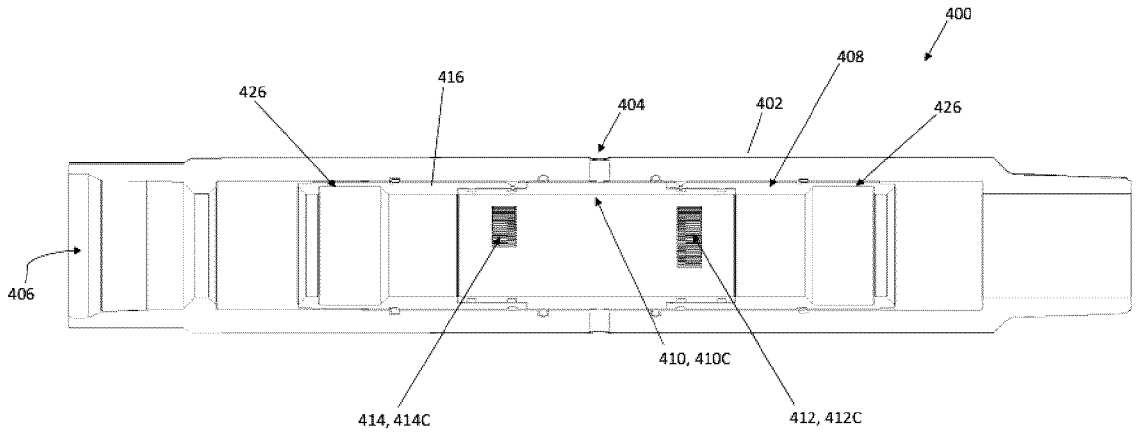
Figure 33:
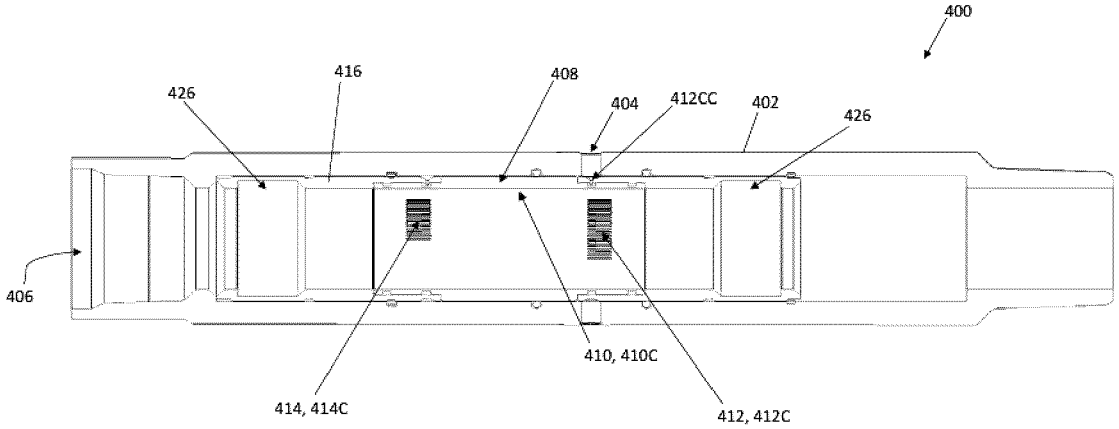
Figure 34:
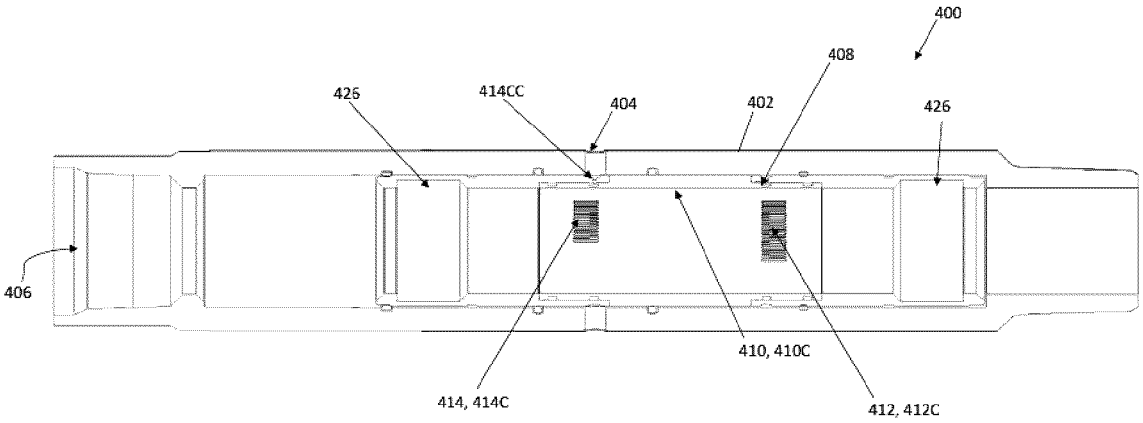

When two adjacent wells are used, the valve arrays of the two wells could be arranged in a staggered relation to each other or directly across from each other. Various operating schemes can be implemented. For example, as shown in FIG. 17, an alternating arrangement of injection and production valves can be provided for both wells, but offset between the two wells such that a production valve in one well has an injection valve directly opposed to it in the other well. In such configuration, both inter-well and intra-well displacement can be promoted since the production valves can receive displaced oil from injection fluid that has been delivered by both adjacent injection valves and opposed injection valves. Of course, many other configurations and operating schemes are possible and can change over time as properties of the fluids and reservoir are measured.

An example advantage of a hybrid process is that it can facilitate operating at higher or closer-to-optimal overall injection pressures.

Injection Fluid Implementations

In some implementations, the injection fluid is a compressible fluid that is a gas or in a supercritical fluid state.

For instance, the injection fluid can be a supercritical fluid, such as $CO_2$, at reservoir conditions. The injection fluid can be relatively hot. The injection fluid can be miscible or immiscible with the oil in the reservoir. The injection fluid could be field gas or enriched field gas, methane, methane blends, nitrogen, air, ethane, light gaseous hydrocarbons, or other gases or mixtures of such gases that may be suitable for secondary or tertiary recovery. The selection of the fluid can be based on various reservoir properties. The injection fluid can also be a multiphase fluid, again depending on the EOR method being used. As mentioned above, it is noted that the valves, the check-valve devices and/or the flow control devices, as the case may be, can be designed and implemented depending on the type of injection fluid to be used.

It is also noted that depending on the type and properties of the injection fluid, the asynchronous frac-to-frac process could be considered a secondary or tertiary recovery process. An applicable type of EOR for asynchronous frac-to-frac operations in tight oil reservoirs would be miscible gas displacement, since gas pressure may be used to store energy and then release it gradually during production mode. Further, during an asynchronous frac-to-frac production cycle, the beneficial interaction of injected gas would continue at the interface between it and the reservoir fluid. In addition, particularly for light tight oil, secondary recovery using waterflood may not be feasible and therefore one could proceed straight to miscible gas EOR using asynchronous frac-to-frac following a primary production period.

Monitoring and Adjustment of Process

Once the valves are set in their production-only and injection-only modes, the asynchronous frac-to-frac process can be conducted over a period of time. A number of variables can be monitored during the process to assess properties and performance indicators. In response to the monitoring, the asynchronous frac-to-frac process can also be adjusted if desired. For example, if two adjacent injection-only and production-only valves are experiencing a hydraulic short circuit, then one possible adjustment to mitigate this issue is to convert both valves to the same mode, i.e., both being injection-only or production-only. The hydraulic short circuit could be via a primary cement channel, a failed packer isolation, a complex hydraulic fracture in the reservoir, a natural fracture or fault in the reservoir, or a too-high permeability pathway. Other actions can also be taken in addition to grouping the short-circuited valves together to operate in a single mode, such as modifying other proximal valves to accommodate the new grouping (e.g., by converting such proximal valves from injection to production mode or vice versa). For example, if the short-circuited valves are both converted to injection-only valves, at least one other proximal valve (e.g., a valve that is adjacent to one of the short-circuited valves) can be converted from an injection valve to a production valve.

Other adjustments are also possible when a hydraulic short circuit is detected between two or more valves that are operating in different modes. For instance, one or both of the valves can be closed (e.g., one could close the injection-only valve that is the source of the hydraulic short circuit, close the production-only valve that is receiving the fluid, or both). In another example, a chemical gel, a polymer or water can be selectively placed via the injection valve to mitigate the hydraulic short circuit. In yet another example, the production valve could be intermittently closed to permit favorable relative permeability modification. In another example, one could isolate the zones and reduce injection pressure to attempt partial or full fracture closure, e.g., notably in the case of a complex hydraulic fracture or natural fault causing the hydraulic short circuit. Depending on the reason for and the location of the hydraulic short circuit, appropriate mitigation strategies can be implemented to adjust operations. In addition, different adjustments can be conducted simultaneously or concurrently (e.g., closing a valve and changing the mode of another valve), and the operation can be monitored during and/or after adjustment to assess the effectiveness of the adjustment strategy. In this manner, the asynchronous frac-to-frac process can be modulated over time to adapt to issues, such as hydraulic short circuits.

It is also noted that the asynchronous frac-to-frac process can be modulated over time to change the configuration of the production and injection valves, not necessarily in response to a hydraulic short circuit or other detected characteristics. For instance, after a given operating period, all or some of the valves of the asynchronous frac-to-frac process of one or more well can be switched between modes to "reverse" fluid flows. Thus, injection valves become production valves, and vice versa. In another example, the groupings of the valves can be changed (e.g., a series of alternating production and injection valves can be reconfigured so that there are pairs or groups of adjacent injection valves and/or production valves alternating along the well; or vice versa where a series of alternating pairs or groups of production and injection valves can be reconfigured so that there are individual adjacent injection valves and/or production valves alternating along the well). In other words, the valves can be changed from an operating pattern such as I-P-I-P-I-P-I-P to an operating pattern such as I-I-P-P-I-I-P-P; or vice versa such as I-I-I-P-P-P-I-I-P-P to I-P-I-P-I-P-I-P-I-P, for example. Various other reconfigurations are also possible where at least some valves are converted from one mode to another. It is also possible to change other variables of the asynchronous frac-to-frac process, such as fluid injection pressure, flowing bottom hole pressure, injection fluid type, and so on.

Adjustment of valves from one mode to another (e.g., injection, production, closed) can be facilitated by using remotely operated ICVs, so that the adjustments can be conducted quickly, responsively and without workover operations. Alternatively, valve adjustments can be performed via workover operations where a work string is deployed downhole to manually shift the valves.

Check Valve Device Implementations

Example embodiments of check valve devices are described in more detail below. Depending on design, the check valve device may be incorporated into the housing port or the sleeve of the valve.

Figure 46:
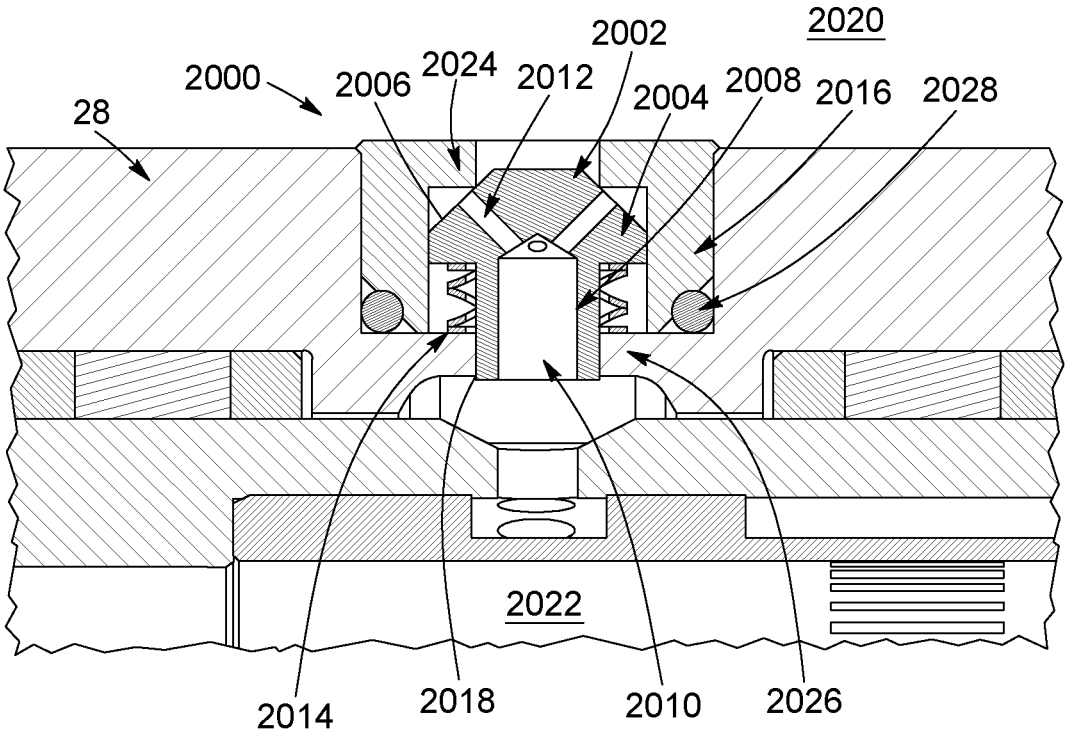
FIGS. 46 and 47 are side cut view schematics of a radial poppet type check valve for production only and injection only, respectively.
Figure 47:
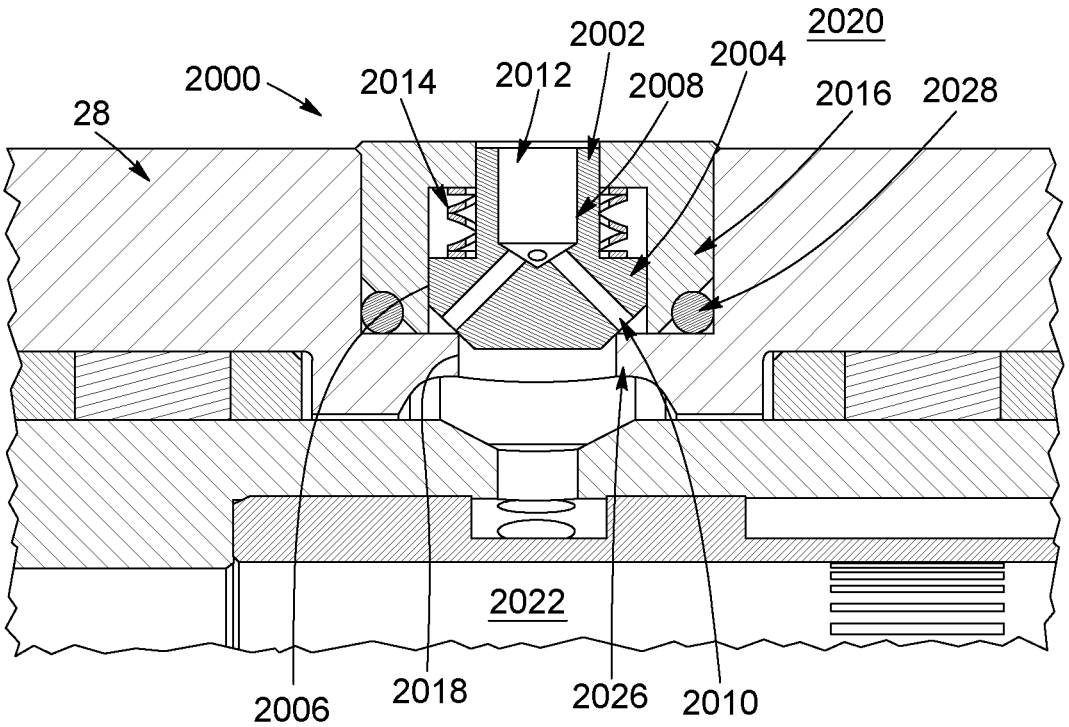

Referring to FIGS. 46 and 47, the check valve device 2000 can have a radial poppet design in which a poppet 2002 (e.g., a dart or a ball) can move between open and closed positions. These types of valves could be installed radially in the ports of a valve housing 28 or of a sleeve. FIG. 46 illustrates a radial poppet check valve 2000 preventing injection while enabling production, while FIG. 47 illustrates a radial poppet check valve 2000 preventing production while enabling injection. Both FIGS. 46 and 47 show the poppet check valve 2000 in a closed position. More particularly, the poppet check valve 2000 includes a poppet member 2002 that includes a body 2004 having outer surfaces 2006 and an internal fluid channel 2008 that has a proximal end 2010 and a distal end 2012. The poppet member 2002 is mounted within the port (e.g., the port of the housing 28 as illustrated) and is engaged with a biasing member 2014 (e.g., a spring) which biases the poppet member 2002 toward the closed position where the internal fluid channel 2008 is blocked from enabling fluid communication through the port. The poppet member 2002 can be mounted within a plug member 2016 that itself is mounted within the port. The outer surfaces of the poppet member 2002 can engage inner surfaces of the plug member 2016 and optionally a proximal portion 2018 of the port to enable the desired sealing and check valve functionality.

Referring to FIG. 46, fluid pressure from the exterior 2020 of the check valve (above the poppet member 2002 in the figure) forces the poppet member 2002 down, overcoming the upward biasing force of the biasing member 2014 to move the poppet member 2002 to an open position, and thus exposing the distal end 2012 of the internal fluid channel 2008 to the fluid and allowing the fluid to therefore pass from the distal end 2012 and out the proximal end 2010 of the internal fluid channel. In this manner, sufficient fluid pressure from the exterior 2020 can enable fluid flow through the poppet member 2002 and into the internal regions 2022 of the valve, thus enabling production fluid to flow into the valve. On the other hand, in the absence of a pressure differential or the presence of pressure from the interior 2022, the poppet member 2002 will remain in the closed position preventing fluid outflow. In this situation, fluid can pass through the proximal end 2010 of the internal fluid channel but there is no fluid communication between the distal end 2012 and the exterior 2020 of the valve.

Referring to FIG. 47, the poppet member 2002 has an orientation that is generally flipped 180 degrees compared to the check valve of FIG. 46 to enable similar functionality in the opposed direction. For instance, fluid pressure from the interior of the check valve (below the poppet member 2002 in the figure) forces the poppet member 2002 up, overcoming the downward biasing force of the spring 2014 to move the poppet to an open position, and thus exposing the proximal end 2010 of the internal fluid channel 2008 to the fluid and allowing the fluid to therefore pass from the proximal end 2010 and out the distal end 2012 of the internal fluid channel 2008. In this manner, sufficient fluid pressure from the interior can enable fluid flow through the poppet member 2002 and beyond the valve housing, thus enabling injection fluid to flow into the reservoir. On the other hand, in the absence of a pressure differential or the presence of pressure from the exterior 2020, the poppet member 2002 will remain in the closed position preventing fluid inflow. In this situation, fluid can pass through the distal end 2012 of the internal fluid channel 2008 but there is no fluid communication between the proximal end 2010 and the interior 2022 of the valve.

The poppet member 2002 can have various configurations. FIGS. 46 and 47 show a poppet member 2002 having a generally mushroom type shape with a trunk portion and a head portion. The spring 2014 can engage an undersurface of the head portion. However, the poppet member can have other shapes, such as a ball shape, which can be adapted to the other components of the check valve device to enable the sealing and movement functions in response to fluid pressures. The internal fluid channel 2008 can also have various configurations. In FIGS. 46 and 47, the internal fluid channel includes a main bore that is on the downstream side of the poppet member when in the open configuration enabling fluid flow. The internal fluid channel also includes at least one secondary bore that extends from the main bore to an opposed end of the poppet member. The secondary bore has an opening that is positioned relative to the internal surfaces of the sealing ring and/or the port such that the opening does not allow fluid communication beyond when the poppet member is in the closed position. FIGS. 46 and 47 show four secondary bores that extend from a single main bore at an angle (e.g., about 45 degrees) such that the respective openings communicate with a dead zone rather than with the apertures of the port.

In addition, the housing port and the plug member can be designed to facilitate sealing engagement of the poppet member at different locations. For example, referring to FIG. 46, the plug member can include an outer lip 2024 that is sized and configured to sealingly engage with the head portion of the poppet member 2002 inward of the channel openings, in the closed position. Similarly, referring to FIG. 47, the port can have a lower lip 2026 that is sized and configured to sealingly engage with the head portion of the poppet member 2002 inward of the channel openings, in the closed position. Furthermore, the side surfaces of the head portion of the poppet member 2002 can cooperate with corresponding inner surfaces of the plug member 2016 to provide a fluid seal while enabling the poppet member 2002 to move between the open position to the closed position where necessary. The check valve can also include a seal 2028 (e.g., an o-ring seal, NPT tapered threads where the plug member screws into the port having corresponding threads, one or more gaskets) enabling the plug member 2016 to have a sealed connections with the port.

Regarding the radial poppet check valves, each housing port around the housing wall can be provided with a corresponding check valve. In addition, the valve can also include a sleeve mounted inside the housing 28. The sleeve can include a flow restriction component, such as a tortuous path, as described elsewhere herein. The flow restriction can restrict fluid flowing into or out of the valve. The check valve can be designed in account for the level of flow restriction.

Still referring to FIGS. 46-47, the housing 28 receives a sleeve that can be composed of two pieces, the first engaging the inner surfaces of the housing 28 and the second being coupled within part of the first. The second piece can be press-fit within the first, for example. The valve can also have two seals (e.g., o-rings) on either side of the housing port and in between the outer surface of the sleeve (e.g., the first piece thereof) and the inner surface of the housing. The first piece of the sleeve can include one or more apertures in the wall thereof communicating with the housing port, while the second piece of the sleeve can include the flow control component (e.g., tortuous path). The sleeve can also be a one-piece component. Sleeves used in various valve embodiments described herein can be formed of one or more pieces that are fixed together.

Figure 48A:
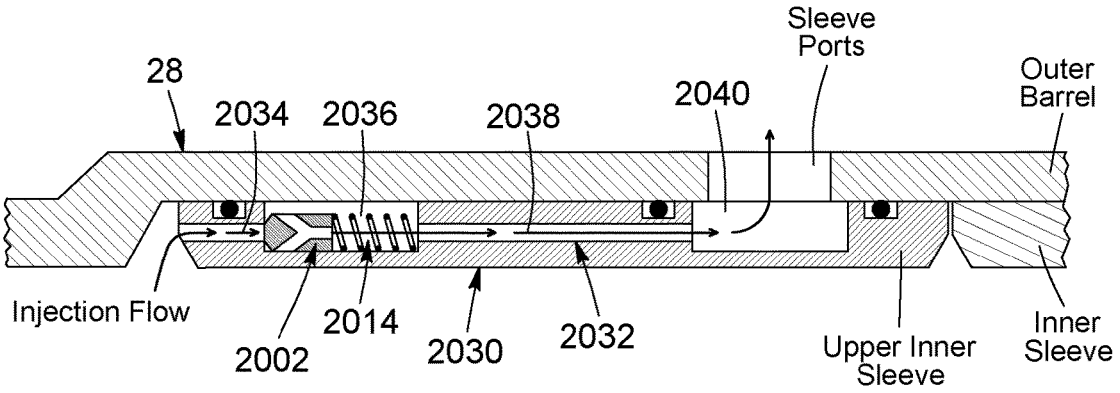
FIG. 48A is a side cut view schematic of part of a valve including an axial poppet type check valve integrated into a sleeve with the poppet in the closed position.
Figure 48B:
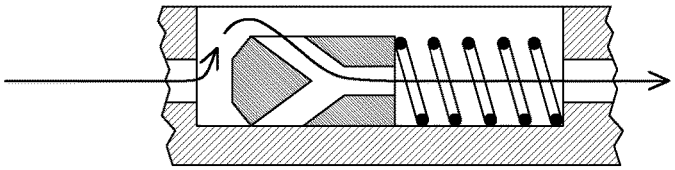
FIG. 48B is a close-up of part of FIG. 48A showing the poppet in the open position.

Referring now to FIGS. 48A-48B, an embodiment of an axial poppet check valve is shown. In this embodiment, the poppet member 2002 is incorporated within a sleeve 2030 for axial movement to prevent or allow fluid flow. The poppet member 2002 is mounted within a sleeve channel 2032 and functions in a similar way as the radial poppet described above. FIG. 48A shows the axial poppet member 2002 in the closed position as it abuts against inner surfaces of the sleeve channel 2032, and FIG. 48B shows that once fluid pressure forces the poppet downhole, fluid communication is created to enable flow past and/or through the poppet, along the sleeve channel, and then through the housing port into the exterior. FIGS. 48A-48B show an axial poppet check valve preventing production inflow and enabling injection outflow. An axial poppet check valve could also be provided for another valve for preventing injection outflow and enabling production inflow by reorienting the poppet member and the biasing member in a similar fashion as illustrated for the radial design. Referring still to FIG. 48A, the sleeve channel 2032 can have various different portions, such as an inlet portion 2034, a poppet chamber portion 2036, and a downstream portion 2038, and a discharge portion 2040 that includes an opening in the outer surface to the sleeve and being in fluid communication with the housing port. In FIG. 48A, the discharge portion 2040 can be formed as an annular chamber circumferentially around the sleeve, while the other portions of the sleeve channel have other configurations (e.g., tubular) and are radially enclosed within he sleeve and the poppet chamber portion 2036 can be a chamber that has side walls and has an open end such that the inner surface of the barrel defines a wall of the poppet chamber portion 2036.

Figure 49:
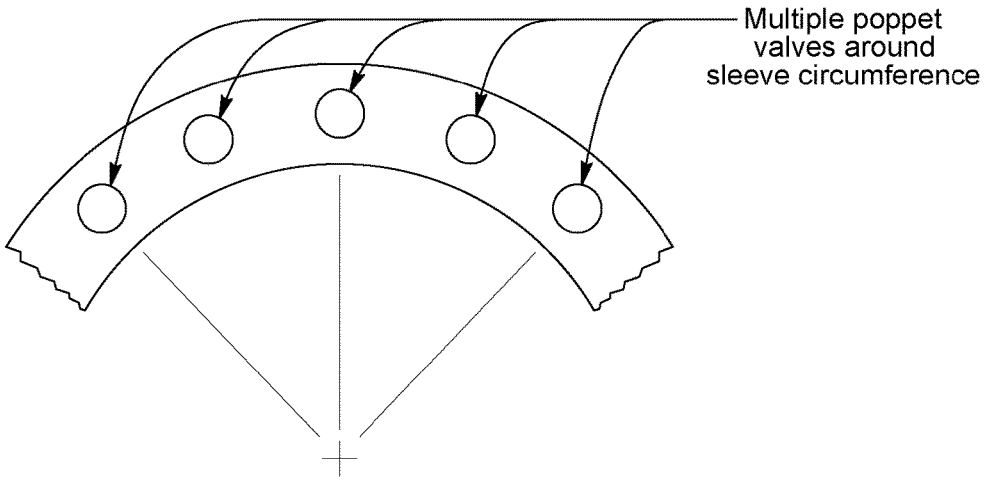
FIG. 49 is a transverse cut view of part of a sleeve that can be used in the valve that has axial poppet type check valves.

FIG. 49 shows that the sleeve 2030 can be provided with multiple sleeve channels 2032 that are distributed around its circumference. There may be two, three, four or more of the multiple sleeve channels 2032, each having a corresponding check valve such as the axial poppet valve. Providing multiple sleeve channels 2032 can facilitate having a relatively thin-walled sleeve 2030 for space considerations while having the desired fluid flow area for injection or production targets. While having a single sleeve channel may require a greater sleeve wall thickness, multiple sleeve channels distributed around the sleeve can allow for thinner walls. The sleeve channels 2032 can have various configurations with each portion having a corresponding shape. For example, the inlet portion 2034, the poppet chamber portion 2036, and the downstream portion 2038 can have a tubular shape defined within the wall of the sleeve, while the discharge portion 2040 could take the form of a single circumferential recess in the outer surface of the sleeve 2030. However, it is noted that other configurations are possible depending on the sleeve design and its cooperation with the inner surfaces of the housing, for example.

Figure 50:
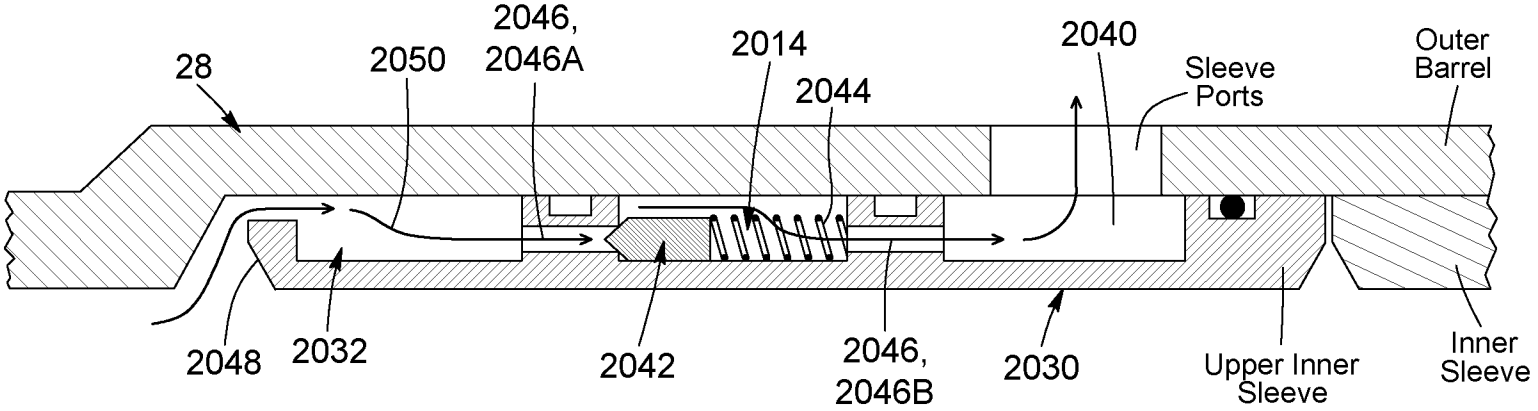
FIG. 50 is a side cut view schematic of part of an injection-only valve including a ring seal type check valve integrated into a sleeve with the ring in the closed position.
Figure 51:
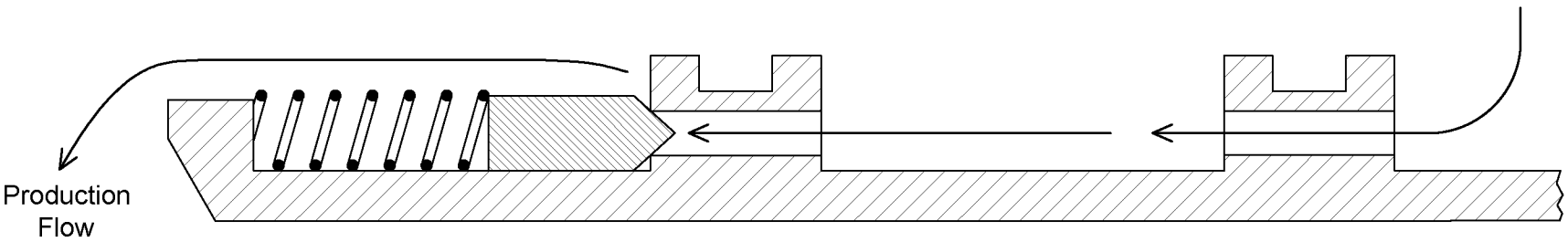
FIG. 51 is a close-up of part of a sleeve that can be used in a production-only valve and having ring seal type check valve in the closed position. Note that while the check valves in FIGS. 50-51, and certain others, are shown in the closed position, the figures also show the flow lines of the fluid for illustration purposes.
Figure 52:
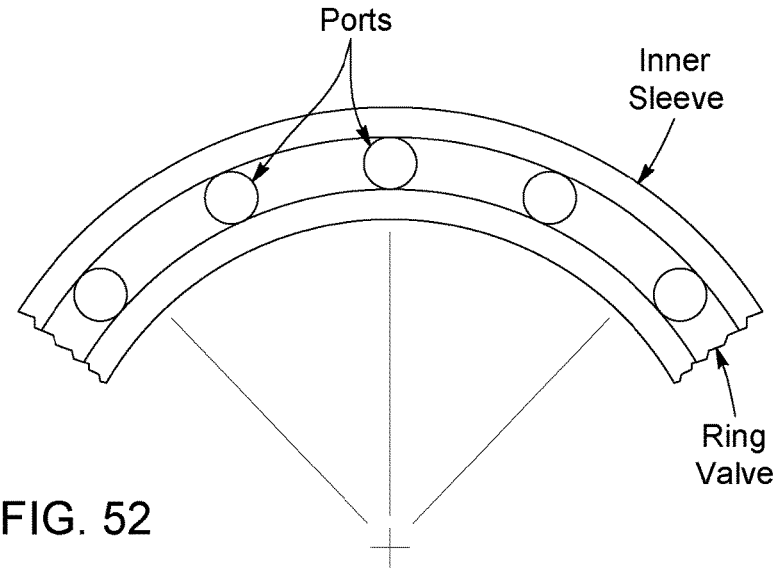
FIG. 52 is a transverse cut view of part of a sleeve that can be used in the valve that has a ring seal type check valve.

Turning now to FIGS. 50-52, the check valve device can be a ring type check valve that moves axially within a sleeve channel 2032. Analogous to the axial poppet, the ring check valve includes a ring plug member 2042 that engages with a biasing member 2014 to move axially within the sleeve channel 2032 between a closed position and an open position. The ring plug 2042 is located within a circumferential chamber 2044 of the sleeve and is, when the ring plug is in the open position, in fluid communication with the adjacent sleeve channel sections. The biasing member 2014 can be a spring or resilient structure, for example. The biasing member 2014 can include multiple individual biasing components distributed around the circumference of the ring plug 2042.

FIG. 50 shows the configuration for enabling injection, where fluid pressure from the interior of the valve will push the ring plug 2042 from the closed position (illustrated) down to an open position to enable fluid to flow around and past the ring plug 2042 toward the port of the valve housing. FIG. 51 shows a configuration for enabling production, where fluid pressure from the exterior of the valve will push the ring plug from the closed position (illustrated) up to an open position to enable fluid to flow around and past the ring plug toward the internal passage of the valve. The ring plug 2042 can be configured to be solid with no through channels, such that the fluid flows around it when the ring plug 2042 displaces to the open position. The ring plug 2042 can include a tapered end that engages corresponding surfaces of the circumferential chamber 2044 to create the seal and prevent fluid flow in the closed position.

The sleeve 2030 can include multiple sleeve channel portions. For example, the sleeve 2030 can include circumferential portions, such as the circumferential chamber 2044 and the discharge portion 2040, as well as tubular portions 2046 such as the portions that interconnect the discharge and circumferential portions. As shown in FIG. 52, and the circumferential chamber in which the ring plug is located can communicate with tubular portions of the sleeve channels. Alternative configurations of the sleeve channel portions are also possible.

FIG. 50 also shows an example configuration of the sleeve 2030 including various chambers, channel portions, and fluid communication features. For example, the sleeve 2030 can include an upper sleeve end 2048 that enables fluid flow from the main passage of the valve into the sleeve channel 2032. The sleeve channel 2032 can include tubular portions defined in and extending axially along the sleeve wall, as well as circumferential chambers that can be defined as recessed portions of the outer surface of the sleeve and the opposed inner surface of the housing. The sleeve 2030 can also have a first chamber 2050 followed by a first tubular portion 2046A leading into a second chamber 2044, a second tubular portion 2046B, and then the discharge portion 2040 that is in fluid communication with the housing ports. By providing a sleeve channel 2032 that has two chambers, the same sleeve design can be used in both a production-only vale and an injection-only valve by incorporating the ring plug and spring into one or the other chamber (e.g., as shown in FIGS. 50 and 51). Still, the sleeve chamber 2032 can also be designed to have a single chamber that houses the ring plug (or other plug member) such that flipping the plug from one side to the other would convert the sleeve between production-only and injection-only functionality. In another alternative embodiment, custom sleeves could be provided for each direction, i.e., production and injection, rather than providing a single sleeve design that can be adapted to both.

Referring now to FIGS. 53-58 and 63, a reed type check valve can be used wherein a reed is incorporated with the sleeve in various ways. The different reed type valves will be described in more detail below.

Figure 53:
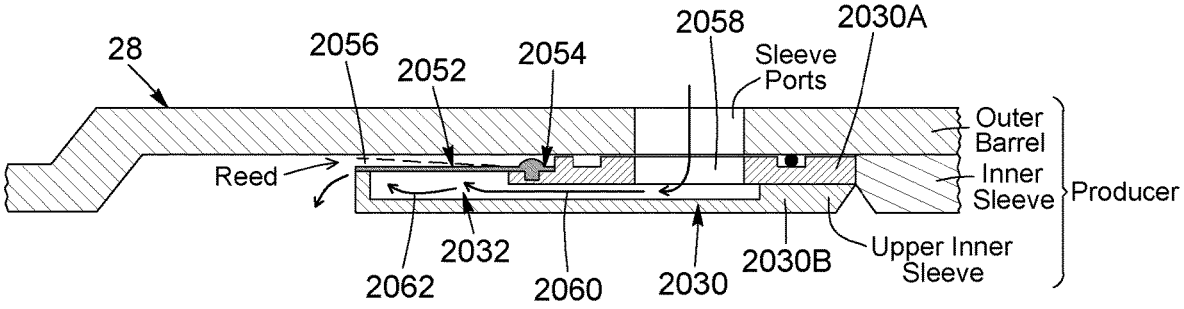
FIG. 53 is a side cut view schematic of part of a production-only valve including a side reed check valve integrated into a sleeve.
Figure 54:
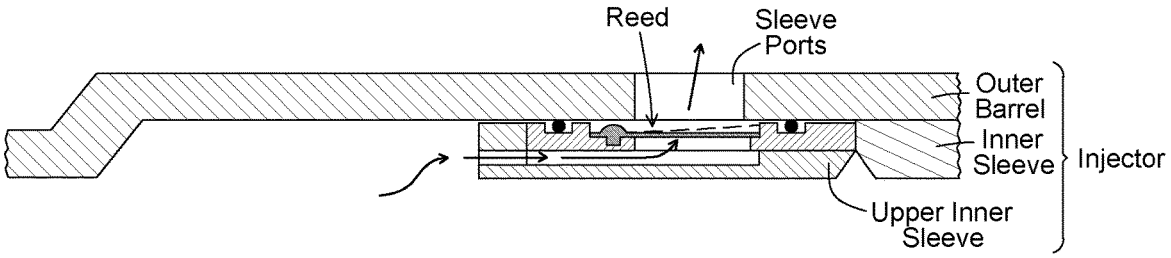
FIG. 54 is a side cut view schematic of part of an injection-only valve including a side reed check valve integrated into a sleeve.
Figure 55:
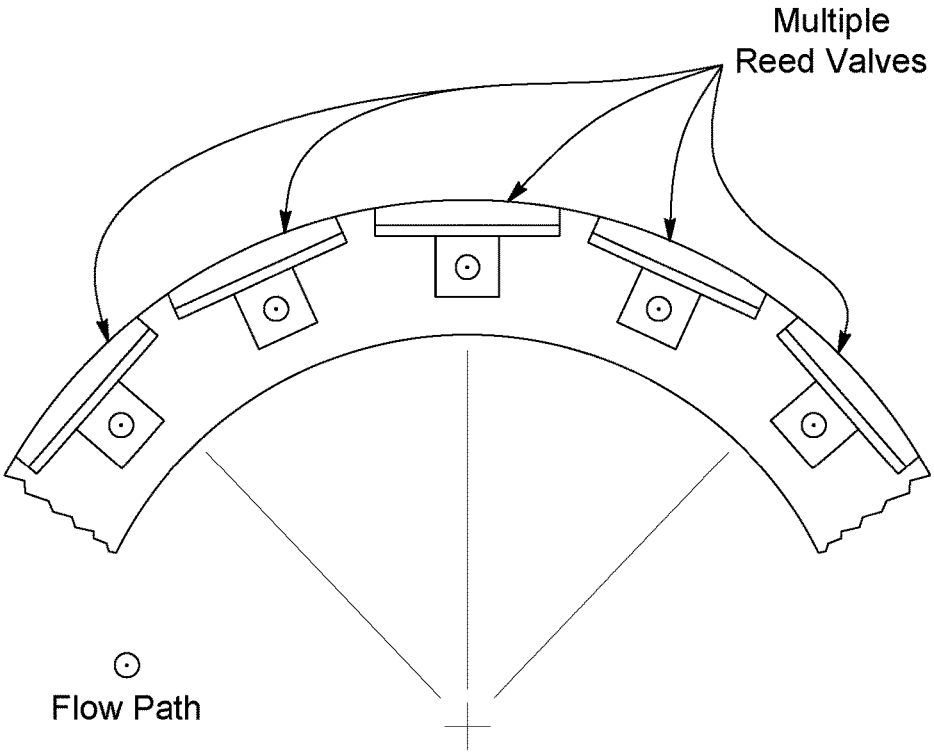
FIG. 55 is a transverse cut view of part of a sleeve that can be used in the valve that has reed type check valves.

Referring to FIGS. 53-55, each reed check valve can include a reed petal 2052 that is attached at one end to the sleeve 2030 via an attachment 2054 while enabling the opposed end to flex from a closed position to an open position in response to fluid pressure from one direction. FIG. 53 shows the reed petal 2052 fixed at a proximal end of the sleeve 2030 and arranged so that an end section of the reed petal 2052 can rest on a support portion of the sleeve 2030 in the closed position and then flex or pivot in response to fluid pressure from below to move the reed petal to the open position to define an opening that allows fluid communication past the reed petal 2052. In FIG. 53, the reed petal 2052 is arranged to flex radially outward in response to fluid pressure that flows from the exterior of the valve and through the sleeve channel 2032. There is a gap 2056 between the housing 28 and the sleeve 2030 to enable the reed petal 2052 to flex toward the housing inner surface to enable fluid to pass through. When the fluid pressure is on the inside of the valve, the reed petal 2052 tends to remain closed for the reed check valves of FIG. 53, which can thus be used in a production-only valve. In addition, the sleeve 2030 can be composed of two parts 2030A, 2030B, if desired, for ease of manufacturing and assembly of the different portions of the sleeve channel 2032 and other features.

Still referring to FIG. 53, the outer and inner sleeve parts 2030A, 2030B could be connected together using a press-fit or other connection methods. In addition, the outer sleeve part 2030A could include ports that align with the housing ports to allow fluid communication, and can also be provided with seals in between the housing and the outer sleeve part. The inner sleeve part 2030B could be configured to have appropriate fluid channels to provide fluid communication between the port of the outer sleeve part and the reed petal 2052. More regarding the sleeve channel and the sleeve parts will be discussed further below.

FIG. 54 shows a reed check valve for an injection-only scenario wherein the reed petal is arranged to flex radially outward in response to fluid pressure from the interior of the valve. Fluid can flow through the sleeve channel to force the reed petal to open and then flow through the housing port and into the reservoir. FIG. 54 shows the sleeve constructed with two parts, yet this sleeve could alternatively be provided as a one-piece structure. In addition, the sleeve could be only the outer sleeve part, although the inner sleeve part facilitates protection of the reed petal and corresponding opening from cement. In FIG. 54, the inner sleeve part could include uphole tubular channel portions followed by a circumferential portion that communicates with the ports of the outer sleeve part over which respective reed petals are provided.

The sleeve channel 2032 for the reed check valves of FIGS. 53 and 54 can be made up of tubular portions and circumferential portions. For example, as in FIG. 53, the sleeve channel 2032 can include one or more tubular inlet portion 2058 through the outer sleeve part 2030A of the sleeve which is a radial aperture through the wall of the outer part; a circumferential portion formed as a recess around the inner sleeve part 2030B and communicates with the inlet portions 2058; an axial tubular portion 2060 extending to a discharge chamber 2062 over which the reed petal 2052 is positioned. The discharge chambers 2062 can be radially milled from the outside with one reed petal per discharge, although one or more could be used. Since the ports of the housing are distributed about the circumference, the circumferential chamber (e.g., of the inner sleeve part) facilitates fluid communication with all of the radial ports as well as the axial tubular portions (e.g., 2060) leading to the chamber of the reed petal 2052. It is also noted that the portion 2060 of the sleeve channel can be a circumferential recess that communicates with the inlet portions 2058, with the discharge chambers 2062 being radial port portions that communicate with 2060. In FIG. 54, the sleeve channel portions can be arranged differently, as illustrated.

FIG. 55 shows an embodiment where the sleeve channel includes multiple sleeve channel portions that have respective reed check valves. For example each of the five channel portions shown in FIG. 55 have a corresponding reed valve petal provided over the corresponding chamber. A given sleeve can thus have multiple channel portions and respective reed valves to facilitate a target injection or production flow rate and also to provide redundancy in the event of a check valve malfunction or blockage.

The reed check valves illustrated in FIGS. 53-55 are arranged so that the reed petal flexes radially and thus deflects from a closed position that can be generally aligned with a longitudinal axis of the sleeve to an open position at an angle, which may be acute, with respect to the longitudinal axis. This general configuration can be referred to herein as a side-bending configuration of the reed check valve. The side-bending reed valve can be used for injection or production in various valve embodiments. The side-bending reed valve can be integrated within the sleeve of the valve, as shown in FIGS. 53-54, or with the housing itself if desired. As shown in FIGS. 53-54, the reed valve can be arranged so that the reed petal bends outward toward the open position, rather than bending inward toward the middle of the valve. Outward bending can reduce issues related to catching tools and the like that can be run through the sleeve. Orientations of the sleeve parts, the reed petal, and related equipment that reduce the risk of catching can be beneficial (e.g., reed petals that are shielded from tool deployment, as shown in FIGS. 53 and 54). In other terms, the reed petal can be oriented so that it does not create an obstruction. The reed petal can also be arranged facing either axial direction (the loose end uphole or downhole) with the sleeve and channels being arranged accordingly. there are various benefits related to features associated with the arrangements of FIGS. 53-55.

Figure 56:
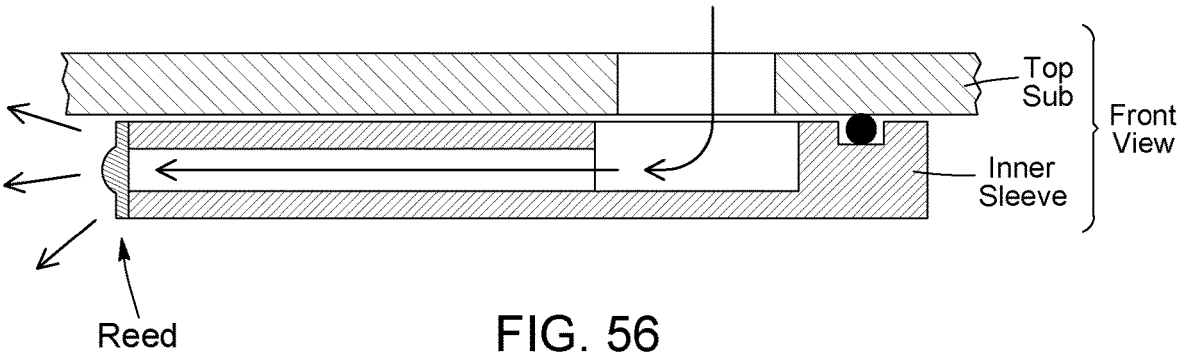
FIG. 56 is a side cut view schematic of part of a production-only valve including an end reed check valve integrated into a sleeve.

Turning to FIGS. 56, 57A and 57B, the reed check valve can be provided in an alternative arrangement that can be referred to as an end-bending configuration. In the closed position, the reed petal 2052 can be oriented generally perpendicular to the longitudinal axis of the sleeve 2030, and in response to fluid pressure the reed petal 2052 flexes to an angle to allow fluid passage in one direction. In this embodiment, the reed petal 2052 can be arranged to cover an outlet of the sleeve channel 2032. As shown in FIGS. 57A and 57B, multiple sleeve channel portions can be provided through the sleeve wall, each being covered by a reed petal 2052. A pair of adjacent sleeve channel portions can also be covered by a single reed petal 2052 with first and second sides that cover respective channel portions and the attachment 2054 securing the reed petal 2052 in between the adjacent sleeve channel portions. The reed petal 2052 could alternatively be secured to the end of the sleeve in other configurations so that the reed petal bends in one or various directions. It is noted that the end-bending configuration could also include an additional inner sleeve part configured to shield the reed petal.

While FIGS. 53-55 show a side-bending configuration and FIG. 56-57B show an end-bending configuration, it should be noted that other angle of the reed petal and associated channel portions are possible. In other words, the reed petal does not have to be parallel or perpendicular to the sleeve longitudinal axis, but can be oriented at other angles.

Referring to FIG. 58, it is also noted that the reed check valve can be provided in the form of an angled reed valve device 2066, where the reed petals 2052 are arranged at an angle with respect to the longitudinal orientation in the closed position. For example, the reed petals can be mounted to a reed block 2068 that includes a base plate 2070, angled walls 2072 extending from the base plate 2070 and side walls (not shown) also extending from the base plate, such that the walls define a flow cavity 2074. The base plate 2070 defines a base opening 2076, and the angled walls include openings 2078 over which the reed petals 2052 are provided. The fluid can flow through the base opening 2076, into the cavity 2074, and out of the openings 2078, deflecting the reed petals 2052 in one direction (i.e., from right to left in FIG. 58); but the fluid is prevented from flowing in the opposite direction. Each reed petal 2052 can also be overlaid with a stop plate 2080 that can be curved and configured to define the maximum open position of the reed petal. In this regard, is it noted that a dedicated stop plate component can be provided for various reed valves, or certain components of the valve (e.g., housing, sleeve, etc.) can act as a stop plate depending on the configuration of the reed petal. The reed block 2068 could be mounted to various parts of the valve or sleeve. For instance, the base plate 2070 could be mounted around a housing port or another fluid communication outlet so that its opening 2076 aligns with the outlet. Various different angles of the plates could be provided as well as sizing of the openings over which the reed petals lay.

Figure 63:
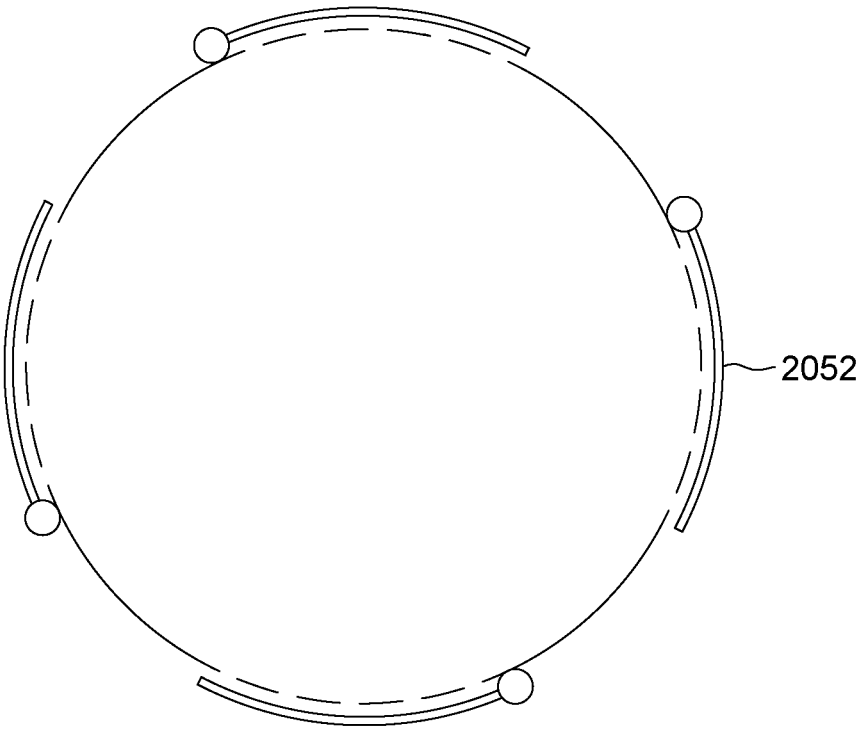
FIG. 63 is a transverse cut view schematic of a check valve sleeve with circumferential reed valves.

Referring to FIG. 63, the valve can include check valve components, such as reed petals, distributed around its circumference. Each of the check valves can be a reed type valve wherein the reed extends circumferentially around the outside or inside of the sleeve or housing. The circumferential reed valve schematically shown in FIG. 63 can have one or more additional features of FIGS. 53-58 adapted to the circumferential arrangement. The reed petals are rotated 90 degrees and are curved to accommodate the tubular shape. The reed petals could be on the inner barrel or exterior of the valve tool. Still referring to FIG. 63, in some implementations the upper barrel would cover the check valve while fracturing through the ports, and, when the upper barrel is slid down over the ports, slots to the circumferential reed valves would be exposed. Fluid could then be injected or produced depending on the orientation of reed valve. For example, the fluid could inject through the casing, into the slots, through the reed valve, and channeled to the ports where injection into the fractures can happen; production would be the opposite flowpath.

Figure 59:
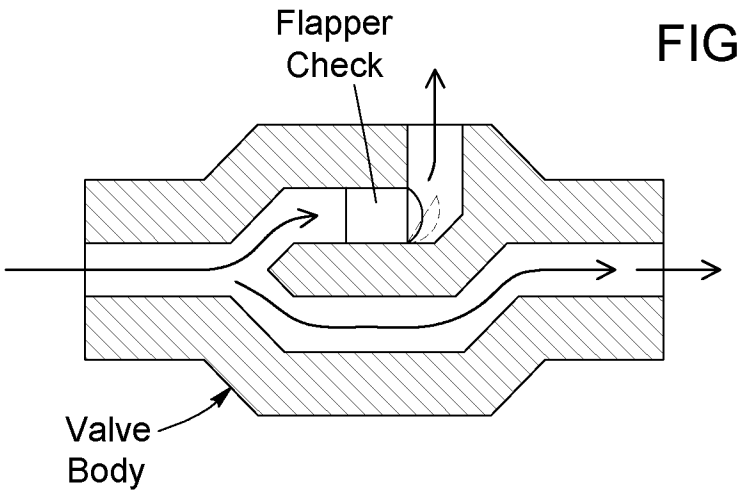
FIG. 59 is a side cut view schematic of an eccentric valve arrangement.
Figure 64:
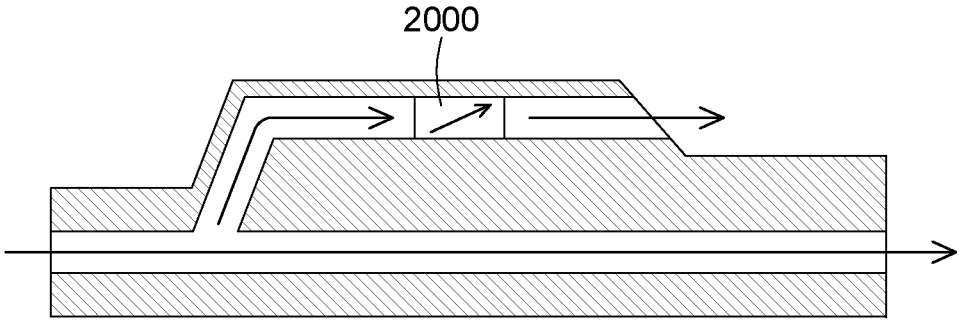
FIG. 64 is a side cut view schematic of another example eccentric valve arrangement.

Referring now to FIGS. 59 and 64, the check valve device can be part of an eccentric arrangement which can provide greater space for the flow path in which the check valve is located. FIG. 59 shows the check valve as being a flapper valve, but it is noted that various different types of check valves could be place in that flow path. With the eccentric location of the main flow path, the injection or production flow path can occupy a larger continuous part of the well bore and can thus accommodate a larger check valve device. The eccentric valve configuration relates to the layout of the check valve device that would be run in the well: the valve body would be run between packers to isolate the zones of an existing well, and the check valve device would be mounted in the valve eccentrically (e.g., similar to the valves of FIGS. 35-36). The injection or production path can extend from the main conduits in a Y configuration. This would allow using a larger check valve device (e.g., about 1 inch), which could be a ball, dart, flapper, reed, etc. type check valve device. Various check valve devices, such as off-the-shelf devices, could be used in the branch path of the eccentric valve. FIGS. 59 and 64 show two different configurations of the eccentric valve setup.

Figure 60:
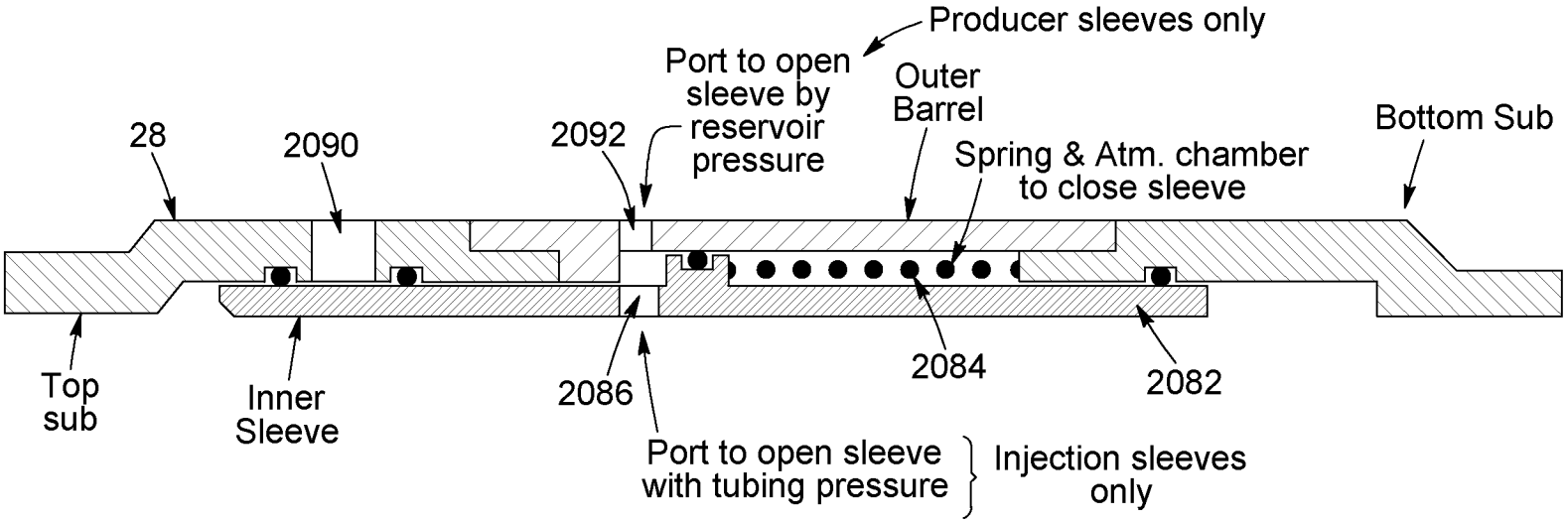
FIG. 60 is a side cut view schematic of part of a valve that includes a spring loaded sleeve, and schematically illustrating ports that would be present for use in an injection-only valve or a production-only valve.

Referring to FIG. 60, the check valve device can include a spring biased inner sleeve 2082. This system includes a spring 2084 or another biasing mechanism, a spring biased inner sleeve 2082 that has may have a sleeve port 2086, where the spring axially biases the sleeve to a closed position and the sleeve 2082 is forced toward the open position in response to fluid pressure entering through the sleeve port. The sleeve covers a housing port 2090 (or sub port) in the closed position. In an injection-only setup, in response to fluid pressure within the valve the fluid flows into the sleeve port 2086 and the sleeve 2082 is forced to move axially (to the right in the figure) to uncover the housing port to allow fluid communication out of the valve. In a production-only setup, in response to fluid pressure outside of the valve the fluid flows into a secondary housing port 2092 and the sleeve 2082 is forced to move axially (to the right in the figure) to uncover the primary housing port 2090 to allow fluid communication into the valve from the exterior. Note that only sleeve port 2086 or the secondary housing port 2092 would be provided. This sleeve could also be equipped with a tortuous path, e.g., in a second part of the sleeve that is connected to the first or as part of the main sleeve component. Note that the seal to the left of the flow ports may be removed if the inner sleeve is driven into the sub sufficiently to initiate a seal.

Figure 61:
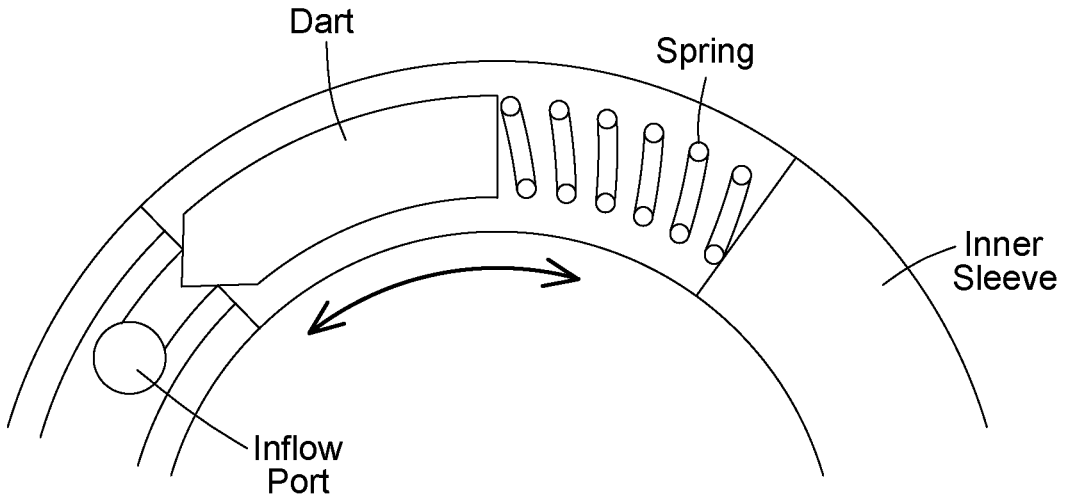
FIG. 61 is a transverse cut view schematic of a circumferential dart check valve integrated into a sleeve.

Referring to FIG. 61, the check valve device can include a circumferential dart setup where a dart is provided in a circumferential chamber of the sleeve and is biased to block a part of the sleeve channel. In the closed position, the dart would be positioned over an opening of the sleeve channel to prevent fluid flow, and the dart could be displaced by fluid pressure opposed to the spring force to open sleeve channel. In this configuration, multiple circumferential dart valves could be stacked along the sleeve to be axially spaced apart from each other. The dart could be provided so that it only allows fluid to flow around it or through it or both.

Figure 62:
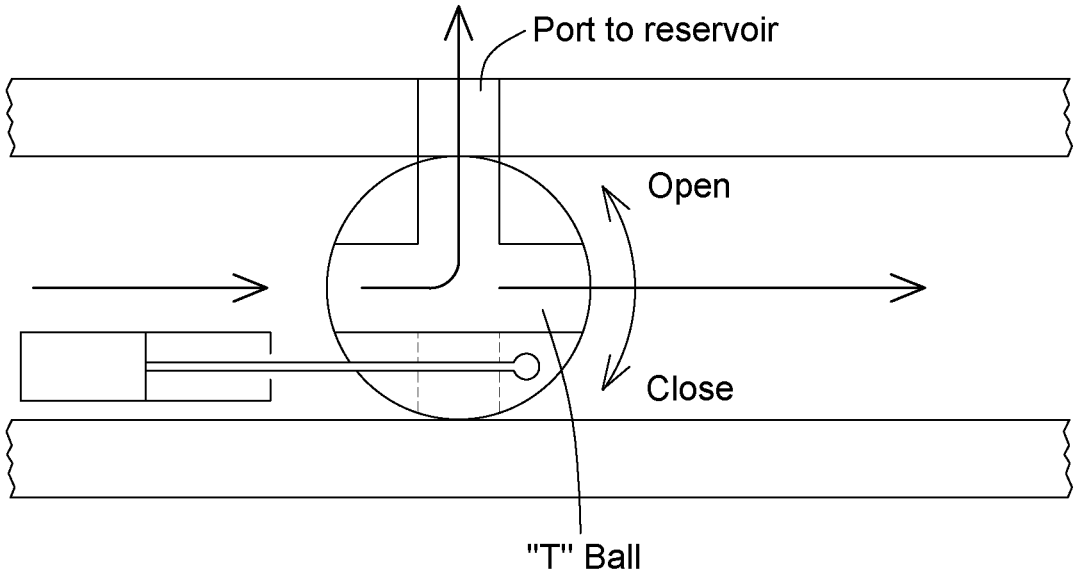
FIG. 62 is a side cut view conceptual schematic of part of a T-ball and piston type check valve.

Referring to FIG. 62, the check valve device can include a ball valve that includes a T-ball comprising a ball body and a T-passage in the body. The T-ball is coupled to a piston that drives the ball to open or closed positions, as illustrated. The piston can be driven by tubing or reservoir pressure to open or close the ball valve depending on injecting or producing.

It is noted that certain valve components can be designed and configured so that a given component can be assembled and used in conjunction with an injection check valve or a production check valve. As an example, FIGS. 50 and 51 illustrate how an upper inner sleeve of the valve can be provided with two chambers dedicated for receiving respective ring plugs. The sleeve receives a ring plug in one or the other chamber—not both—depending on the function as part of an injection or production check valve, but the sleeve design itself is configured to be able to function in both scenarios. Another example of a configuration that can be made to function as either injection or production check valve is shown in FIGS. 46 and 47, where the housing port and the seal ring are configured to receive the poppet and spring in either an inflow check or an outflow check setup. The housing port and the seal ring thus have sealing surfaces and support surfaces that are configured to work in either direction and in conjunction with the poppet design.

The check valve devices can be integrated with various valve implementations in different ways. It is also noted that multiple check valve devices could be integrated into a given valve, where the check valves are of the same or different type. For example, multiple check valves of the same type can be provided in a sleeve or a housing port of a give valve to operate in parallel with reach other. In addition, check valves could be provided in series with each other. Further, in some implementations, different check valves can be provided on a same valve, e.g., a radial poppet check valve could be provided in the housing port in addition to an axial poppet or ring in the sleeve that communicates with the housing port. Multiple check valve devices in a single valve can enable redundancy. For instance, serial check valves can be useful to ensure the check is maintained even in the event one of the valves becomes caught in the open position (e.g., due to debris or mechanical failures). Check valves in parallel can be useful for providing dimensions for the desired flow capacity while accounting for space considerations of the valve, since having a single checked channel may require an overly large dimensions for the target fluid flow while having multiple parallel channels each having a corresponding check valve can be provided with smaller dimensions while providing the overall size for the target fluid flow.

In addition, certain check valve types can be selected based on various factors, including the structural features of the valve, the use in a production-only valve or an injection-only valve, the operating parameters of the process including injection rates and fluid properties, and the reservoir properties. For example, in one implementation, the production-only valves can each include a check valve integrated into the housing port (e.g., radial poppet of FIG. 43) and may or may not have any flow restriction components (e.g., tortuous path provided in a sleeve); while the injection-only valves can each have a check valve integrated into the sleeve (e.g., axial poppet of FIG. 48A, ring valve of FIG. 50, side reed valve of FIG. 54, etc.) and each sleeve may or may not have a flow restriction component. In another example, the production-only valves can each have an end-reed valve provided on the sleeve (e.g., see FIGS. 56-57); while the injection-only valves could have another type of check valve integrated into their sleeves. Note that any combination of the check valve devices for injection- or production-only valves can be implemented.

Furthermore, the injection-only valves can be designed and configured for the particular injection fluid and/or injection flow rates based on process design. One benefit of providing both flow restriction (e.g., via a tortuous path) and check valve functionality on each valve is that the flow restriction can facilitate distributing the fluid pressure among the injection-only valves during an injection cycle, thereby reducing preferential "over-injection" through valves communicating with fast flow or high permeability pathways of the reservoir and under-injection through the other valves. Since distribution of fluid pressure is enhanced by the flow restrictions, there is more surety that all of the valves will receive sufficient fluid pressure to move the check valves to the open position during an injection cycle. This can also facilitate the design of injection check valves since the operating windows of injection cycles can be more predictable and consistent for the injection valves. Similar benefits can also be applicable for the production-only valves in terms of distributing the inflow of the production fluid among the valves and ensuring that all of the check valves of the production-only valves are open during a production cycle.

The check valve devices can also be configured so that, in the open position, certain fluid flow is promoted while inhibiting others. For example, hydrocarbon flow can be promoted while discouraging water flow; and/or liquid flow can be promoted while discouraging gas flow. This type of phase flow control functionality can be incorporated into the check valves, or enabled by a distinct component of the system.

As mentioned above, different check valves can be used for different valve constructions. The following provides a summary for example integration of check valve devices with different valve systems.

For example, valves such as the valves shown in FIGS. 18-22 and 26-34 can be equipped with check valve devices in certain parts. For example, a radial poppet valve can be provided in ports of the housing (which can be composed of various sub-components). Other types of check valve devices (e.g., the axial poppet, ring check, circumferential dart) can be provided in the sleeve or body of the valve. Other types of check valve devices, such as the side-bending reed or end-bending reed, can be provided in the sleeve. The eccentric valve and the spring sleeve could be provided as a new system.

Valves such as the valves shown in FIGS. 35-36 can be equipped with check valve devices in certain parts, but the check valves are not needed as these valves can be remotely controlled to open and closed positions.

Figure 43:
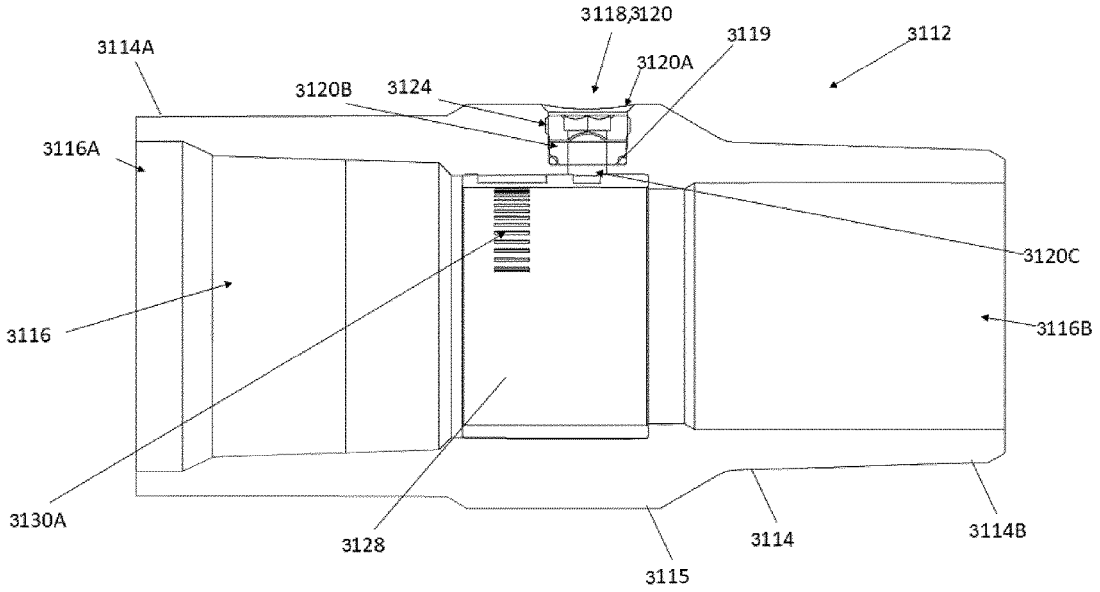
FIG. 43 is a side cut view schematic of another example valve that can be used in the context of frac-to-frac processes described herein. The illustrated valve includes a burst disc in the housing port and a flow restriction component that is part of the sleeve.
Figure 44:
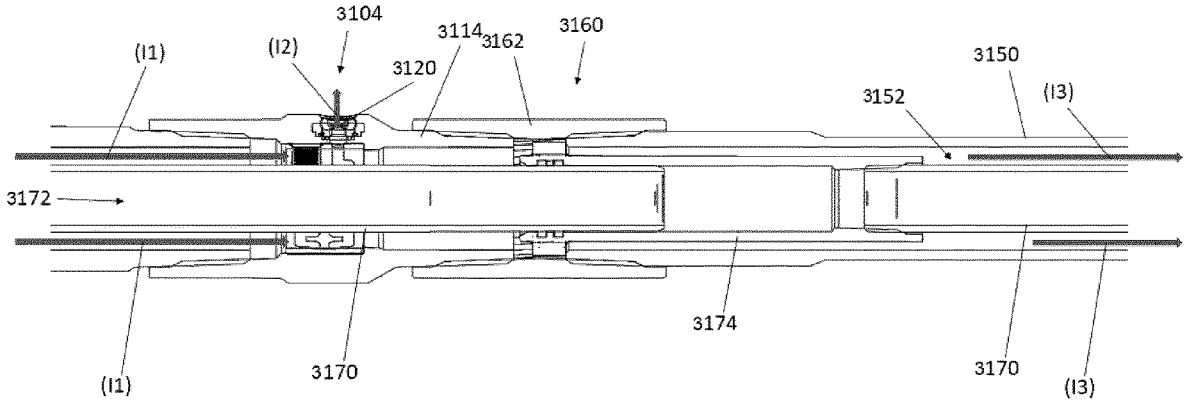
FIG. 44 is a side cut view schematic of a valve and completion assembly that can be used in the context of frac-to-frac processes described herein.

Valves such as the valves shown in FIGS. 43-44 can be equipped with check valve devices in certain parts of the system. For example, a radial poppet valve can be provided in the ports of the housing, while an axial poppet, ring check, side-bending reed or end-bending reed or circumferential dart can be provided in body. The check vales would be integrated while accounting for the burst disk, if present. The eccentric valve and the spring sleeve could be provided as a new system.

In addition, the valves that include at least one check valve device as described herein can be used in the context of asynchronous frac-to-frac processes, as well as other processes. For example, the valves can be used for stimulation, production and enhanced oil recovery of oil and gas wells. The valves can be used newly completed or recompleted wells. The valves can be used for asynchronous frac-to-frac processes as well as synchronous frac-to-frac processes where appropriate completions are provided for simultaneous injection and production. The valves can also be used controlling production inflow or injection outflow in other processes for hydrocarbon mobilization, stimulation and recovery. For valves that also have constructions for fracturing, the frac fluid flow path can be separate from the production flow path (e.g., side by side controlled by position of the inner sleeve, which can be positioned in open/closed/produce positions with a three-position sleeve).

In addition, check valve devices can facilitate solutions to a number of problems. For example, embodiments of the valve assemblies with integrated check valve devices can mitigate the problem of fluid losses during production or intervention operations by preventing fluid loss out of a well bore; can mitigate the problem of production loss from a high-pressure zone or a hydrostatic column to a lower pressure zone in a well; can enable an operator to produce a well from the highest pressured area until equalizing with lower pressured areas of the well, when all intervals will contribute to production; can mitigate the problem of diverting liquid/gas/polymer (e.g., $CO_2$ for miscible flooding) into certain portions of a well and not others, by enabling downhole mixing between hydraulic fractures and then producing oil or gas from alternating fractures; can facilitate stimulation and one or more of the following new drill wells and facilitate cemented or not cemented and one or more of the following: (i) control hydrostatic column of fluid to prevent or reduce fluid leak off in a well during stimulation and production, (ii) frac-to-frac operating with controlled injection and production in/out of specific intervals during EOR operations to improve or enhance ultimate oil recovery (UOR) (e.g., inject in to every even interval and product in every odd interval), (iii) control production flow based on fluid characteristics, (iv) control flow based on liquid or gas characteristics (viscosity, temp, oil saturation, phase, rheology). The valves can also be designed so that a first sliding sleeve can uncover a port for stimulation, a second sliding sleeve can then move into position opposite a port which contains a check valve device used to control, restrict, or stop flow in or out, and where the entire process can be reversed to go back to stimulate, inject fluid for flooding, or stop flow, if desired. Certain embodiments of the valve can be used for the following applications: cemented in place, open hole, stimulate, production, open-close, restrict or stop flow in one direction.

In some implementations, the check valve device would be designed to open under minimal flow such that the check valve is relatively sensitive to fluid activation. The check valve device can be designed so that it opens in response to a small fluid pressure and the spring is just strong enough to return the poppet to the closed position in response to zero pressure differential across the poppet. Alternatively, the check valve device could be designed without a spring and returns to the closed position when sufficient pressure is provided on that side of the valve. It is also noted that higher spring forces can facilitate re-closing of the check valve, which could provide some advantages for example in terms of reliability and debris removal. The cracking pressure of the check valve can be designed based on various parameters, and can be the same or different for valves along the well. Depending on the design, the check valve may have a closing pressure that is roughly equal to its cracking pressure or notably different. The design can depend on trade-offs between potential chattering, poppet (or other component) wear and increased flowing pressure versus low closing pressure. The flowing pressure can be additive with any uphole or downhole pressure drops. For the present application, a minimal restriction may be desired in the check valve yet sufficient to fully drive the poppet off of its seat to prevent chattering. Furthermore, if the biasing mechanisms is present, it can take various forms, such as a helical spring, a wave spring, a beam spring, a sealed air cushion, a resilient material, among others.

Further Valve Implementations

Further valve designs can be used in the context of the processes and system described herein. An example valve and completion system design are described in U.S. provisional application No. 63/092,656 (Werries & Powell) which is incorporated herein by reference. An example of this valve is shown in FIGS. 43 and 44 as valve 3112, which includes a valve housing 3114 and a valve sleeve 3128 mounted within the housing. The housing has a port 3120 in which a breakable barrier 124 (e.g., a burst disc) is provided and configured to burst in response to fluid pressure from inside, thus enabling fluid pressure activation of the valve. The valve sleeve 3128 also includes a flow restriction component 3126 that can take the form of a fluid channel that can be a tortuous path that winds (e.g., boustrophedonically) across a portion of the valve sleeve 3128. The valve sleeve 3128 can be fixedly secured to prevent axial movement, and such that the inlet of the fluid channel overlays the housing port. The valve sleeve could also be arranged so that it can be shifted axially from a position not aligned with the port, to a position aligned with the port for enabling fluid communication therewith. FIG. 44 shows the valve 3112 integrated within a completion system that includes various conduits and segments that are connected together as shown. Note that it could have a restriction and a check valve.

Figure 45:
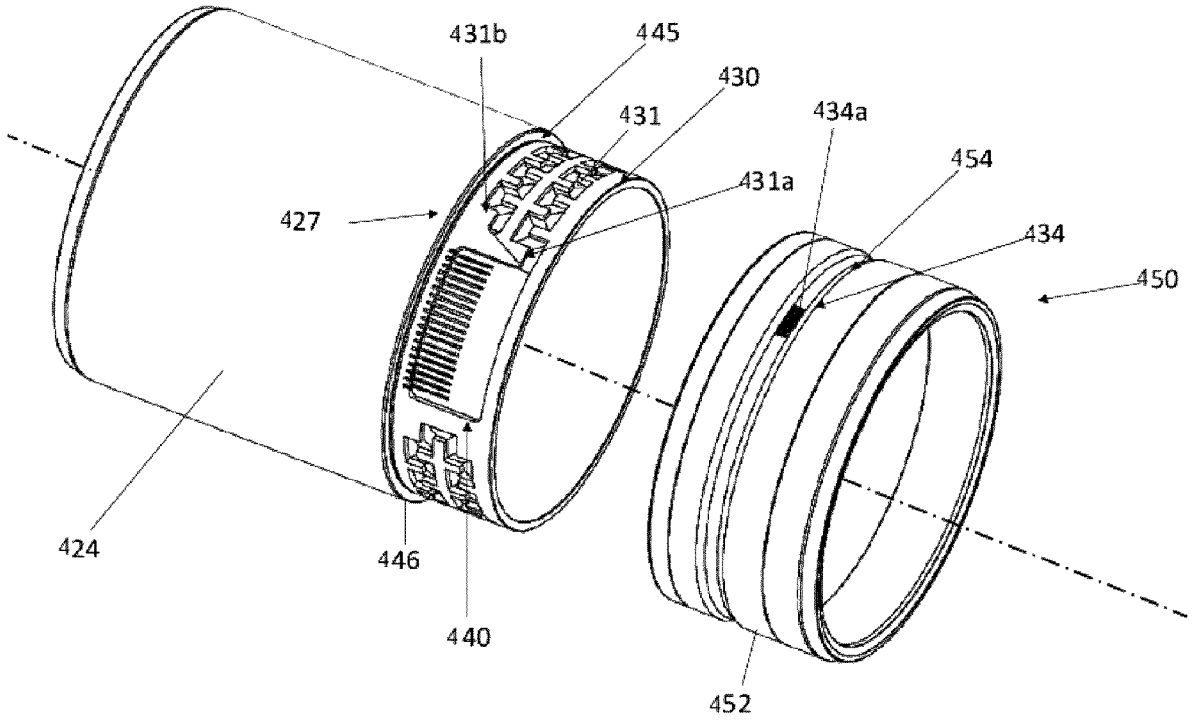
FIG. 45 is a perspective exploded view of a sleeve and a cap for enabling variable assembly for providing a certain flow restriction.

Referring to FIG. 45, an example sleeve 424 with a tortuous path flow restriction is illustrated. The sleeve 424 can be coupled to a cap 450 having an opening so that he opening aligns at a certain location of the tortuous path to define the length of the path and thus the level of flow restriction. Once the sleeve and cap assembly is mounted within a valve housing, the opening is alignable with the housing port. This sleeve and cap assembly facilitates providing variable flow restriction for different valves using the same component designs. It may be desirable to provide different valves along a well with different levels of flow restriction. A check valve device could be incorporated into the cap, e.g., within the opening or within flow channels defined in or by the cap.

Another example of a valve includes a hydraulic system instead of an electrical system for actuation. Such a valve can be similar to the valve of FIGS. 35-36, for example, but can be hydraulically remotely operated with hydraulic lines running up to the surface. The hydraulically-controlled valve can include two independent hydraulic lines that are attached to the valve, with each line combined with the valve creating a closed hydraulic system when including surface equipment. In this valve embodiment, the hydraulic lines also "feed-through" the body of the valve, where the control line continues on to the valves below in the well. Preferably, only two hydraulic lines are run for the entirety of the well. If one switches, for each consecutive valve assembly, which line controls "open" and which valve controls "closed", one is left with a system where pressuring up on line "A" (and bleeding off line "B" for return flow) opens half the valves and closes the other half. Reversing the flow path (high side B, low side A) reverses the configuration. The hydraulic system can thus be used for facilitating frac-to-frac operations where alternating valves can be configured as injection and production valves. Thus, during the injection cycle, a first alternating set of valves can be opening for receiving injection fluid, and then for the production cycle the hydraulic system can reverse in order to close the injection valves and open the production valves. The asynchronous frac-to-frac process can therefore use this type of hydraulic system without the required use of check valves, by actively opening and closing the valves according to the asynchronous operating schedule.

Another example of a valve assembly is described in U.S. provisional application No. 63/122,098 (Johnson et al.), which is incorporated herein by reference. This valve assembly has a valve sleeve that can be moved over housing ports by using an electrical cable that activates a hydraulic system so that hydraulic fluid can force the sleeve to move between open and closed positions, for example. This valve assembly can have various features similar to those of the hydraulic embodiment described above in terms of the sleeve, housing, ports, and hydraulics, although the hydraulic valve has a hydraulic connection that runs to surface instead of an electrical connection.

Further Process Implementations

In some implementations, the asynchronous frac-to-frac process is operated such that production and injection never occur at the same time. In other words, production is completely ceased prior to the start of the subsequent injection cycle, and the injection is completely ceased prior to the start of the subsequent production cycle. Thus, the injection cycle and the production cycle of the process do not overlap. When using completion systems where the production and injection fluids flow through the same conduit, this type of operation would occur naturally as one cannot have flow in both directions via the same conduit at the same time. In this implementation, there may also be a gap in between production and injection cycles where no production or injection occurs as surface equipment is readied for the subsequent cycle, for example.

However, when a dual-conduit completion system is used, the asynchronous frac-to-frac process can be operated with some overlap where there is production and injection occurring simultaneously. In a dual-conduit completion system, the production and injection conduits can be provided in a side-by-side configuration, with the production conduit being in fluid communication with the production-only valves and the injection conduit being in fluid communication with the injection-only valves. Alternatively, one conduit can be provided within the other, e.g., concentrically. In a dual-conduit completion system, the overlap between production and injection cycles may be slight or more pronounced. In addition, the production and injection cycles can be operated asynchronous such that during a given production cycle there is at least a period of time where injection completely ceases, and during a given injection cycle there is at least a period of time where production completely ceases. However, the asynchronous frac-to-frac process could also be operated where injection and production never complete cease, but are rather reduced during the opposite cycle of the process. One benefit of using a dual-conduit system in asynchronous frac-to-frac operations is that each cycle can be initiated and ramped up at the same time as the preceding cycle is being ramped down, thereby enabling less downtime between cycles which can lead to faster overall recovery. For example, the injection cycle can be initiated with fluid being injected down the well and starting to flow through the injection-only valves while the preceding production cycle is winding down yet while production fluid is still flowing to surface. In addition, it may be desirable in some cases to enable heat transfer between the injection and production fluids as they pass counter-currently with respect to each other during the overlap time between cycles. In addition, by continuing a small amount of injection and production at all times, it can also be possible to detect certain events or issues more rapidly than if the injection or production were completely shut down during the opposite cycle.

Furthermore, while the methods and systems disclosed herein have been described in relation to hydrocarbon recovery operations, it is also noted that the methods and systems could be adapted for other applications, such as solution mining, geothermal operations, among others, where fluids are injected and/or produced from a subterranean formation. The methods and systems can also be adapted for recovering various types of hydrocarbons from hydrocarbon-bearing formations.

The invention claimed is:

1. A process for producing hydrocarbons from a fractured reservoir via a well that has been operated for primary production of hydrocarbons, comprising:

conducting an asynchronous frac-to-frac operation comprising asynchronously injecting an injection fluid into the reservoir and producing production fluid from the reservoir respectively via injection-only valves and production-only valves provided in alternating relation along the well to enable frac-to-frac hydrocarbon recovery from fractured zones in the reservoir;

wherein the production-only valves and/or the injection-only valves each comprise:

a housing with a port for fluid communication therethrough;

a check valve device in fluid communication with the port for providing one-way flow; and a flow restriction component in fluid communication with the port and the check valve device and configured to restrict a flow rate of fluid flowing through the port, wherein the flow restriction component comprises a tortuous path, and wherein at least one of the following is true:

(i) the flow restriction component is provided by a sleeve that is mounted within the housing;

(ii) both the production-only valves and the injection-only valves each comprise corresponding flow restriction components and check valve devices; and (iii) only the injection-only valves comprise the flow restriction components and the check valve devices.

2. The process of claim 1, wherein the production-only valves are in fluid communication with a production conduit system that receives production fluid during production cycles, and the injection-only valves are in fluid communication with an injection conduit system providing the injection fluid during injection cycles, the injection conduit system being fluidly isolated from the production conduit system in the well; and the process further comprises, for at least one transition phase between injection and production cycles, simultaneously injecting and producing via the well.

3. The process of claim 2, wherein the at least one transition phase comprises a first transition phase wherein production is decreased and injection is initiated, and a second transition phase wherein injection is decreased and production is initiated.

4. The process of claim 3, wherein the first transition phase is controlled such that the injection is initiated by flowing the injection fluid down the injection conduit system while production is ongoing, but the injection fluid does not flow through the injection-only valves until production is ceased.

5. The process of claim 1, wherein the check valve device is provided in the port of the housing.

6. The process of claim 5, wherein the check valve device is a radial poppet check valve.

7. The process of claim 1, wherein the production-only valves and the injection-only valves are in fluid communication with a single well string comprising conduit sections that are interconnected together along the well, the well string providing the injection fluid during injection cycles and receiving production fluid during production cycles of the asynchronous frac-to-frac operation.

8. The process of claim 1, wherein the production-only valves are in fluid communication with a production conduit system, and the injection-only valves are in fluid communication with an injection conduit system that is fluidly isolated from the production conduit system in the well.

9. The process of claim 8, wherein the production conduit system and the injection conduit system are arranged in side-by-side relation to each other.

10. The process of claim 8, wherein the production conduit system and the injection conduit system are arranged concentrically with respect to each other.

11. The process of claim 1, wherein (ii) is true.

12. The process of claim 1, wherein (iii) is true.

13. The process of claim 1, wherein only the production-only valves comprise the flow restriction components and the check valve devices.

14. The process of claim 1, wherein (i) is true.

15. The process of claim 14, wherein the check valve device is provided in a sleeve channel defined by the sleeve.

16. The process of claim 15, wherein the check valve device comprises an axial poppet check valve, an axial dart check valve, a ring plug check valve, a reed check valve, or a circumferential dart check valve.

17. The process of claim 15, wherein the sleeve comprises a plurality of sleeve channels, each having a corresponding check valve provided therein.

18. The process of claim 14, wherein the sleeve is fixed with respect to the housing.

19. The process of claim 14, wherein the sleeve is slidable with respect to the housing between at least a first configuration and a second configuration.

20. The process of claim 19, wherein the sleeve of each valve comprises a production-only check valve device configured for alignment with the port of the housing when the sleeve is shifted in one direction, and an injection-only check valve device configured for alignment with the port of the housing when the sleeve is shifted in another direction.

21. A process for producing hydrocarbons from a fractured reservoir via a well that has been operated for primary production of hydrocarbons, comprising:

conducting an asynchronous frac-to-frac operation comprising asynchronously injecting an injection fluid into the reservoir and producing production fluid from the reservoir respectively via injection-only valves and production-only valves provided in alternating relation along the well to enable frac-to-frac hydrocarbon recovery from fractured zones in the reservoir;

wherein the production-only valves and/or the injection-only valves each comprise:

a housing having a central passage and a housing wall within a port therethrough for fluid communication between the central passage and an exterior of the housing; and a flow restriction component including a tortuous path to provide fluid communication between the port and the central passage, and wherein at least one of the following is true:

(i) the production-only valves and/or the injection-only valves each comprise a sleeve mounted within the central passage of the housing and comprising the flow restriction component, wherein the tortuous path comprises a groove in an outer surface of the sleeve;

(ii) both the injection-only valves and the production-only valves each include a corresponding sleeve providing the tortuous path therein;

(iii) the production-only valves and/or the injection-only valves each comprise a sleeve mounted within the central passage of the housing and comprising the flow restriction component, wherein the sleeve is fixedly mounted within the housing; and (iv) the production-only valves and/or the injection-only valves each comprise a sleeve mounted within the central passage of the housing and comprising the flow restriction component, wherein the sleeve is shiftably mounted within the housing and is shiftable between at least a non-aligned position and an aligned position in which the tortuous path is in fluid communication with the port of the housing.

22. The process of claim 21, wherein (i) is true.

23. The process of claim 21, wherein the tortuous path comprises a boustrophedonic pattern.

24. The process of claim 21, wherein (ii) is true.

25. The process of claim 21, wherein (iii) is true.

26. The process of claim 21, wherein (iv) is true.

27. A process for producing hydrocarbons from a fractured reservoir via a well that has been operated for primary production of hydrocarbons, comprising:

conducting an asynchronous frac-to-frac operating comprising asynchronously injecting an injection fluid into the reservoir and producing production fluid from the reservoir respectively via injection-only valves and production-only valves provided in alternating relation along the well to enable frac-to-frac hydrocarbon recovery from fractured zones in the reservoir, wherein the production-only valves and/or the injection-only valves each comprise:

a housing with a port for fluid communication therethrough; and a check valve device in fluid communication with the port for providing one-way flow, and wherein at least one additional valve is provided along the well and is operable to provide a non-checked configuration wherein fluid communication is provided with the reservoir in both inflow and outflow directions, and wherein the additional valve is provided in the non-checked configuration during the asynchronous frac-to-frac operation such that the additional valve enables both injection and production therethrough to operate as a cyclic huff-and-puff valve.

28. The process of claim 27, wherein the cyclic huff-and-puff valve is selected and operated to be in fluid communication with an isolated fractured zone that is hydraulically isolated from all other fractured zones of the reservoir.

* * * * *